US012203345B2

(12) United States Patent
Rodriguez et al.

(10) Patent No.: US 12,203,345 B2
(45) Date of Patent: Jan. 21, 2025

(54) METHOD FOR POSITIONING A MULTILATERAL JUNCTION WITHOUT THE NEED FOR A DEFLECTOR ASSEMBLY

(71) Applicant: Halliburton Energy Services, Inc., Houston, TX (US)

(72) Inventors: Franklin Rodriguez, Stavanger (NO); Yoann Santin, London (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/097,772

(22) Filed: Jan. 17, 2023

(65) Prior Publication Data

US 2023/0228172 A1 Jul. 20, 2023

Related U.S. Application Data

(60) Provisional application No. 63/300,539, filed on Jan. 18, 2022.

(51) Int. Cl.

| | |
|---|---|
| ***E21B 41/00*** | (2006.01) |
| ***E21B 7/06*** | (2006.01) |
| ***E21B 17/046*** | (2006.01) |
| ***E21B 17/06*** | (2006.01) |
| ***E21B 17/20*** | (2006.01) |

(Continued)

(52) U.S. Cl.

CPC ..... *E21B 41/0035* (2013.01); *E21B 7/061* (2013.01); *E21B 17/046* (2013.01); *E21B 17/06* (2013.01); *E21B 17/20* (2013.01); *E21B 23/12* (2020.05); *E21B 29/06* (2013.01); *E21B 34/063* (2013.01); *E21B 41/0042* (2013.01); *E21B 43/08* (2013.01)

(58) Field of Classification Search

CPC .. E21B 41/0035; E21B 41/0042; E21B 23/12; E21B 17/20

See application file for complete search history.

(56) References Cited

U.S. PATENT DOCUMENTS 2,054,766 A * 9/1936 Flury ..... E21B 27/00 166/163
4,694,878 A 9/1987 Gambertoglio
(Continued)

FOREIGN PATENT DOCUMENTS

CN 2916093 Y 6/2007
CN 106170601 A 11/2016
(Continued)

*Primary Examiner* — Christopher J Sebesta
*Assistant Examiner* — Lamia Quaim
(74) *Attorney, Agent, or Firm* — Scott Richardson; Parker Justiss, P.C.

(57) ABSTRACT

Provided is a multilateral junction, a well system, and a method. The multilateral junction, in at least one aspect, includes a mainbore leg having a first mainbore leg end and a second opposing mainbore leg end, as well as a lateral bore leg having a first lateral bore leg end and a second opposing lateral bore leg end. The multilateral junction, according to this aspect, further includes a lateral locating assembly coupled to the second opposing lateral bore leg end, the lateral locating assembly including: a tubular; and a bendable deflection tip coupled to the tubular, the bendable deflection tip configured to move between a straight position and a bent position upon the application of fluid pressure thereto.

34 Claims, 77 Drawing Sheets

(51) Int. Cl.

| | |
|---|---|
| ***E21B 23/12*** | (2006.01) |
| ***E21B 29/06*** | (2006.01) |
| ***E21B 34/06*** | (2006.01) |
| *E21B 43/08* | (2006.01) |

(56) References Cited

U.S. PATENT DOCUMENTS

| | | | | |
|---|---|---|---|---|
| 5,154,231 | A | 10/1992 | Bailey et al. | |
| 5,474,126 | A | 12/1995 | Lynde et al. | |
| 5,526,880 | A | 6/1996 | Jordan, Jr. et al. | |
| 6,041,860 | A | 3/2000 | Nazzal et al. | |
| 6,186,277 | B1 | 2/2001 | Tervo | |
| 6,209,644 | B1 | 4/2001 | Brunet | |
| 6,527,067 | B1 | 3/2003 | Ravensbergen et al. | |
| 6,685,236 | B2 | 2/2004 | Setterberg, Jr. | |
| 7,905,279 | B2 | 3/2011 | Hart et al. | |
| 8,220,547 | B2 | 7/2012 | Craig et al. | |
| 9,476,285 | B2 | 10/2016 | Zhou | |
| 9,951,573 | B2 | 4/2018 | Dahl et al. | |
| 2001/0042621 | A1 | 11/2001 | Leising | |
| 2005/0095156 | A1 | 5/2005 | Wolters et al. | |
| 2006/0042792 | A1* | 3/2006 | Connell | E21B 23/12 166/255.3 |
| 2006/0201677 | A1 | 9/2006 | Moody et al. | |
| 2009/0151950 | A1* | 6/2009 | Patel | E21B 47/12 166/244.1 |
| 2010/0226206 | A1 | 9/2010 | Al-Khamis | |
| 2014/0000914 | A1 | 1/2014 | Steele | |
| 2014/0102716 | A1 | 4/2014 | Benson et al. | |
| 2015/0285016 | A1* | 10/2015 | Lajesic | E21B 7/061 166/50 |
| 2015/0345241 | A1 | 12/2015 | Glaser et al. | |
| 2016/0145956 | A1 | 5/2016 | Dahl et al. | |
| 2016/0258251 | A1 | 9/2016 | Hornsby et al. | |
| 2017/0260834 | A1* | 9/2017 | Chacon | E21B 47/024 |
| 2017/0362896 | A1 | 12/2017 | Rodriguez | |
| 2018/0274300 | A1 | 9/2018 | Vemuri et al. | |
| 2019/0040719 | A1* | 2/2019 | Rodriguez | E21B 41/0042 |
| 2021/0102443 | A1 | 4/2021 | Glaser | |
| 2021/0156232 | A1 | 5/2021 | Rodriguez | |
| 2021/0172294 | A1 | 6/2021 | Steele et al. | |
| 2022/0259949 | A1 | 8/2022 | Rodriguez et al. | |
| 2023/0228170 | A1 | 7/2023 | Rodriguez et al. | |
| 2023/0228172 | A1 | 7/2023 | Rodriguez et al. | |

FOREIGN PATENT DOCUMENTS

| | | | |
|---|---|---|---|
| GB | 2406349 | B | 2/2006 |
| WO | 2015187297 | A1 | 12/2015 |
| WO | 2016060657 | A1 | 4/2016 |

* cited by examiner

METHOD FOR POSITIONING A MULTILATERAL JUNCTION WITHOUT THE NEED FOR A DEFLECTOR ASSEMBLY

CROSS-REFERENCE TO RELATED APPLICATION

This application claims the benefit of U.S. Provisional Application Ser. No. 63/300,539, filed on Jan. 18, 2022, entitled "DETACHABLE WHIPSTOCK WITH SEALING CAPABILITIES FOR MULTILATERAL SYSTEMS," commonly assigned with this application and incorporated herein by reference in its entirety.

BACKGROUND

Multilateral wells include one or more lateral wellbores extending from a main wellbore. A lateral wellbore is a wellbore that is diverted from the main wellbore. A multilateral well may include one or more windows or casing exits to allow corresponding lateral wellbores to be formed. A milling assembly deflects upon a whipstock assembly to penetrate part of the casing joint and form the window or casing exit in the casing string, as well as to drill and complete the lateral wellbore. The milling assembly and the whipstock assembly are subsequently withdrawn from the wellbore. Thereafter, a deflector assembly is positioned at a junction between the main wellbore and lateral wellbore, wherein the deflector assembly is used to deflect other completion tools into the lateral wellbore.

BRIEF DESCRIPTION

Reference is now made to the following descriptions taken in conjunction with the accompanying drawings, in which.

DETAILED DESCRIPTION

Figure 1:
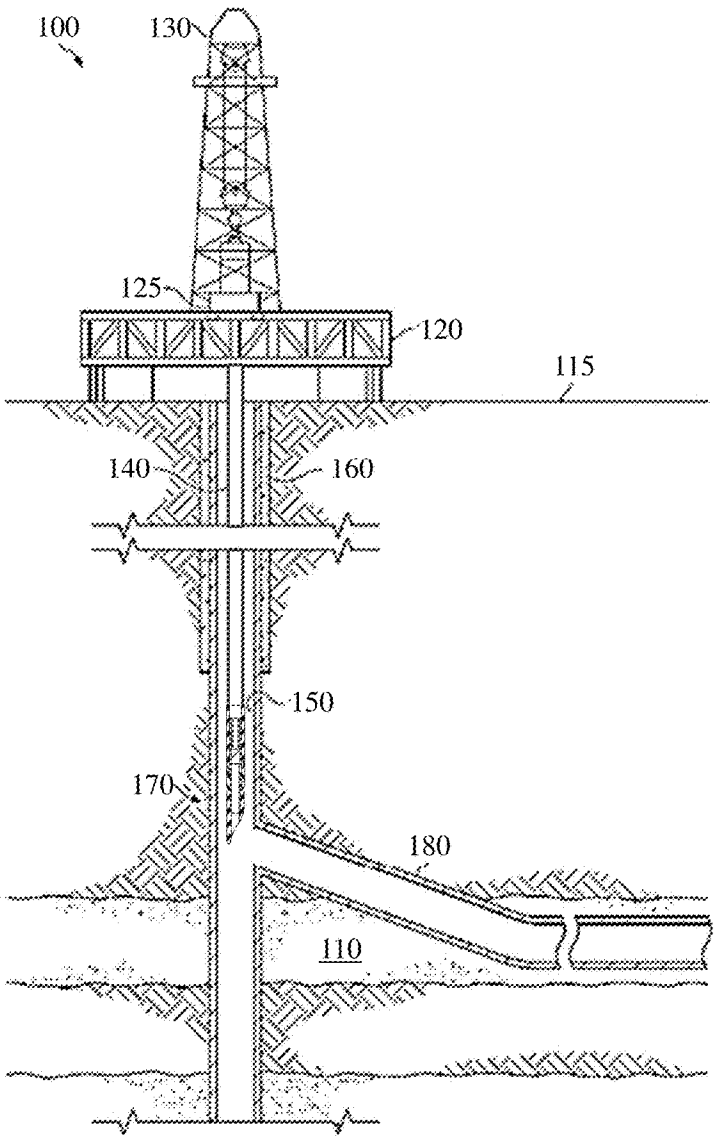
FIG. 1 is a schematic view of a multilateral well according to one or more embodiments disclosed herein.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water, such as ocean or fresh water.

A subterranean formation containing oil and/or gas hydrocarbons may be referred to as a reservoir, in which a reservoir may be located on-shore or off-shore. Reservoirs are typically located in the range of a few hundred feet (shallow reservoirs) to tens of thousands of feet (ultra-deep reservoirs). To produce oil, gas, or other fluids from the reservoir, a well is drilled into a reservoir or adjacent to a reservoir.

A well can include, without limitation, an oil, gas, or water production well, or an injection well. As used herein, a "well" includes at least one wellbore having a wellbore wall. A wellbore can include vertical, inclined, and horizontal portions, and it can be straight, curved, or branched. As used herein, the term "wellbore" includes any cased, and any uncased (e.g., open-hole) portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet of the wellbore. As used herein, "into a well" means and includes into any portion of the well, including into the wellbore or into the near-wellbore region via the wellbore.

While a main wellbore may in some instances be formed in a substantially vertical orientation relative to a surface of the well, and while the lateral wellbore may in some instances be formed in a substantially horizontal orientation relative to the surface of the well, reference herein to either the main wellbore or the lateral wellbore is not meant to imply any particular orientation, and the orientation of each of these wellbores may include portions that are vertical, non-vertical, horizontal or non-horizontal. Further, the term "uphole" refers to a direction that is towards the surface of the well, while the term "downhole" refers to a direction that is away from the surface of the well.

FIG. 1 is a schematic view of a well system 100 according to one or more embodiments disclosed herein. The well system 100 includes a platform 120 positioned over a subterranean formation 110 located below the earth's surface 115. The platform 120, in at least one embodiment, has a hoisting apparatus 125 and a derrick 130 for raising and lowering pipe strings, such as a tubing string 140. Although a land-based oil and gas platform 120 is illustrated in FIG. 1, the scope of this disclosure is not thereby limited, and thus could potentially apply to offshore applications. The teachings of this disclosure may also be applied to other land-based multilateral wells different from that illustrated.

As shown, a main wellbore 150 has been drilled through the various earth strata, including the subterranean formation 110. The term "main" wellbore is used herein to designate a wellbore from which another wellbore is drilled. It is to be noted, however, that a main wellbore 150 does not necessarily extend directly to the earth's surface, but could instead be a branch of yet another wellbore. A casing string 160 may be at least partially cemented within the main wellbore 150. The term "casing" is used herein to designate a tubular string used to line a wellbore. Casing may actually be of the type known to those skilled in the art as a "liner" and may be made of any material, such as steel or composite material and may be segmented or continuous, such as coiled tubing. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

A lateral locating assembly 170 according to one or more embodiments of the present disclosure may be positioned at a location in the main wellbore 150. Specifically, the lateral locating assembly 170 would be placed at a location in the main wellbore 150 where an exit window may be milled for access to a lateral wellbore 180. Accordingly, the lateral locating assembly 170 may be used to support one or more tools accessing the lateral wellbore 180. In some embodiments, the lateral locating assembly 170 may include an inner diameter running there through for fluid access, for example without needing support from a whipstock or traditional deflectors or deviation systems. In fact, the well system 100 of FIG. 1 may operate without any deflectors in one or more embodiments of the disclosure.

The lateral locating assembly 170, in one or more embodiments, may include a housing and a piston positioned within the housing. A mandrel may extend from a distal end of the housing, and the mandrel may be configured to rotate and translate angularly in response to the piston moving from a first position to a second position. A bendable deflection tip may be coupled with a distal end of the mandrel, the deflection tip configured to rotate and angularly translate with the mandrel relative to the housing. When the lateral locating assembly 170 reaches the exit window for the lateral wellbore 180, an axial force (e.g., via fluid pressure) may be applied to the piston to move the piston from the first position to the second position, thereby rotating the mandrel and deflection tip. An angled inner surface in a distal end of the housing may be configured to engage a ramp positioned on an outer surface of the mandrel such that as the mandrel and the deflection tip coupled thereto rotate, the mandrel and deflection tip may also translate angularly with respect to the housing and into the lateral wellbore 180.

Figure 2A:
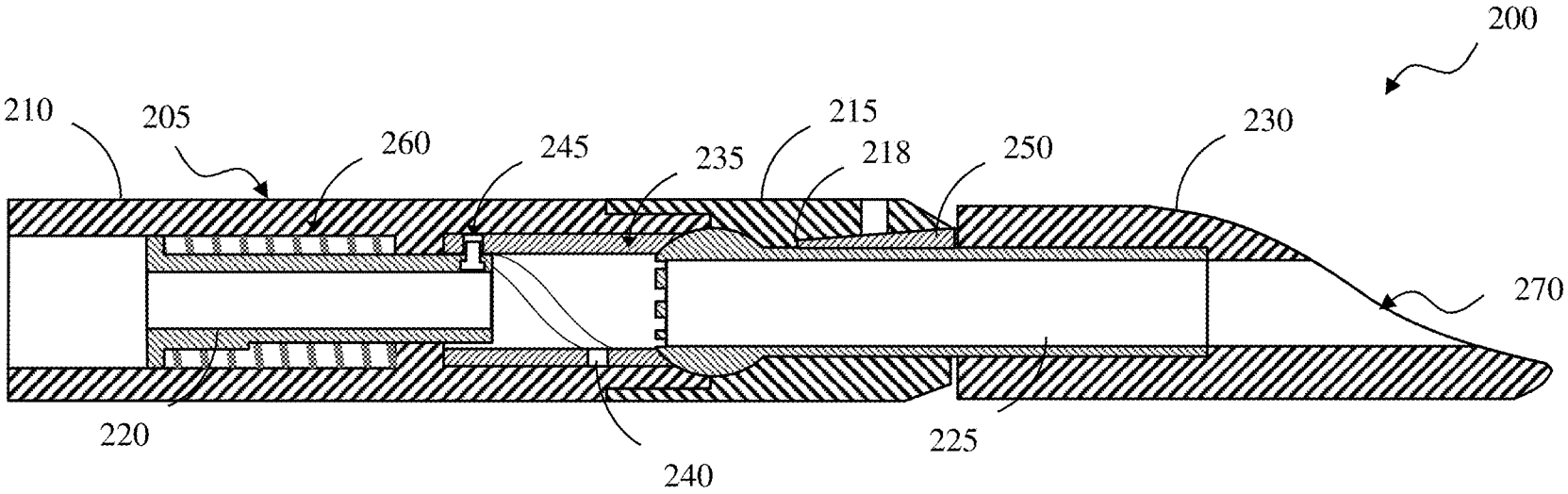
FIG. 2A illustrates a lateral locating assembly designed and manufactured according to one or more embodiments of the disclosure, for example shown in a run-in-hole state.
Figure 2B:
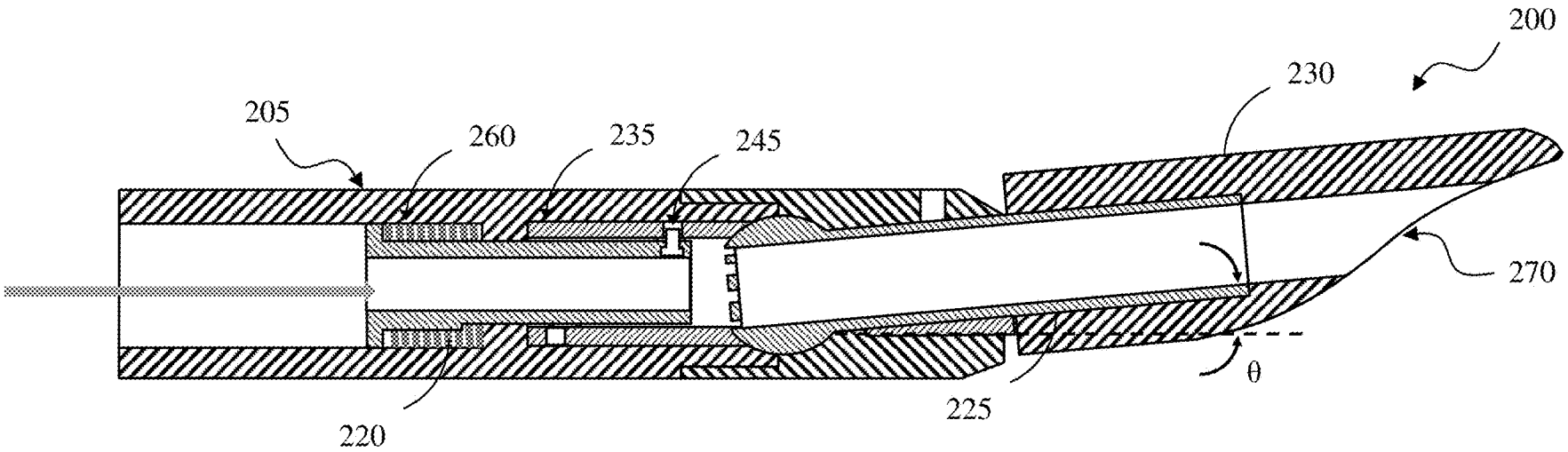
FIG. 2B illustrates the lateral locating assembly shown in FIG. 2A in a deflected state.

Turning now to FIGS. 2A and 2B, there is shown one embodiment of a lateral locating assembly 200 designed and manufactured according to one or more embodiments of the disclosure. The lateral locating assembly 200 is shown in FIG. 2A in a run-in-hole state (e.g., straight position) and shown in FIG. 2B in a deflected state (e.g., bent position). The lateral locating assembly 200, in one embodiment, may include a housing 205. Positioned within the housing 205 may be a piston 220, the piston 220 configured to move from a first position as shown in FIG. 2A to a second position as shown in FIG. 2B. In some embodiments, a mandrel 225 may extend from a distal end of the housing 205, the mandrel 225 configured to rotate and translate angularly in response to the piston 220 moving from the first position to the second position. In some embodiments, the mandrel 225 may rotate about 180 degrees relative to the housing 205.

A deflection tip 230 (e.g., bendable deflection tip) may be coupled with a distal end of the mandrel 225 and configured to rotate and angularly translate with the mandrel 225 relative to the housing 205 as the piston 220 moves from the first position to the second position. The deflection tip 230 is illustrated in FIGS. 2A and 2B as a separate feature. Nevertheless, other embodiments may exist wherein the deflection tip and the mandrel 225 are a single feature. In certain embodiments, the deflection tip 230 is configured to rotate by about 180 degrees and angularly translate (e.g., bend) by an angle (θ) of at least about 5 degrees as the piston moves from the first position to the second position. In some other embodiments, the deflection tip 230 may be configured to rotate eccentrically by about 180 degrees and angularly translate (e.g., bend) by an angle (θ) of at least about 5 degrees.

In the illustrated embodiment, a rotating transmission sleeve 235 may be coupled between the piston 220 and the mandrel 225. The rotating transmission sleeve 235 may include a helical channel 240. The helical channel 240 may engage a protrusion 245 on the piston 220 such that the helical channel 240 may follow the protrusion 245 and rotate the rotating transmission sleeve 235 as the piston 220 moves from the first position to the second position. As the rotating transmission sleeve 235 rotates, the mandrel 225 and the deflection tip 230 may likewise rotate and angularly translate relative to the housing 205.

In some embodiments, the housing 205 may include a piston housing 210 on a proximal end thereof and a separate eccentric housing 215. The eccentric housing 215, in one or more embodiments, may include an angled inner surface 218.

In the illustrated embodiment a ramp 250 (e.g., eccentric ramp) may be coupled on an outer surface of the mandrel 225. The ramp 250 may be configured to engage the angled inner surface 218 of the housing 205 as the mandrel 225 rotates, and thereby angularly translate the mandrel 225 relative to the housing 205. In this embodiment, the piston 220 may be maintained in the first position by a spring 260 and as such the deflection tip 230 is maintained in a neutral, run-in-hole state (e.g., straight position). An axial (linear) force may be applied to the piston 220, which may compress the spring 260 and thereby move the piston 220 from the first position shown in FIG. 2A to the second position shown in FIG. 2B (e.g., bent position).

When lateral intervention is no longer necessary, the lateral locating assembly 200 may in some embodiments be returned to the run-in-hole, or neutral, position shown in FIG. 2A, wherein the piston 220 may be returned from the second bent position back to the first straight position. As such, the deflection tip 230 may be rotated and angularly translated from the deflected state shown in FIG. 2B back to the run-in-hole position shown in FIG. 2A. The lateral locating assembly 200 may then be retrieved uphole, or may be positioned at another location within the wellbore for access of another lateral wellbore portion. The lateral locating assembly 200 may accordingly provide access to at least one lateral wellbore without the need for other downhole tools, such as a deflector or other supporting tools, and thus, additional trips into the wellbore by a tubing string or downhole conveyance may not be required.

Figure 3A:
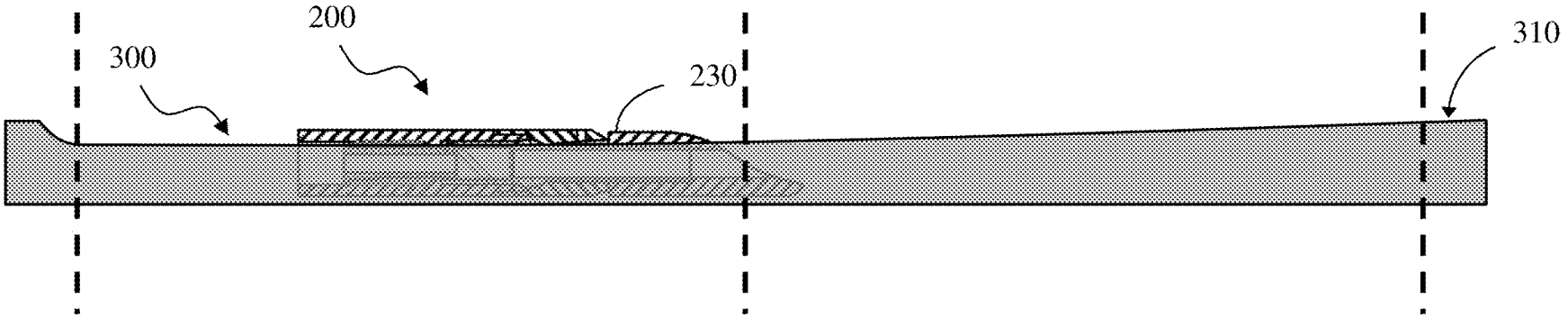
FIGS. 3A through 3F illustrate the lateral locating assembly illustrated in FIG. 2A shown in various positions transitioning from a first run-in-hole state to a final deflected state and then back to the first run-in-hole state.
Figure 3B:
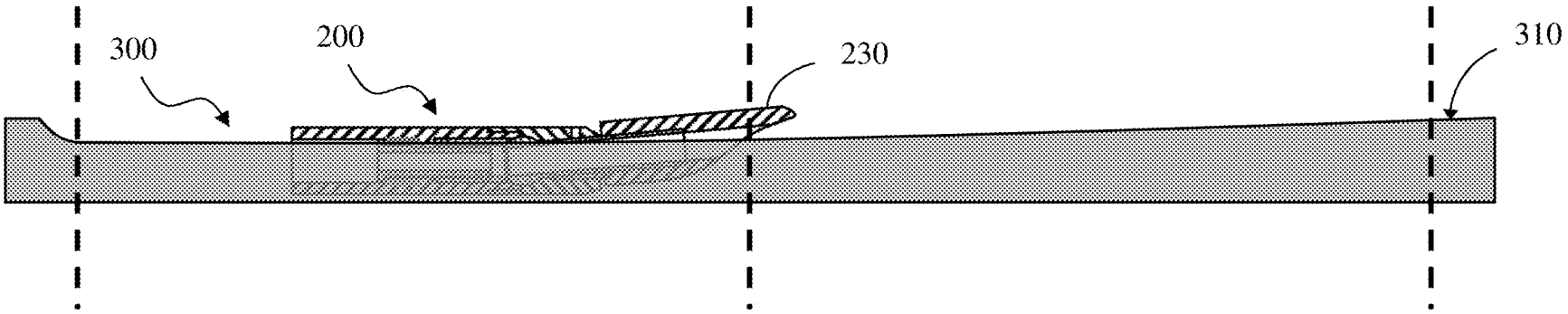
Figure 3C:
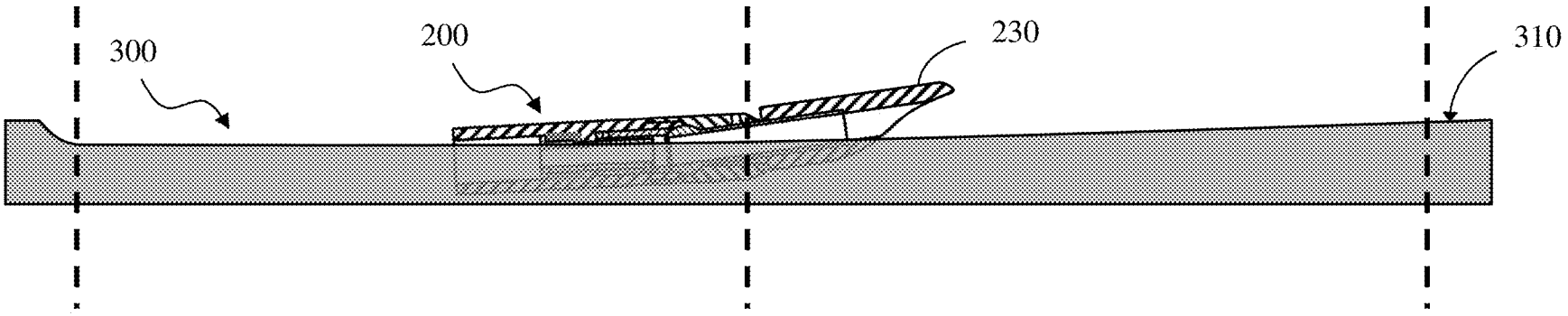
Figure 3D:
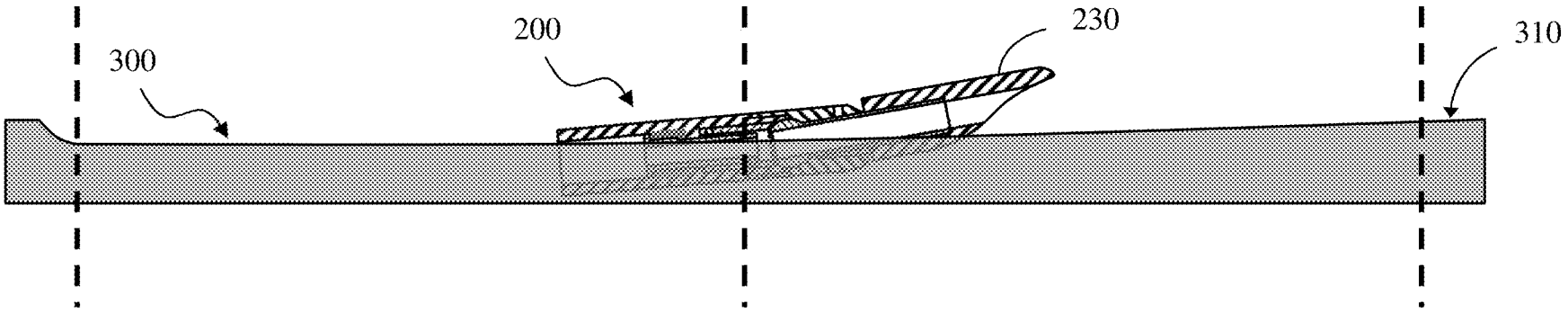
Figure 3E:
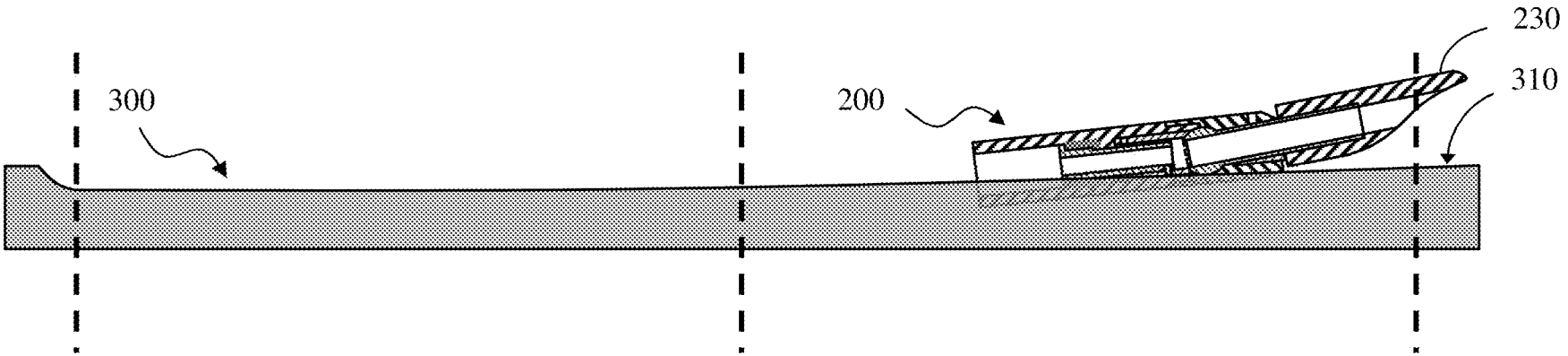
Figure 3F:
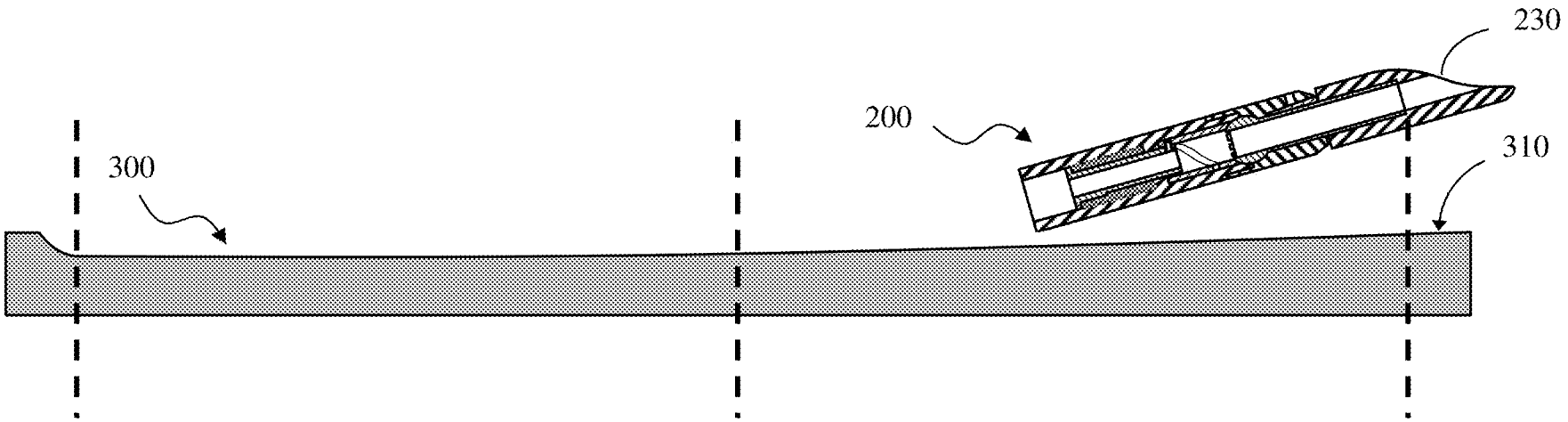

Turning now to FIGS. 3A through 3F, an example of the lateral locating assembly 200 is shown in various operational states and reference depths with respect to a window 300 to a lateral wellbore 310. FIG. 3A illustrates the lateral locating assembly 200 in a neutral, run-in-hole state, wherein the deflection tip 230 is in a straight non-deflected position. In the illustrated example, the reference depth of the deflection tip 230 with respect to the window 300 may be about 0 cm. FIG. 3B illustrates the lateral locating assembly 200 in a deflected state wherein the deflection tip 230 has rotated and translated angularly into a bent deflected position, and beginning to deviate through the window 300 into the lateral wellbore 310, in this example, at a reference depth of about 2 cm (0.756 in.) with respect to the window 300. FIG. 3C illustrates the lateral locating assembly 200 with the deflection tip 230 in a deflected position as the lateral locating assembly 200 deviates into the lateral wellbore 310 at a reference depth, in this example, of about 35.66 cm (1.17 ft.) through the window 300. FIG. 3D illustrates the lateral locating assembly 200 in a deflected position partially deviated into the lateral wellbore 310 at a reference depth of about 60.05 cm (1.97 ft.) with respect to the window 300. FIG. 3E illustrates the lateral locating assembly 200 in a deflected position with the deflection tip 230 substantially deviated (deviated between about 55-100%) into the lateral wellbore 310 at a reference depth of about 155.45 cm (5.10 ft.) with respect to the window 300. FIG. 3F illustrates the lateral locating assembly 200 back in a neutral, run-in-hole state, wherein the deflection tip 230 is again in a straight non-deflected position. The lateral wellbore 310 may now be accessed for fluid passage and/or accessed by downhole tools through the lateral locating assembly 200.

Figure 4:
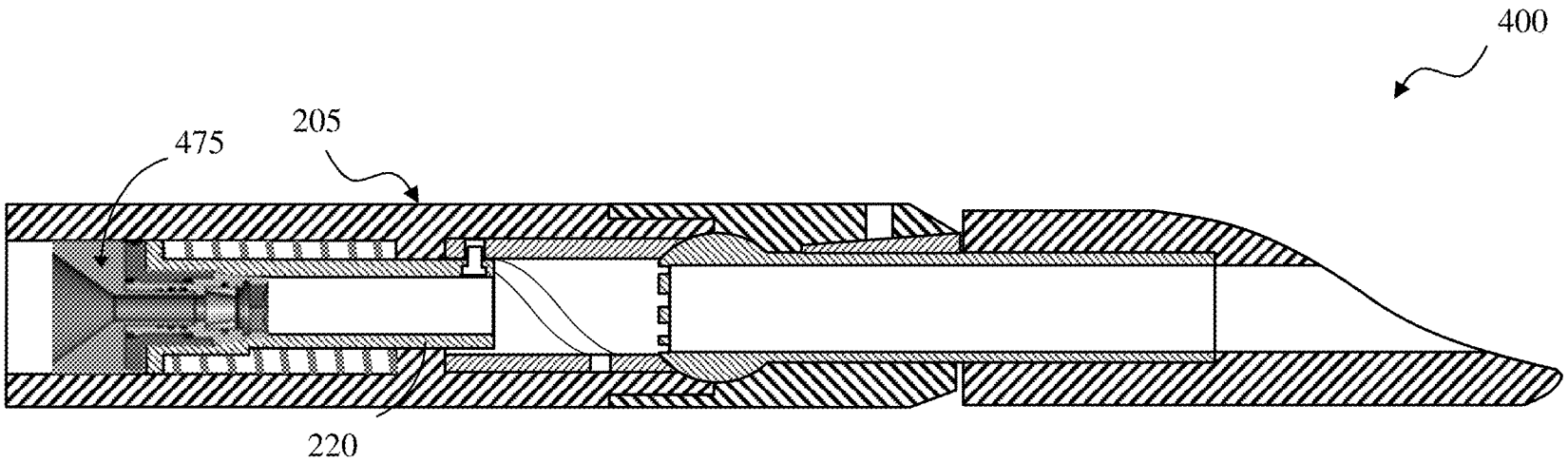
FIG. 4 illustrates a lateral locating assembly designed and manufactured according to one or more alternate embodiments of the disclosure.

Turning now to FIG. 4, there is shown another embodiment of a lateral locating assembly 400 according to principles of the disclosure. The lateral locating assembly 400 is similar in many respects to the lateral locating assembly 200 of FIGS. 2A-2B. Accordingly, like reference numbers have been used to reference similar, if not identical, features. The lateral locating assembly 400 differs, for the most part, from the lateral locating assembly 200, in that the lateral locating assembly 400 includes a fluid nozzle assembly 475 positioned within the housing 205 at an uphole end of the piston 220. In some embodiments, the fluid nozzle assembly 475 may increase pressure on the piston 220, in order to urge the piston 220 from the first position to the second position. The fluid nozzle assembly 475 may activate the piston 220 due to differential pressure in the wellbore. In some embodiments, the fluid nozzle assembly 475 may be needed when more force is required to urge the piston 220 from the first position (e.g., when there may be a smaller cross section in the wellbore over which fluid flow is available). In addition, various sizes of nozzles may be used in the fluid nozzle assembly 475 according to different environments and configurations in which the lateral locating assembly 400 may be placed.

Figure 5:
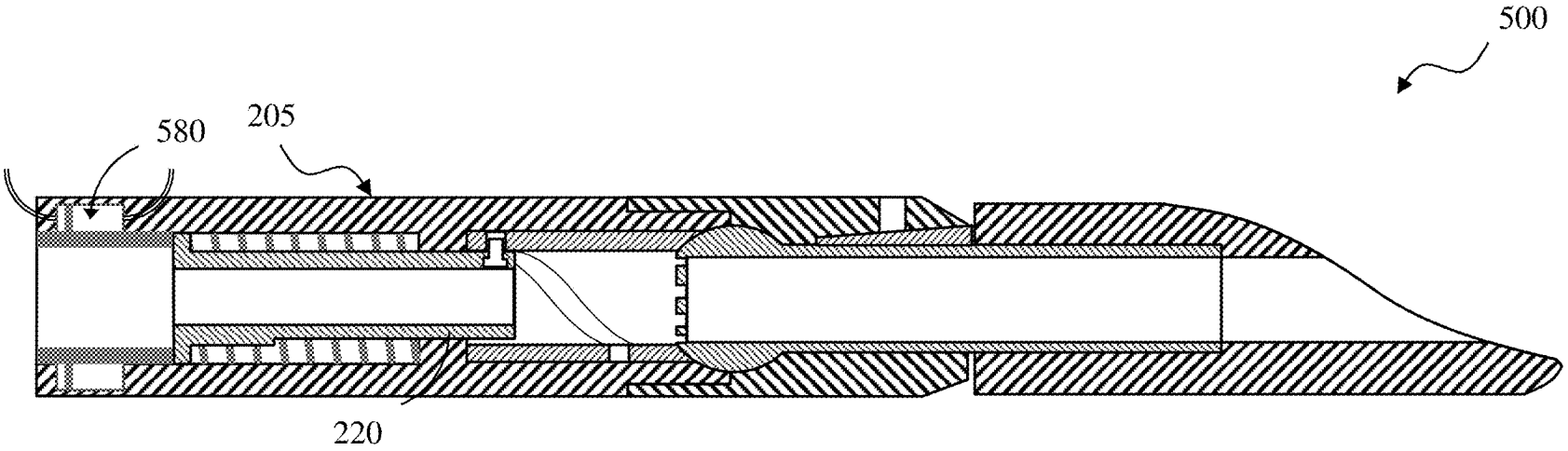
FIG. 5 illustrates another lateral locating assembly designed and manufactured according to one or more alternate embodiments of the disclosure.

Turning now to FIG. 5, there is shown another embodiment of a lateral locating assembly 500 according to principles of the disclosure. The lateral locating assembly 500 is similar in many respects to the lateral locating assembly 200 of FIGS. 2A-2B. Accordingly, like reference numbers have been used to reference similar, if not identical, features. The lateral locating assembly 500 differs, for the most part, from the lateral locating assembly 200, in that the lateral locating assembly 500 includes a hydraulic power unit 580 coupled uphole of the piston 220. The hydraulic power unit 580 may be configured to mechanically move the piston 220 from the first position to the second position. In some embodiments, the hydraulic power unit 580 may be programmable to mechanically move the piston 220 from the first position to the second position after one or more pressure cycles thereon. The programming of hydraulic power unit 580 may depend on signature pressure amounts or cycles determined according to anticipated environments and configurations in which the lateral locating assembly 500 may be placed. The hydraulic power unit 580, in some embodiments, may be actuated remotely using applied surface pressure. In other embodiments, the hydraulic power unit 580 may be actuated by hydrostatic pressure and may include actuation by a timer.

Figure 6:
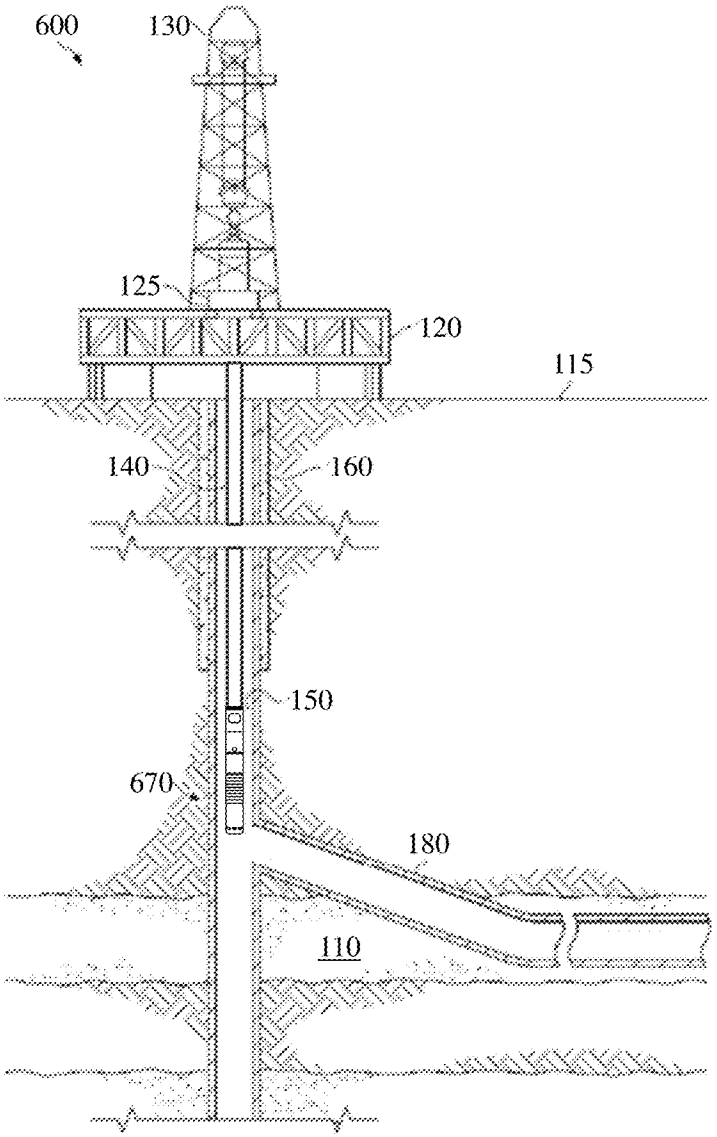
FIG. 6 is a schematic view of a multilateral well according to one or more alternative embodiments disclosed herein.

Turning now to FIG. 6, there is shown a schematic view of a multilateral well 600 according to one or more alternative embodiments disclosed herein. The multilateral well 600 is similar in many respects to the multilateral well 100 of FIG. 1. Accordingly, like reference numbers have been used to reference similar, if not identical, features. The multilateral well 600 differs, for the most part, from the multilateral well 100, in that the multilateral well 600 employs a hydraflex lateral locating assembly 670, as discussed further below.

Figure 7A:
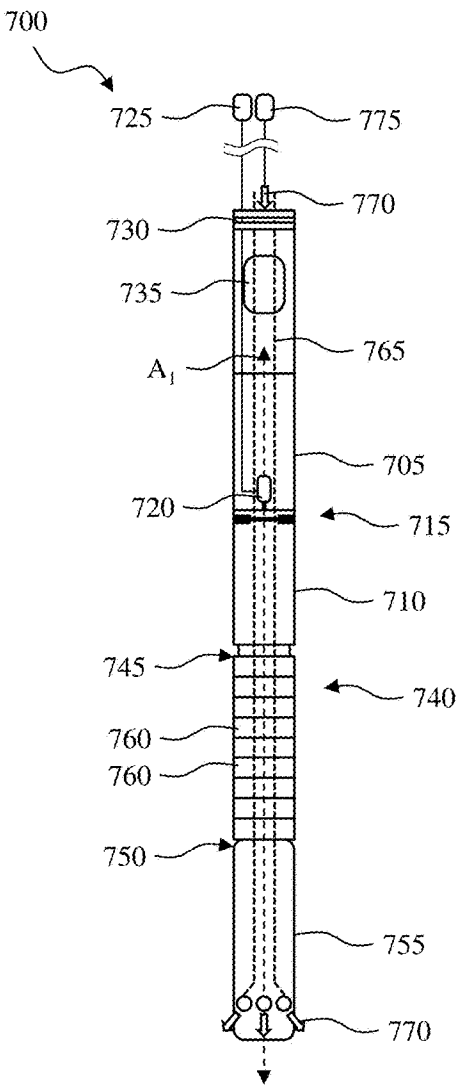
FIGS. 7A through 7C illustrate schematic views of a hydraflex lateral locating assembly designed, manufactured and operated according to one or more embodiments of the disclosure in various different operational configurations.

Turning now to FIG. 7A there is shown a schematic view of a hydraflex lateral locating assembly 700 designed, manufactured and operated according to one or more embodiments of the disclosure in a straight position. The hydraflex lateral locating assembly 700 includes an upper housing 705 and a lower housing 710, coupled to one another along a tool axis A1. The upper and lower housings 705, 710 are rotationally coupled to one another to permit rotational movement therebetween about the tool axis A1, and together define an orientation sub 715. A rotational driver 720, such as a hydraulic motor, is disposed within the upper housing 705 of the orientation sub, and is operable to selectively induce rotational motion of the lower housing 710 with respect to the upper housing 705 in either direction, e.g., clockwise and counter-clockwise directions. The rotational driver 720 may include hydraulic, pneumatic, mechanical or other mechanisms recognized in the art. A first actuator, controller or orientation actuator 725 is operably coupled to the rotational driver 720 to permit an operator to selectively operate the rotational driver 720. The first actuator 725 may be disposed at the surface location (e.g., surface 115 illustrated in FIG. 6) or at a downhole location. The upper housing 705 defines a connector 730 such as threads, latches, etc., for coupling the hydraflex lateral locating assembly 700 to the lower end of a tubing string (e.g., the tubing string 140 illustrated in FIG. 6). The connector 730 may fixedly couple the upper housing 705 to the tubing string, and thus, in some embodiments, the rotational driver 720 may selectively rotate the lower housing 710 with respect to the tubing string.

The upper housing 705 may also support a sensor package 735 therein. For tool strings equipped with real-time communication capabilities, the sensor package 735 provides an operator with real-time information regarding position and configuration of the hydraflex lateral locating assembly 700. For example, the sensor package 735 may include tool face sensors, inclination sensors, gamma sensors, casing collar locators (CCL) or cameras, which can provide additional verification of a successful entry into a lateral wellbore as described below. In some embodiments, the sensor package 735 is disposed in a separate sensor sub coupled to the upper housing 705.

A kick-over sub 740 is coupled to a lower end of the lower housing 710. In the embodiment illustrated in FIG. 7A, the kick-over sub 740 includes a segmented tubular section 745 and a bottom hole assembly BHA 750 including a fluid nozzle 755. The segmented tubular section 745 includes a plurality of pivotally coupled sections 760, which permit the hydraflex lateral locating assembly 700 to be moved to a bent articulated position wherein BHA 750 is obliquely arranged with respect to the tool axis A1 (see FIG. 7B). Sections 760 may simply be added or removed from a segmented tubular section 745 as the kick-over sub 740 is manufactured to adjust the angle of the bend to suit different well geometries or BHA 750 lengths. In other embodiments (not shown) the BHA 750 may include any tool or structure useful in completing or servicing the lateral wellbore or vertical main wellbore. Also, in other embodiments, the kick-over sub 740 may include any structure operable to move the BHA 750 between aligned (e.g., straight) and oblique (e.g., bent) arrangements with respect to the tool axis A1 (see FIG. 7B). For example, the kick-over sub may include an indexed, knuckle-type kick-over sub operable to move the BHA 750 to discrete articulated and incremental rotational positions by cycling a fluid pressure within the hydraflex lateral locating assembly 700.

A fluid passageway 765 extends through the hydraflex lateral locating assembly 700, fluidly coupling the nozzle 755 to the tubular string. The hydraflex lateral locating assembly 700 may maintain the straight configuration when fluid 770 is passed through the fluid passageway 765 at a rate less than a predetermined threshold. A second actuator or kick-over actuator 775 is operatively coupled to the fluid passageway for controlling a rate of fluid 770 flowing through the fluid passageway 765. In some embodiments, the second actuator 775 may include a pump (not shown) at the surface (e.g., earth surface 115 as shown in FIG. 6).

Figure 7B:
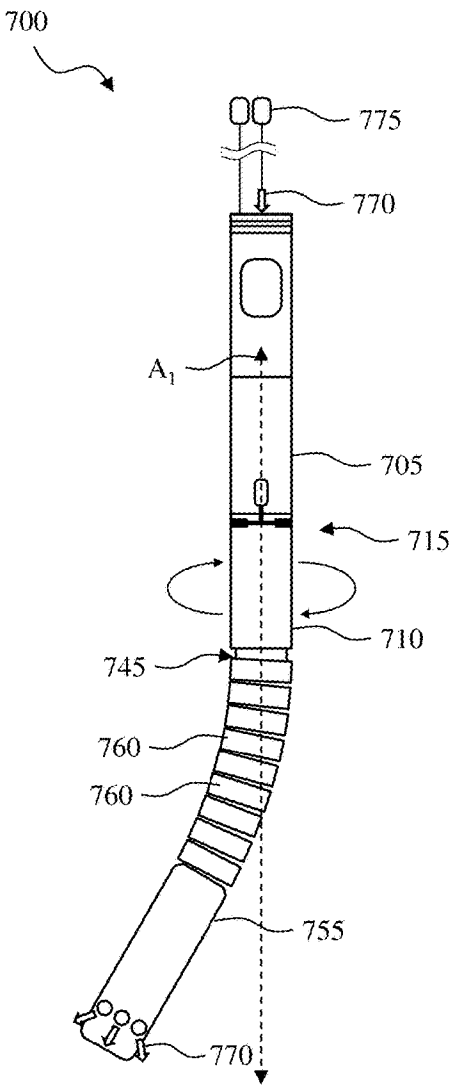

Turning now to FIG. 7B there is shown a schematic view of a hydraflex lateral locating assembly 700 designed, manufactured and operated according to one or more embodiments of the disclosure in an articulated configuration induced by operating the kick-over actuator 775. For example, the kick-over actuator 775 may have been operated to increase the flow of fluid 770 to a flowrate greater than the predetermined threshold. With the increased flowrate, a pressure differential across the nozzle 755 may be sufficient to move the sections 760 to pivot relative to one another, thereby bending the segmented tubular section 745 and moving the nozzle 755 to the oblique orientation with respect to the tool axis A1. The kick-over actuator 775 may be operated without rotating the nozzle 755 with respect to the tool axis A1 or the tubular string 30 and longitudinal axis.

Figure 7C:
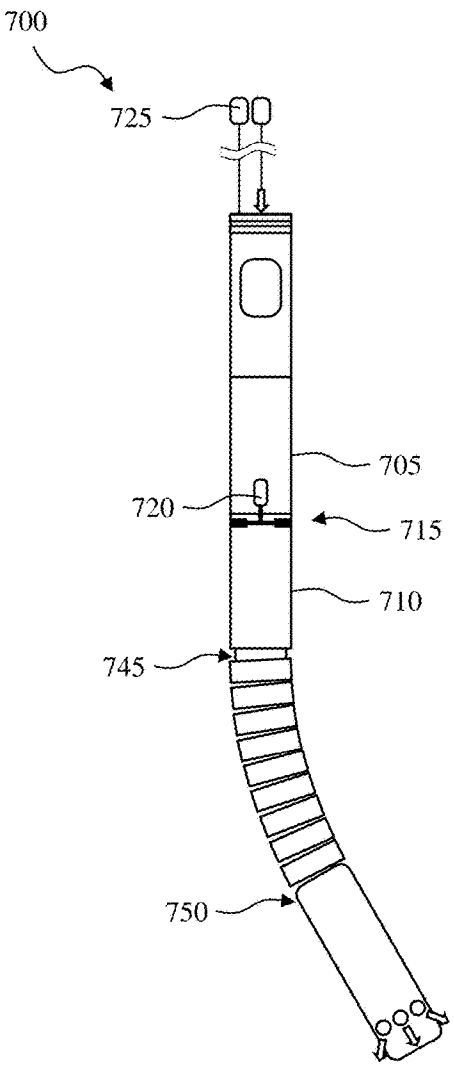

Turning now to FIG. 7C there is shown a schematic view of a hydraflex lateral locating assembly 700 designed, manufactured and operated according to one or more embodiments of the disclosure in an oriented configuration induced by operating the orientation actuator 725. The orientation actuator 725 may be operated to send a control signal to the rotational driver 720 to thereby rotate the lower housing 710 with respect to the upper housing 705 of the orientation sub 715. Since the segmented tubular section 745 and BHA 750 are coupled to the lower housing 710, the BHA 750 is rotated to the illustrated position while the hydraflex lateral locating assembly 700 maintains the articulated position. In the oriented configuration of FIG. 7C, the BHA 750 is rotated generally up to 180 degrees in either direction (e.g., clockwise or counterclockwise) from an un-oriented configuration of FIG. 7C. In other embodiments, the oriented configuration may require a distinct degree of rotation of the lower housing 710 that is less than 180 degrees to align the BHA with the lateral wellbore 14 in any rotational position.

Although FIGS. 7A through 7C illustrate the end of the BHA 750 as equipped with a nozzle tool 755, in other embodiments, a BHA may be provided equipped with alternate subterranean tools without departing from the scope of the disclosures. For example, a BHA may be provided with tools such as milling tools, shifting tools, venturi subs, or any number of other downhole components as needed to complete various operational objectives.

FIGS. 8A through 8E are sequential views of the hydraflex lateral locating assembly 700 in various stages of a procedure for entering a lateral wellbore 820 extending from a main wellbore 810. Initially, the hydraflex lateral locating assembly 700 is lowered or run into the main wellbore 810 on tubular string 830 or other conveyance. A rig may be employed to lower the hydraflex lateral locating assembly 700 into the main wellbore 810, and as the hydraflex lateral locating assembly 700 is lowered, the sensor package 735 may operate to count the casing collars 840 encountered. As the hydraflex lateral locating assembly 700 approaches the depth of the lateral wellbore 820 and an expected number of casing collars 840 is encountered, the hydraflex lateral locating assembly 700 may be held at a depth above the lateral wellbore 820. In other embodiments, the sensor package 735 or other portions of the tubular string 830 may include other tools for of depth correlation, such as an in-line camera, gamma sensor, and/or caliper. Other tools such as an in-line camera may provide an indication of depth and tool face to an operator at the surface.

Figure 8A:
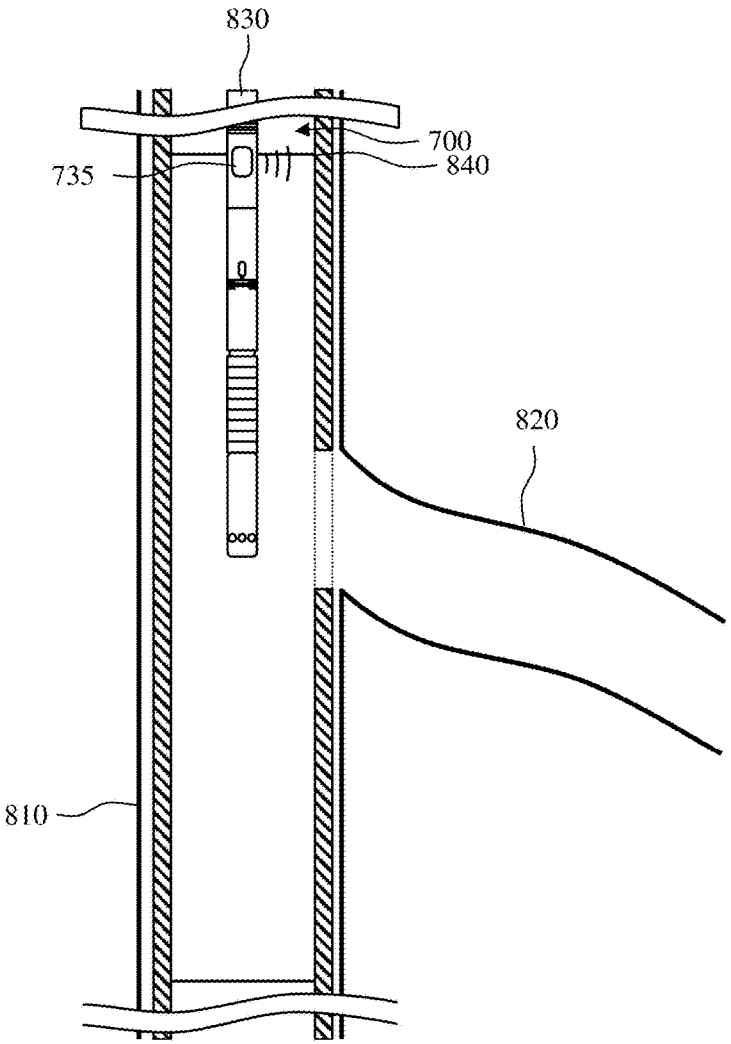
FIGS. 8A through 8E illustrate sequential views of the hydraflex lateral locating assembly in various stages of a procedure for entering a lateral wellbore extending from a main wellbore.
Figure 8B:
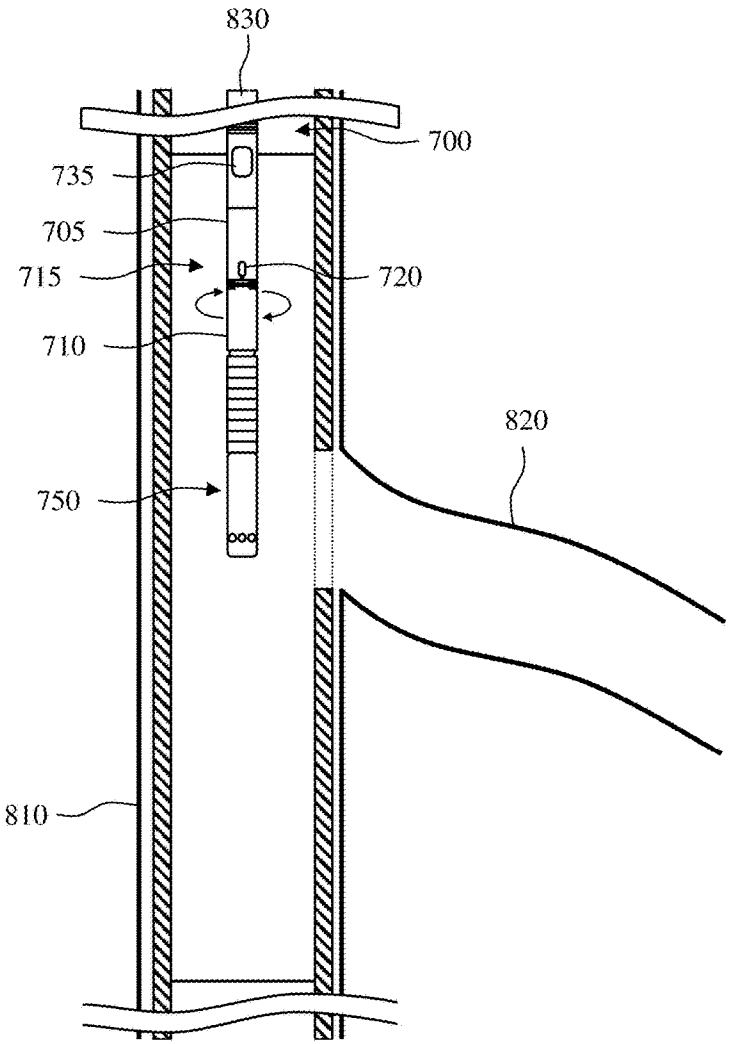

As illustrated in FIG. 8B, thereafter the hydraflex lateral locating assembly 700 may be rotationally oriented. The sensor package 735 may provide an initial tool face orientation of BHA 750, and the difference between the initial tool face and the circumferential position of the lateral wellbore 820 is determined. The orientation actuator 725 (FIG. 7C) may be employed to command the rotational driver 720 to rotate the lower housing 710 by the exact difference between the initial tool face and the circumferential position of the lateral wellbore 820. The lower housing 710 may be rotated in a clockwise or counter-clockwise direction, whichever is shorter, with respect to the upper housing 705 of the orientation sub 715. The BHA 750 may thereby be rotationally oriented without pivoting the BHA 750.

Figure 8C:
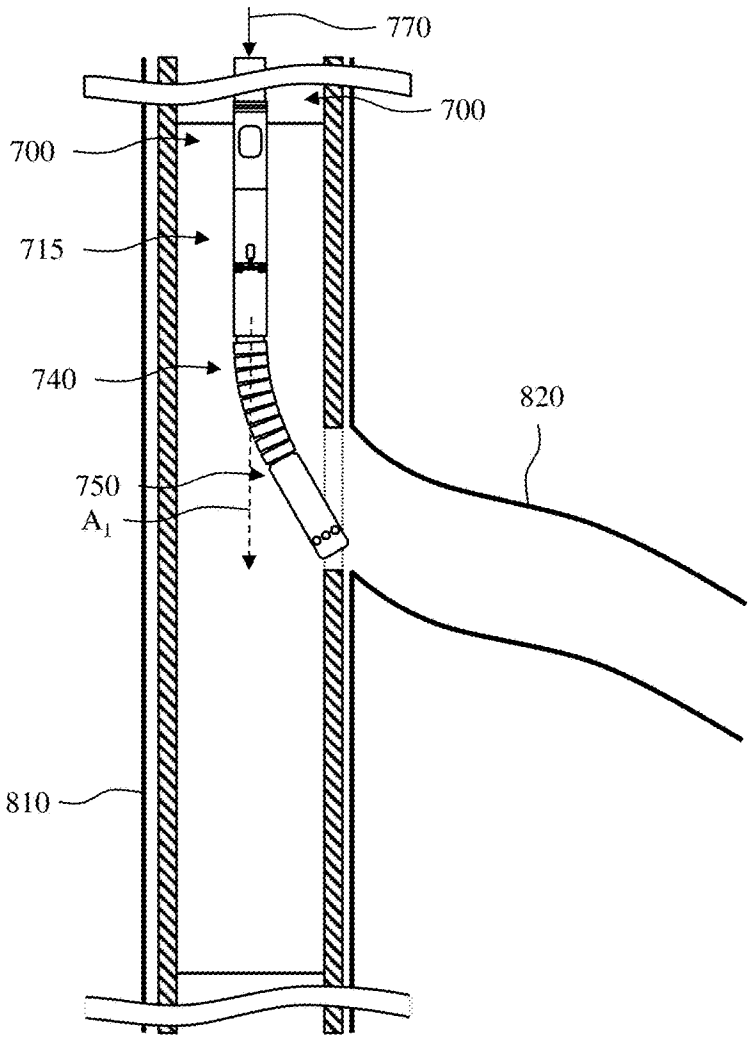

Next, as illustrated in FIG. 8C, the hydraflex lateral locating assembly 700 tool is moved to the bent articulated position to pivot the BHA 750. The kick-over actuator 775 (FIG. 7B) may be employed to increase the flow rate of fluid 770 through the hydraflex lateral locating assembly 700 above the necessary threshold to bend the kick-over sub 740 (FIG. 7B). In some embodiments, the amount the flow rate is increased above the threshold will correspond to an increased amount the BHA 750 pivots from the tool axis A1. The rotational orientation of the BHA is maintained as the kick-over actuator 775 is activated to pivot the BHA 750 toward the lateral wellbore 820. Since the orientation sub 715 and kick-over sub 740 are independently activated, the processes shown in FIGS. 8B and 8C may be reversed.

Figure 8D:
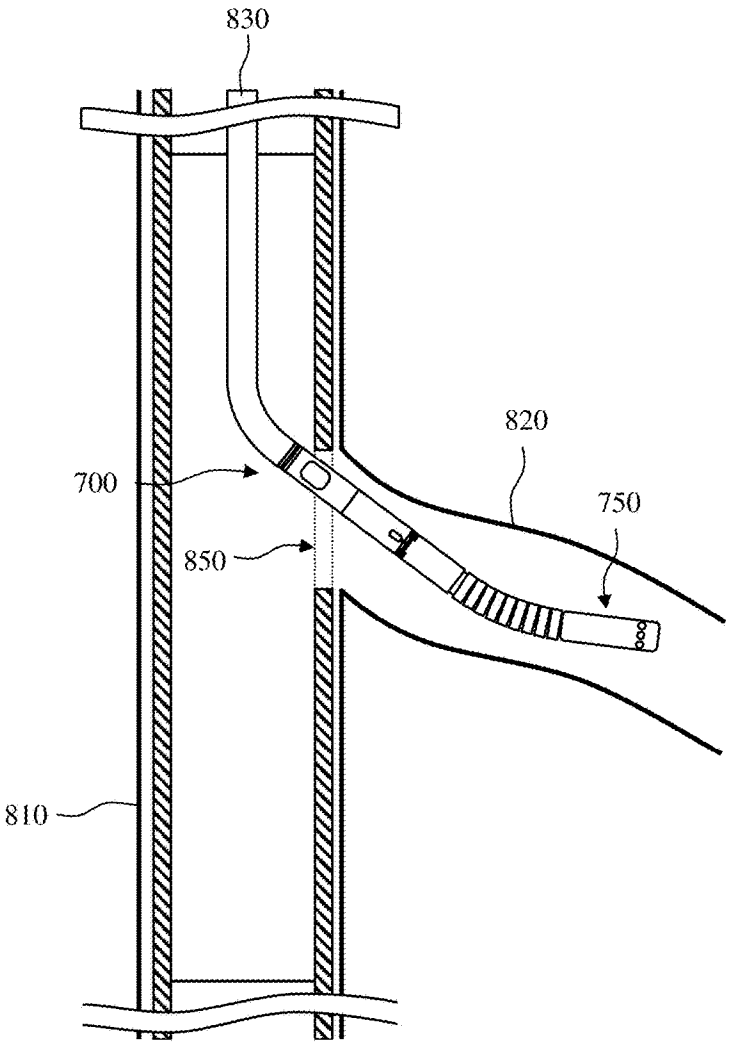

Next, as illustrated in FIG. 8D, the hydraflex lateral locating assembly 700 is lowered further in the main wellbore 810 such that the BHA 750 passes through the window 850. If the BHA 750 is properly oriented and pivoted, the hydraflex lateral locating assembly 700 will enter the lateral wellbore 820 in the articulated configuration.

Figure 8E:
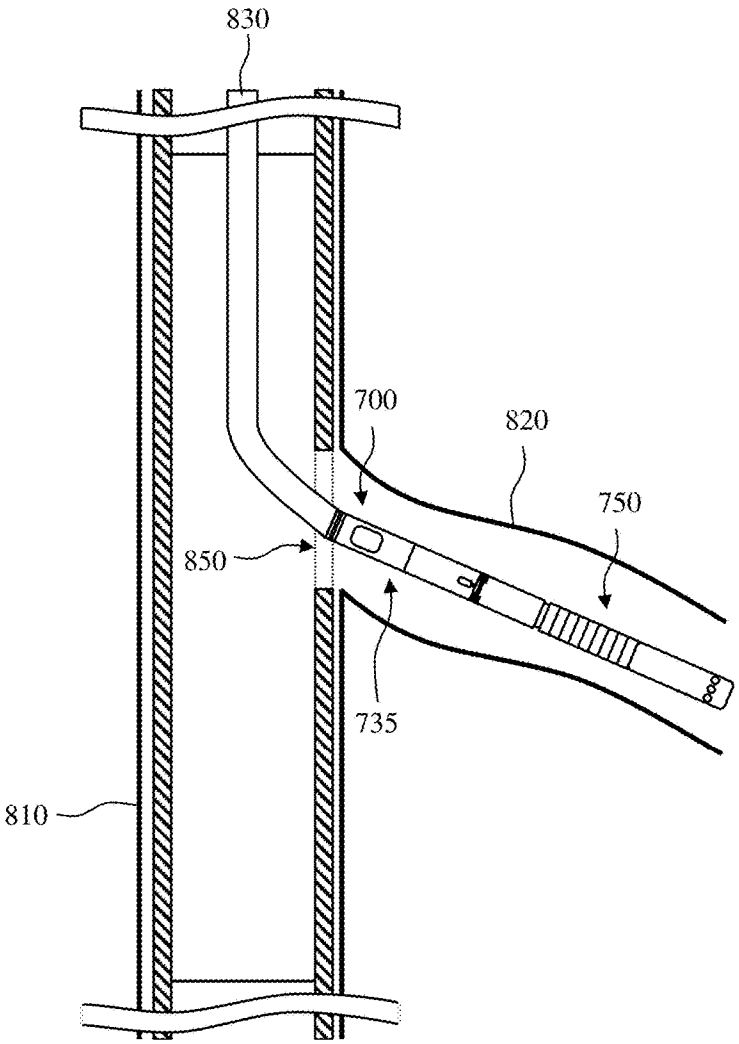
Figure 9A:
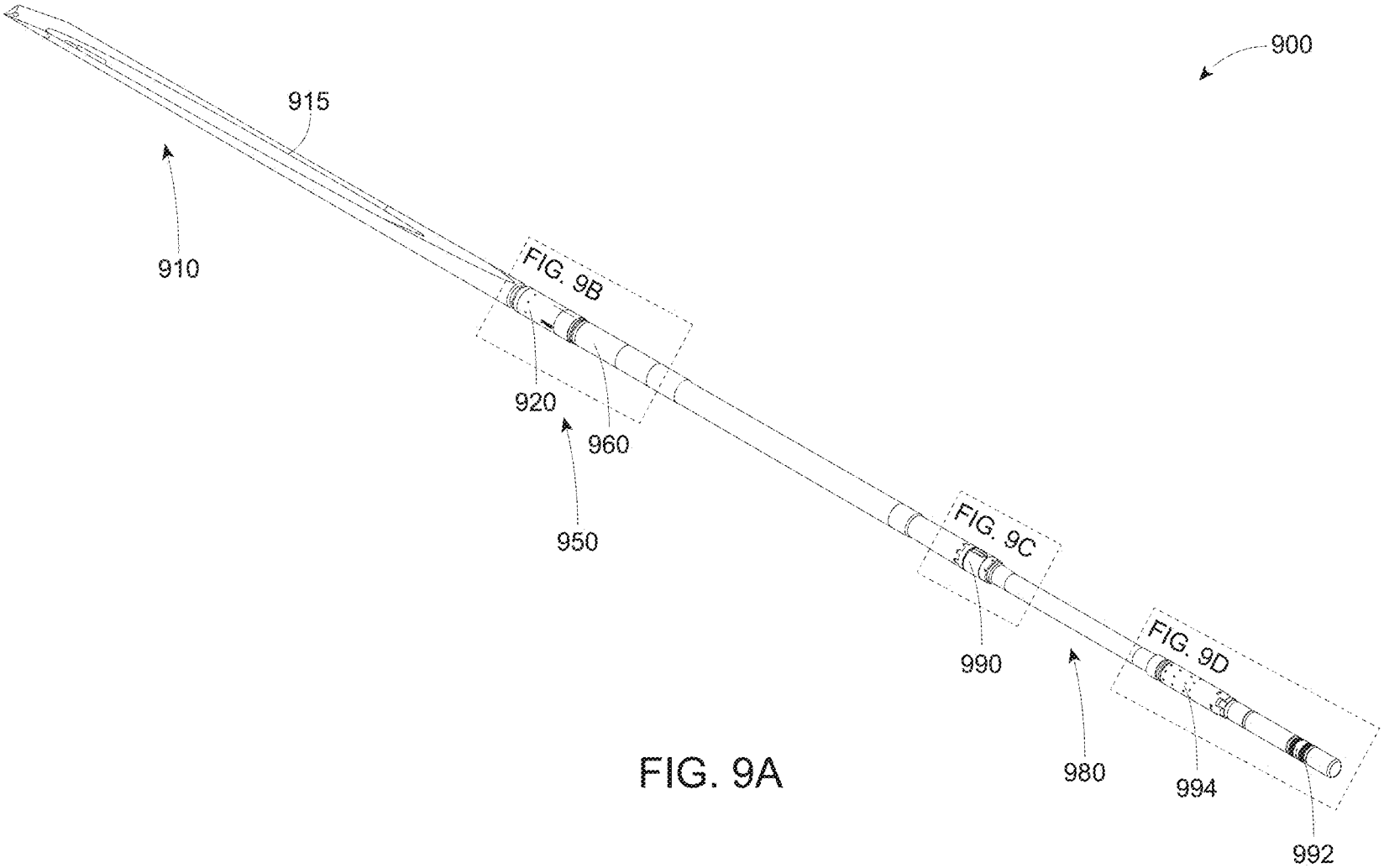
FIGS. 9A through 10D illustrate are various different views of a whipstock designed, manufactured and/or operated according to one or more embodiments of the disclosure.
Figure 9B:
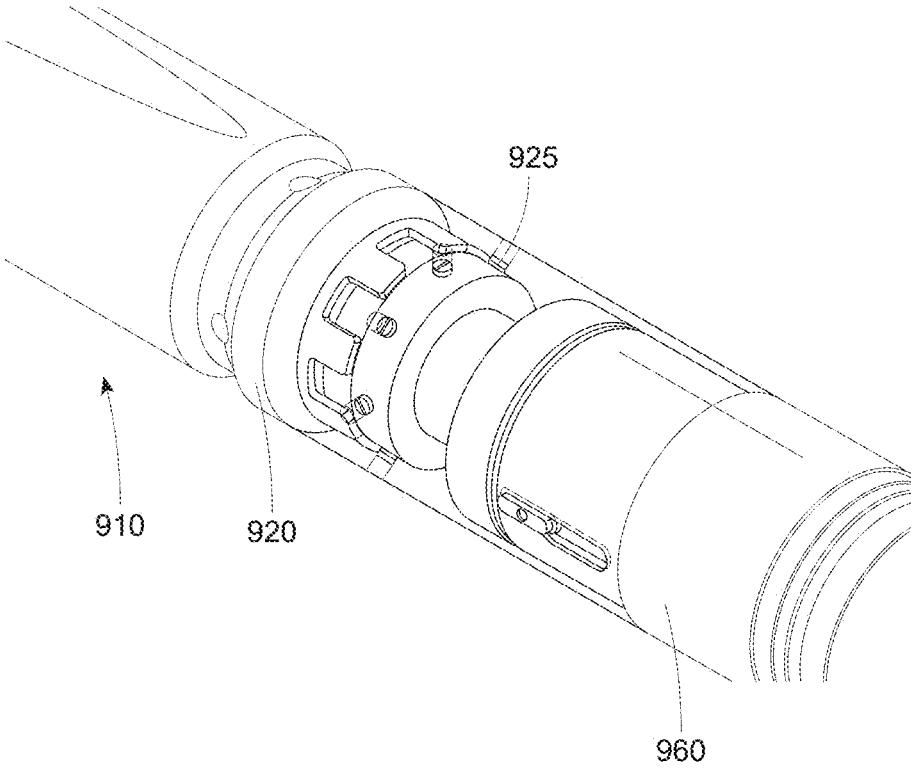
Figure 9C:
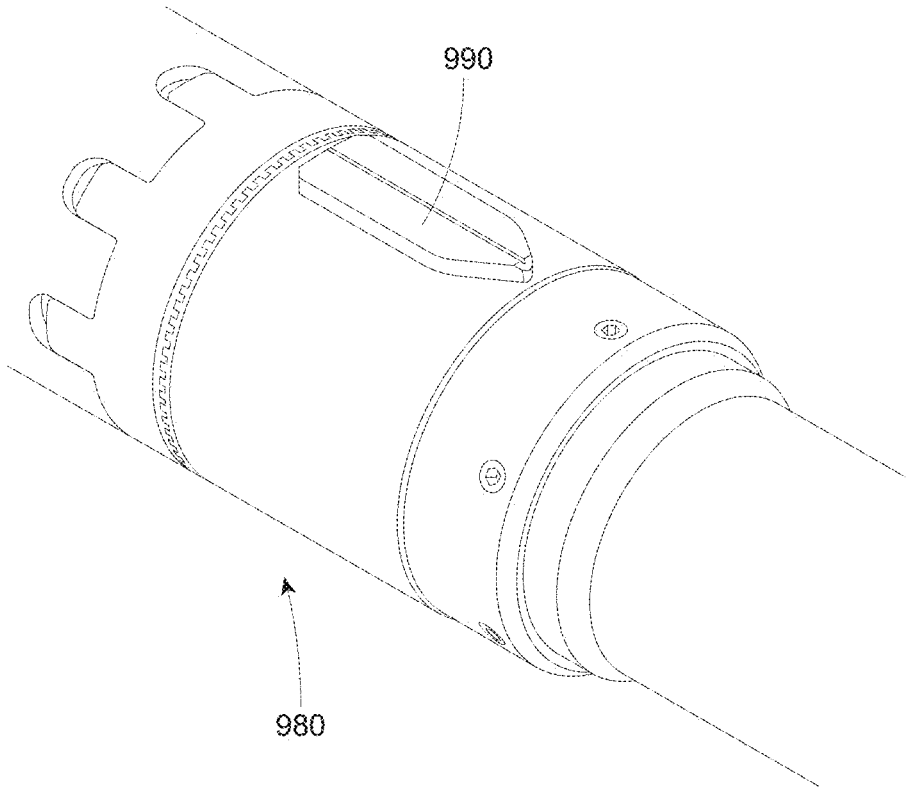
Figure 9D:
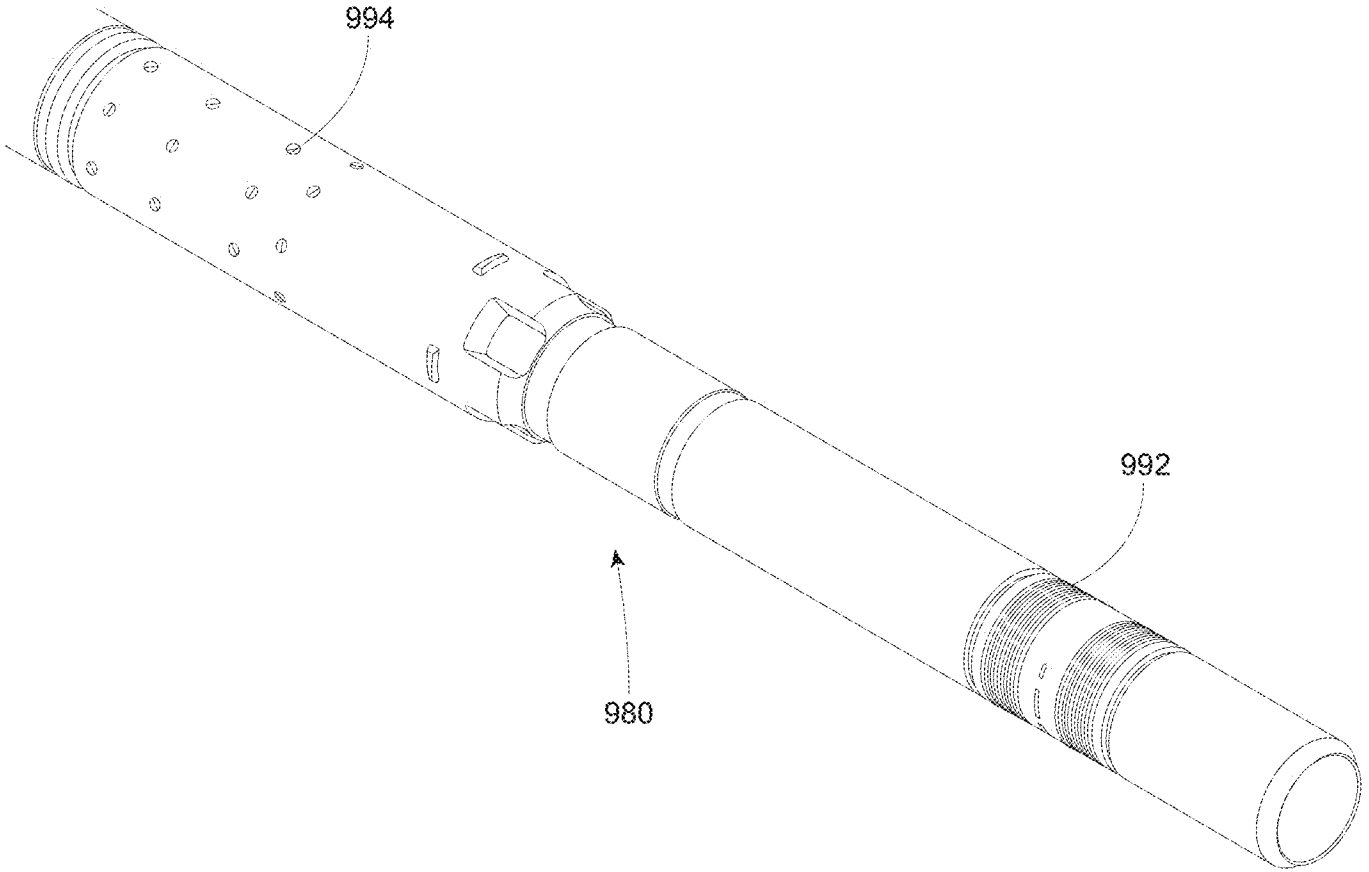
Figure 10A:
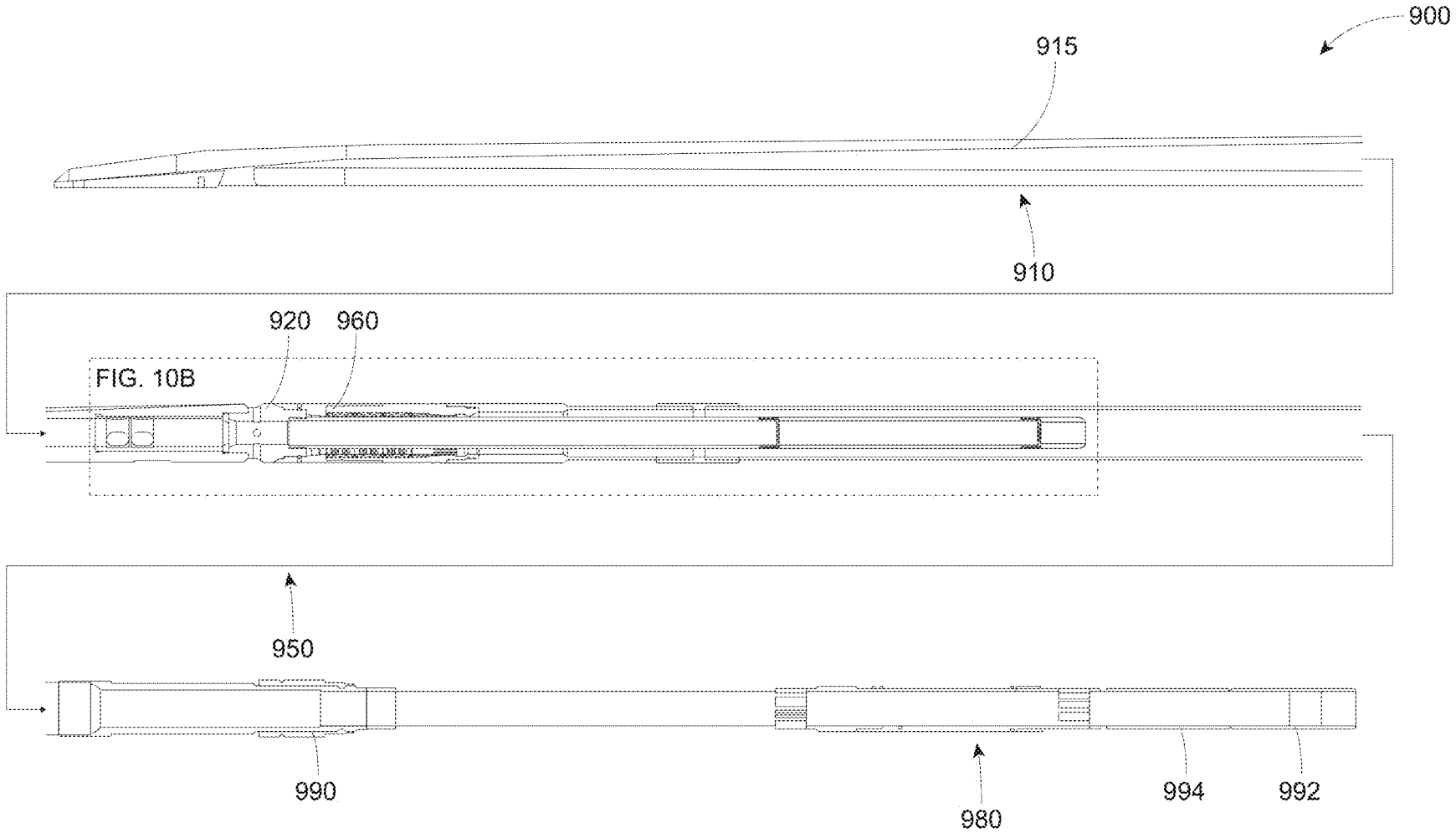
Figure 10B:
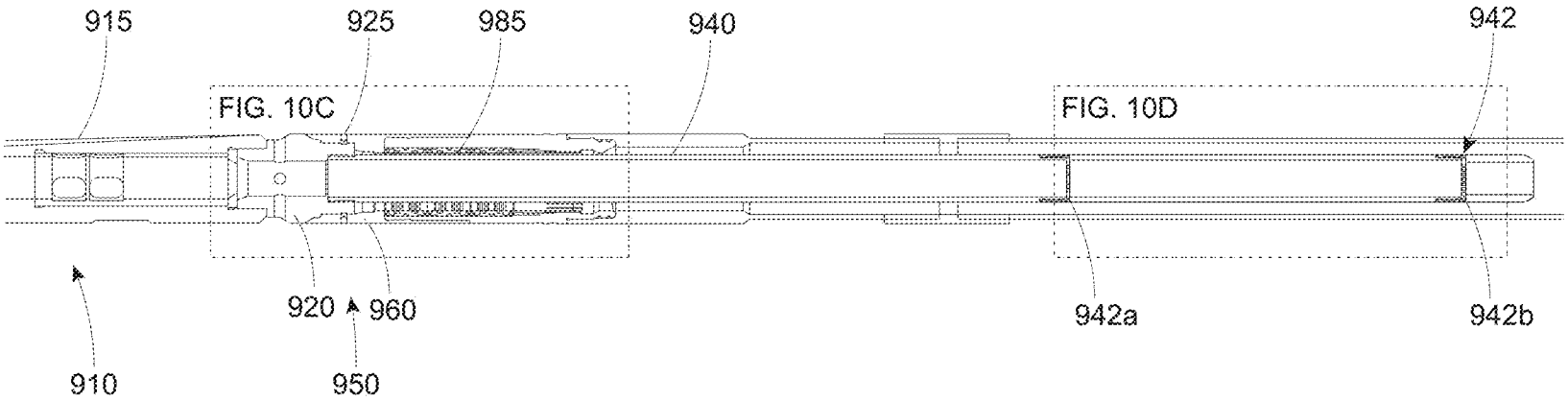
Figure 10C:
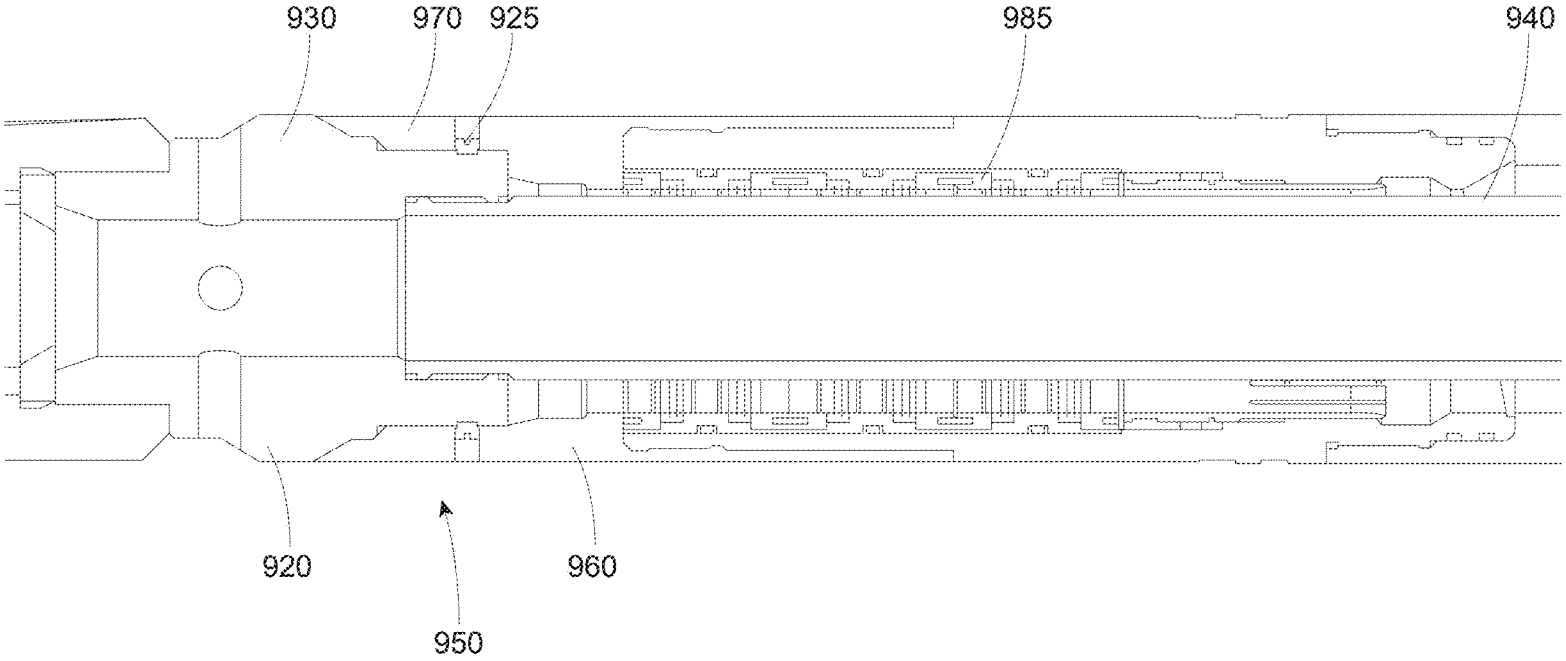
Figure 10D:
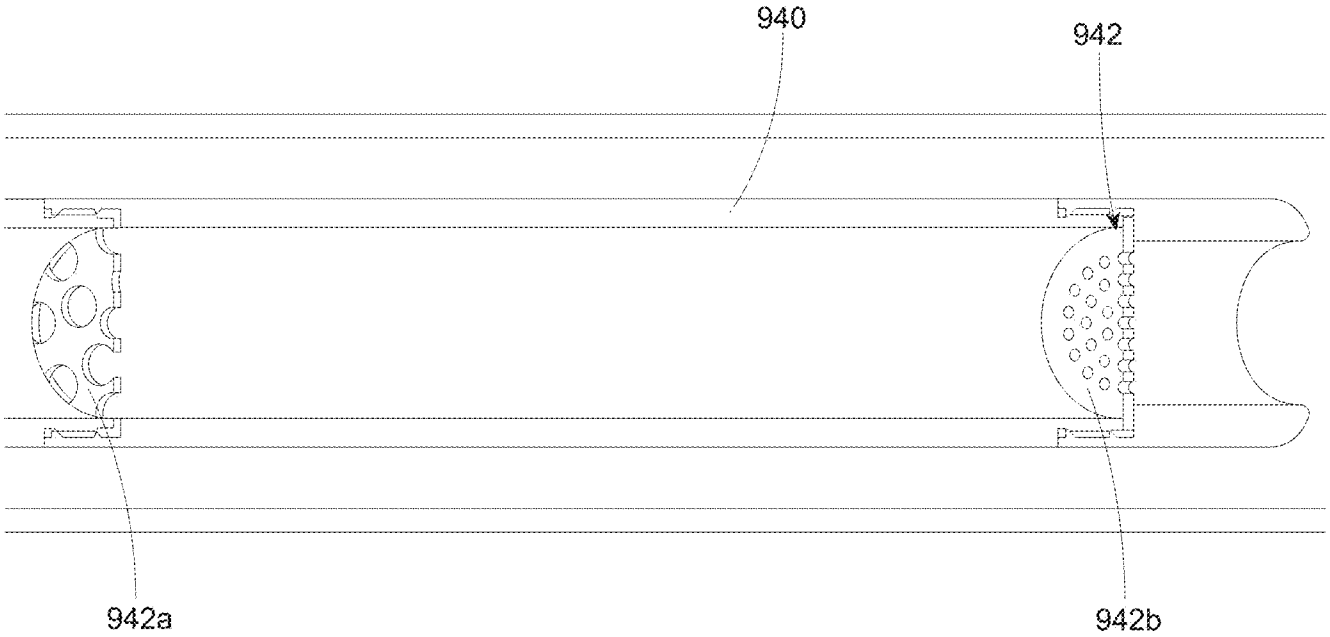

As illustrated in FIG. 8E, an inclination sensor within the sensor package 735 may verify that an expected inclination of the sensor package 735 has been achieved to verify a successful entry into the lateral wellbore 820. Alternatively, or additionally, some embodiments may utilize a gamma sensor in the sensor package 735 to verify lateral entry based on identifying an expected lithology, for example. The sensor package 735 may communicate a signal indicative of a successful entry to the surface to an operator. Next, the kick-over actuator 775 (FIG. 7B) may optionally be again actuated to return the hydraflex lateral locating assembly 700 to the straight configuration illustrated in FIG. 8E. In the straight configuration, friction between the hydraflex lateral locating assembly 700 and the lateral wellbore 820 may be reduced as the hydraflex lateral locating assembly 700 is further advanced into the lateral wellbore 820 to carry out a wellbore operation, The hydraflex lateral locating assembly 700 may be withdrawn from the lateral wellbore 820, and the procedure may be repeated for additional lateral wellbores 820 branching from the main wellbore 810.

The present disclosure proposes the installation of a Level 5 multilateral junction without the use/installation of a deflector in the mainbore. The present disclosure, in at least one embodiment, includes a whipstock having a detachable whipface. The whipstock having the detachable whipface will be able to save the operator 1 trip down hole (~12 hours) and still provide the conditions required to install a level 5 junction. Moreover, this will all be achieved using the current designs for the XLS whipface and deflector seal sub; which is a time/cost saving for the company.

The detachable whipstock of the present disclosure (e.g., with sealing capabilities) will be able to provide, depending on the embodiment, many advantages over existing technologies. First, the detachable whipstock provides a whipface for milling of a multilateral window. And may be installed on a shear bolted mill. Additionally, the detachable whipstock provides a seal sub (e.g., T-seals for junction installation), which may be installed with either FlexRite latch coupling or ReFlexRite latch BHA (using VF anchor), among others. Moreover, the detachable whipstock may provide a detachable sub that is shear pinned (e.g., to support axial force) and able to hold torque due to locking teeth. The sub will allow the whipface to be detached from the seal sub. Additionally, the detachable whipstock may provide an inner sleeve connected to the whipface that will protect the seals in the BHA while milling and drilling occurs. When the whipface is detached and pulled out of hole (POOH), the inner protective sleeve exposes the seals and provides the conditions to land a MIC junction. Moreover, the detachable whipstock may provide filters inside the protective inner sleeve that will catch milling and drilling debris. When the whipface is detached and POOH, the debris that is caught is retrieved. Additionally, the detachable whipstock allows for the whipface and protective sleeve to be detached using current running tools. In yet another example, the detachable whipstock provides the option to retrieve the seal sub BHA back to surface if required. The combinations of one or more of these features allows for the installation of a multilateral junction with one less run, which is not possible with existing technologies.

The present disclosure also allows for the junction to be run with an open hole stinger integrated with a lateral locating assembly (e.g., hydraulic bending tool such as a hydraflex) that will provide access to the lateral when required. In at least one embodiment, the lateral locating assembly includes a sliding sleeve, which will open when installed in the lateral to allow oil production. The lateral locating assembly of the present disclosure will be able to provide, depending on the embodiment, many advantages over existing technologies. For example, the lateral locating assembly may provide a bending assembly that is hydraulically triggered to access a lateral bore without the use of a deflector. The hydraflex offers the possibility to customize the bending angle by adjusting the number of modules (e.g., 3 degrees each), to perfectly match well requirements. As it is activated by pressure, a sub with small orifice will be added below to create required pressure drop when pumping. The lateral locating assembly may also provide a sliding sleeve that is in the closed position while RIH to allow the hydraflex to function properly. The sliding sleeve will open when installed in the lateral inside the lateral liner to allow oil production. The lateral locating assembly may additionally provide a shrouded open hole stinger with a swell packer and swab cups to seal in a 6.00" polished bore receptacle (PBR) in the lateral liner. In yet another embodiment, the lateral locating assembly may provide an interaction between the OHS and the sliding sleeve that will allow them to work in conjunction. When the shroud is fixed with shear screws into the OHS, the sliding sleeve will be closed. When the screws in the shroud are sheared the sliding sleeve will open and will stay open (e.g., by way of a snap ring or other retaining mechanism). The combination of one or more of these features allows for the installation of a multilateral junction with one less run, which is not present in other existing technologies.

Turning to FIGS. 9A through 10D, illustrated are various different views of a whipstock 900 designed, manufactured and/or operated according to one or more embodiments of the disclosure. FIGS. 9A through 9D illustrated outside views of the whipstock 900, whereas FIGS. 10A through 10D illustrate cross-sectional views of the whipstock 900. The whipstock 900, in one or more embodiments, includes a detachable whipface with sealing capabilities. For example, in at least one embodiment, the whipstock 900 includes a bottom hole assembly (BHA) that will allow: 1) the creation of a lateral wellbore; 2) the ability to drop screens in the lateral wellbore; and 3) a sequence to detach the whipface and expose a seal sub to install a multilateral junction.

The whipstock 900, in one or more embodiments, includes a whipface 910 having an angled casing string exit surface 915. The whipstock 900, according to at least one embodiment, further includes a sub 950 detachably coupled to the whipface 910, as well as a bottom hole assembly 980 fixedly coupled to the sub 950. The sub 950, in one or more embodiments, is a lower sub 960, and the whipstock 900 further includes an upper sub 920 fixedly coupled to the whipface 915 between the whipface 915 and the lower sub 960. In at least one embodiment, one or more shear features 925 detachably couple the whipface 910 and upper sub 920 to the lower sub 960. Any number and type of shear features 925 may be used and remain within the scope of the disclosure.

In at least one embodiment, the whipstock 900 further includes a plurality of members 970 and member profiles 930 in the lower sub 960 and upper sub 920. In one or more embodiments, the members 970 and member profiles 930 are teeth and grooves configured to cooperate to rotationally fix the lower sub 960 and the upper sub 920, and thus take any rotational stress from the shear features 925. Many different configurations for the members 970 and member profiles 930 may be used and remain within the scope of the disclosure.

In at least one embodiment, the upper sub 920 includes a tubular 940 that extends within the lower sub 920 and at least a portion of the bottom hole assembly 980. The tubular 940, in at least one embodiment, may have one or more debris collection devices 942 located therein. For instance, in at least one embodiment, the tubular 940 has a first course debris filter 942*a* located within the tubular 940 and a second fine debris filter 942*b* located within the tubular 940 downhole of the first course debris filter 942*a*. In yet another embodiment, the debris collection devices could be a magnet, scraper, etc. and remain within the scope of the disclosure. Other configurations for the number of debris collection devices 942, type of debris collection devices 942 and relative locations for the debris collection devices 942 may be used and remain within the scope of the disclosure.

The bottom hole assembly 980, in accordance with one embodiment of the disclosure, includes one or more seals 985 positioned along an inner surface thereof. The one or more seals 985, in at least one embodiment, are protected by the tubular 940 of the upper sub 920 when the whipface 910 and upper sub 920 are engaged with the lower sub 960, but will be exposed to other features (e.g., a mainbore leg of a multilateral junction) when the whipface 910 and upper sub 920 are disengaged from the lower sub 960. In at least one embodiment, the one or more seals 985 are T-seals that form at least a portion of a seal sub.

The bottom hole assembly 980, in one or more embodiments, may additionally include an alignment key 990 located along an outer surface thereof. The alignment key 990, in at least one embodiment, may be configured to engage with a muleshoe of a related feature to rotationally position the whipface 910 within a casing string of a wellbore. The bottom hole assembly 980, in one or more other embodiments, may additionally include one or more second seals 992 located along the outer surface thereof proximate a downhole end thereof, the one or more second seals 992 (e.g., V-pack seals) configured to engage and seal with a mainbore completion (e.g., not shown). The bottom hole assembly 980, in yet another embodiment, may further include an anchor 994 (e.g., latch for a multilateral anchor) positioned between the alignment key 990 and the one or more second seals 992, the anchor 994 configured to laterally fix the bottom hole assembly 980 relative to the mainbore completion.

Turning to FIGS. 11A through 11E, illustrated is one embodiment of a detaching sequence for a whipstock 1100 designed, manufactured and/or operated according to one or more embodiments of the disclosure. In the given embodiment, the whipstock 1100 is substantially similar to the whipstock 900 disclosed above. Accordingly, like reference numbers have been used to indicate similar, if not identical, features.

Figure 11A:
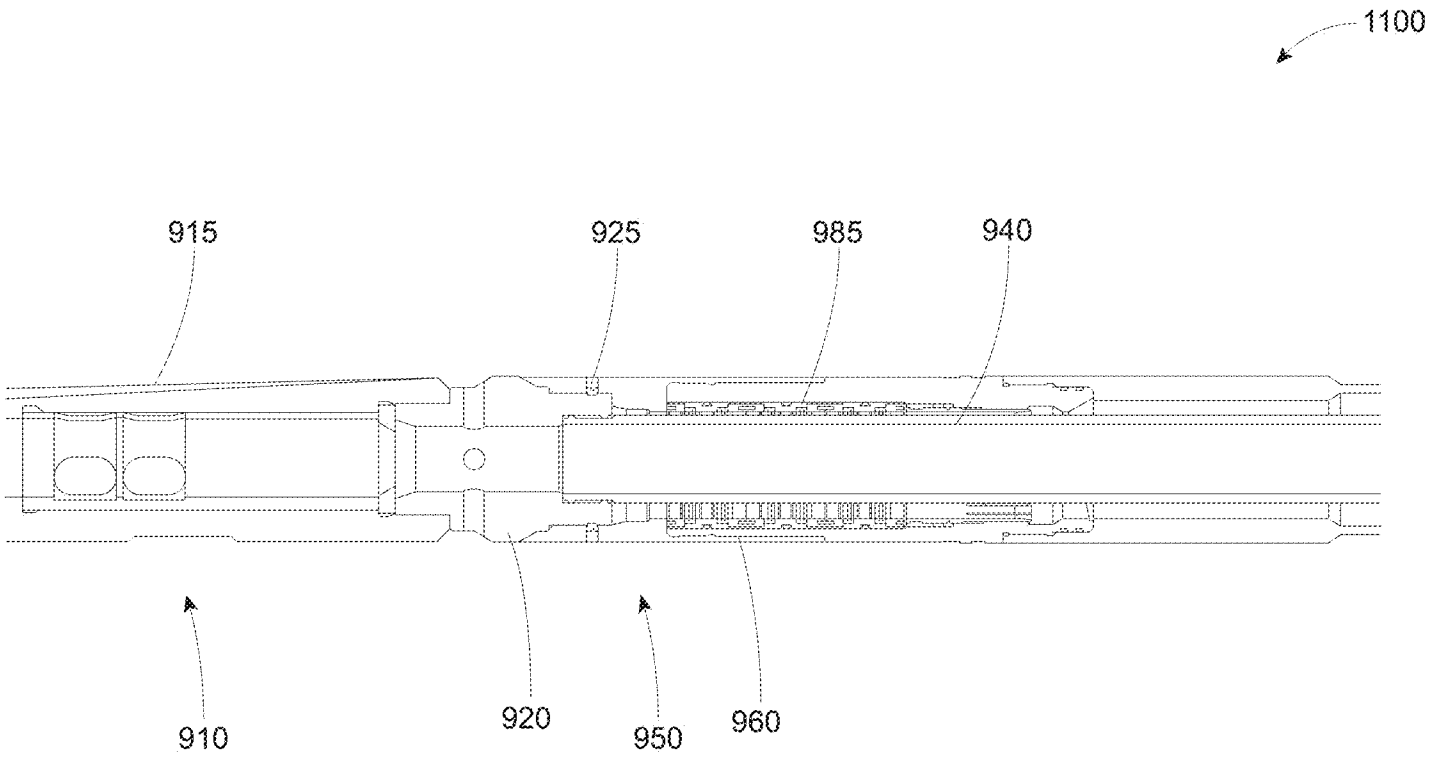
FIGS. 11A through 11E illustrate one embodiment of a detaching sequence for a whipstock designed, manufactured and/or operated according to one or more embodiments of the disclosure.
Figure 11B:
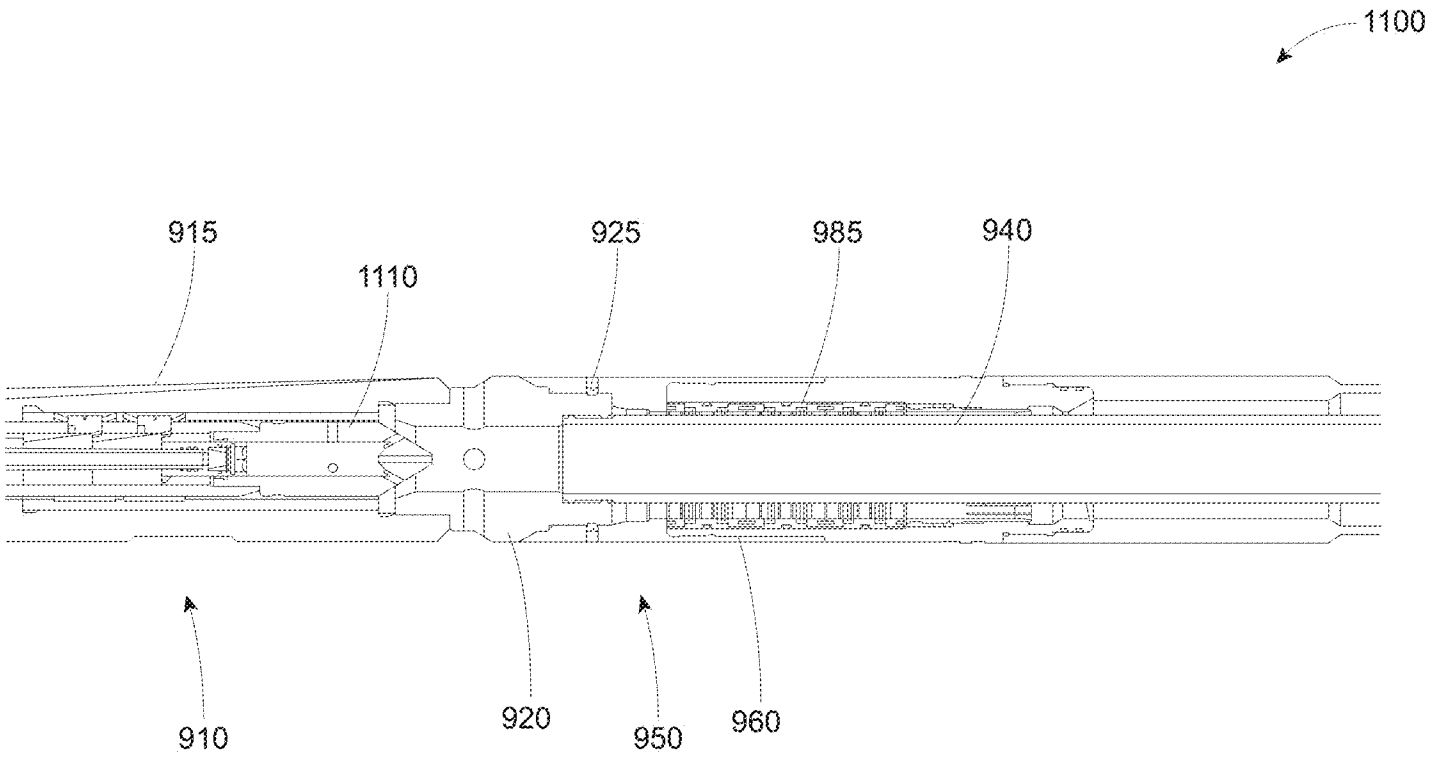
Figure 11C:
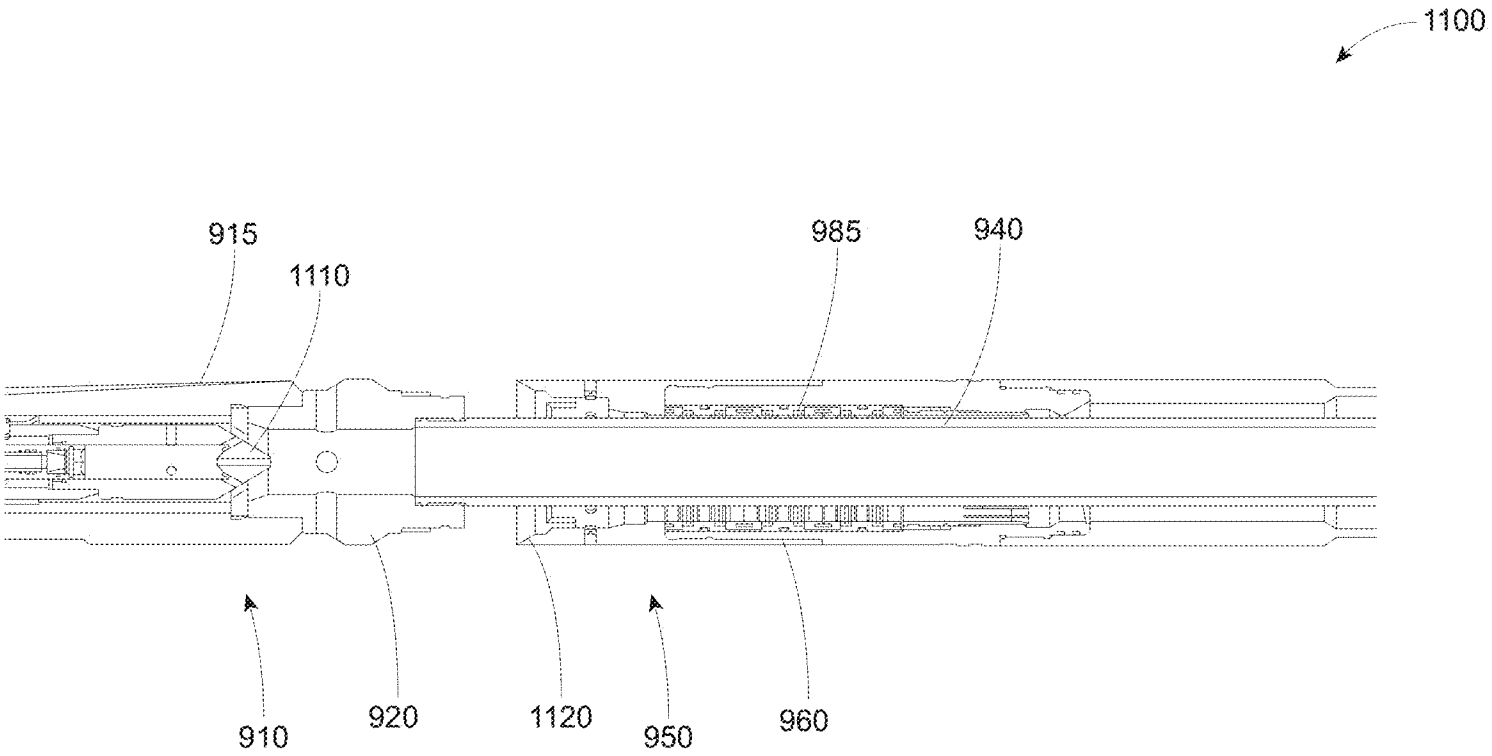
Figure 11D:
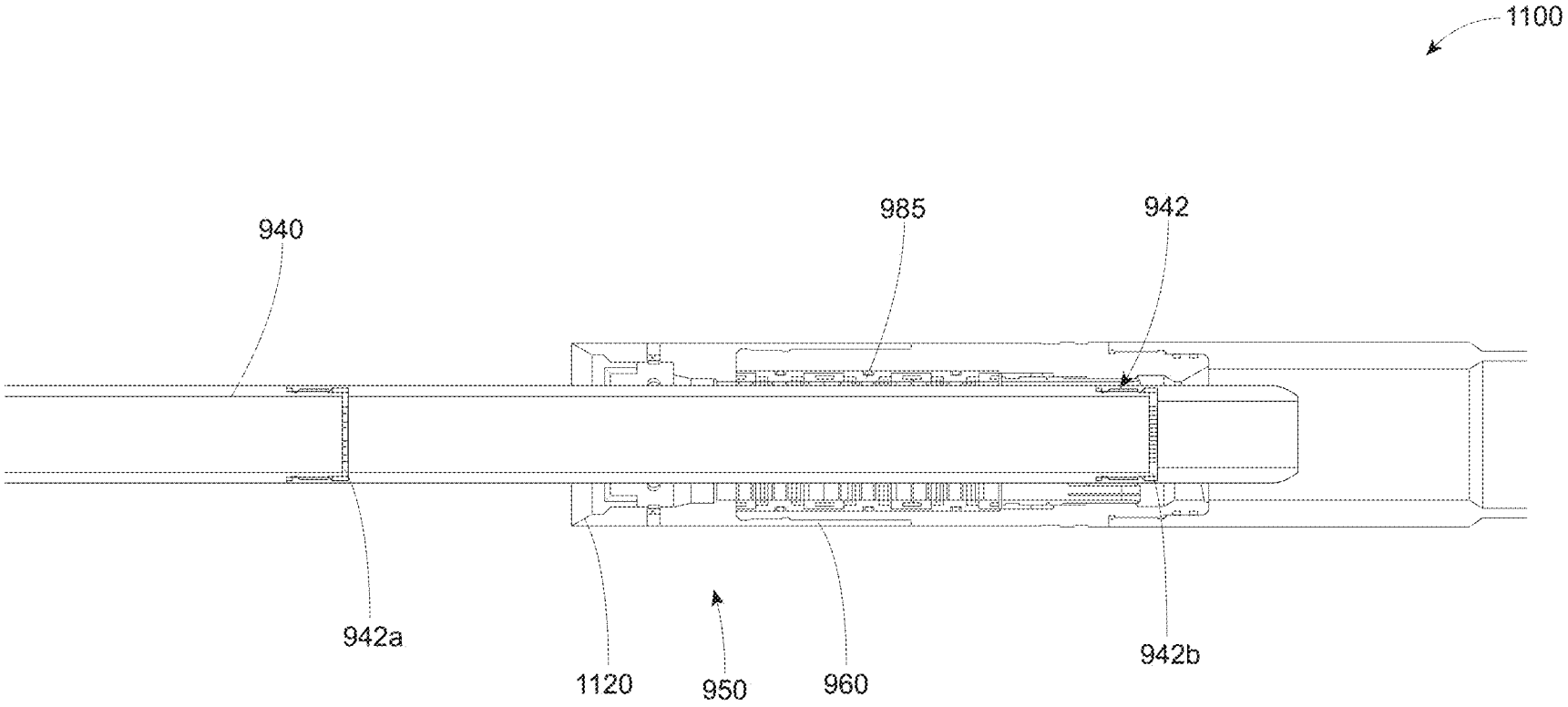
Figure 11E:
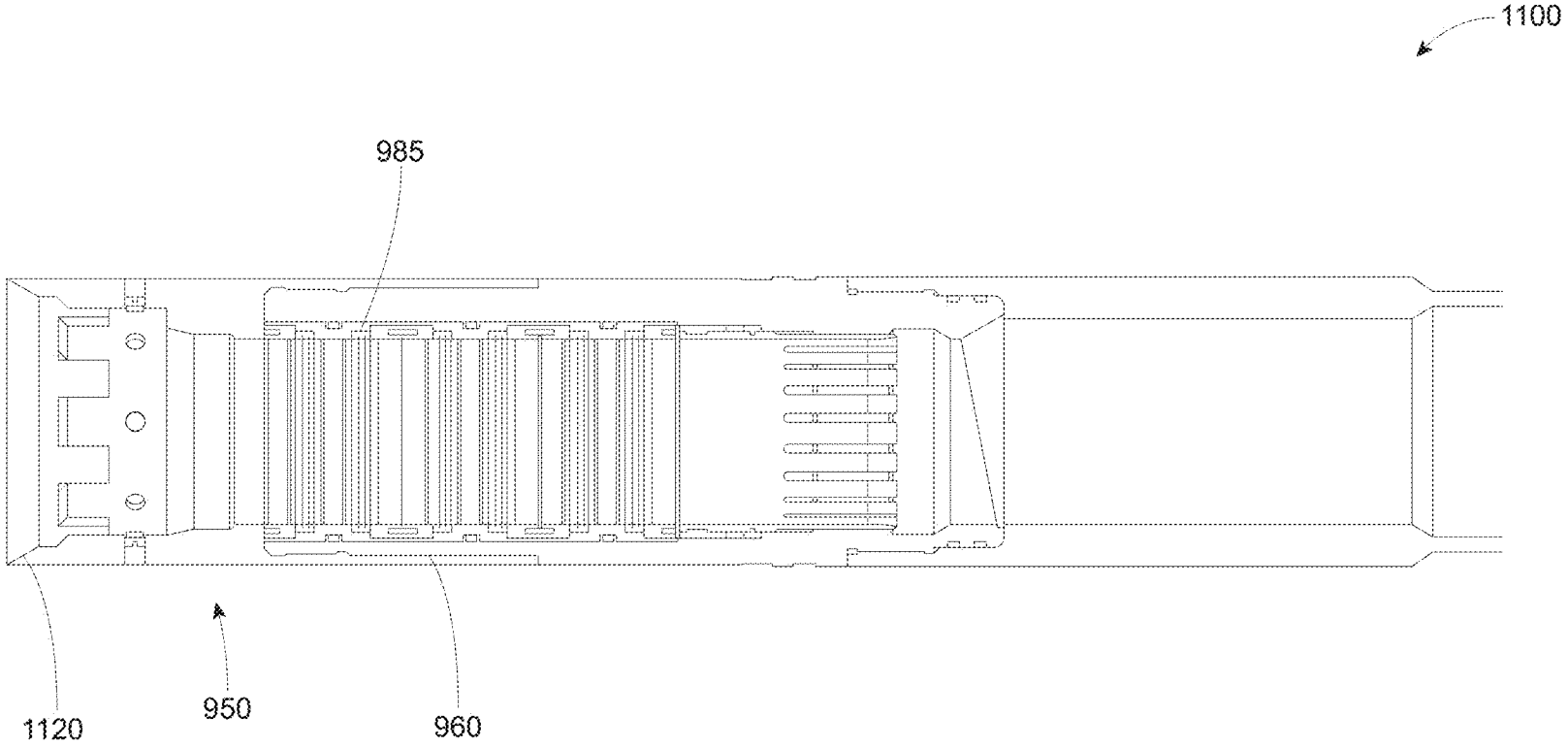

FIG. 11A illustrates the installation of the whipstock 1100. FIG. 11B illustrates the engagement of a running tool 1110 with the whipface 910 and/or upper sub 920. Accordingly, the whipface 910 and upper sub 920 are ready to be detached. FIG. 11C illustrates the shearing of the shear features 925 (e.g., with a straight pull of the running tool 1110). Accordingly, the whipface 910 and upper sub 920 are detached at this moment. FIG. 11D illustrates as the whipface 910 and the upper sub 920 continue to be pulled out of hole. Accordingly, any debris trapped within the tubular 940 may be recovered. At this stage, the one or more seals 985 remain protected by the tubular 940. FIG. 11E illustrates that the lower sub 960 and the one or more seals 985 remain in the mainbore, for example with an angled shoulder 1120 to allow for easy entry of another downhole tool (e.g., mainbore leg of a multilateral junction). The angled shoulder 1120, in at least one embodiment, may be angled by 10, 15, 30, 45 or more degrees). Furthermore, in at least one embodiment the remaining lower sub 960, as well as all remaining portions of the whipstock 1100, is entirely free of an angled casing string exit surface.

Figure 12A:
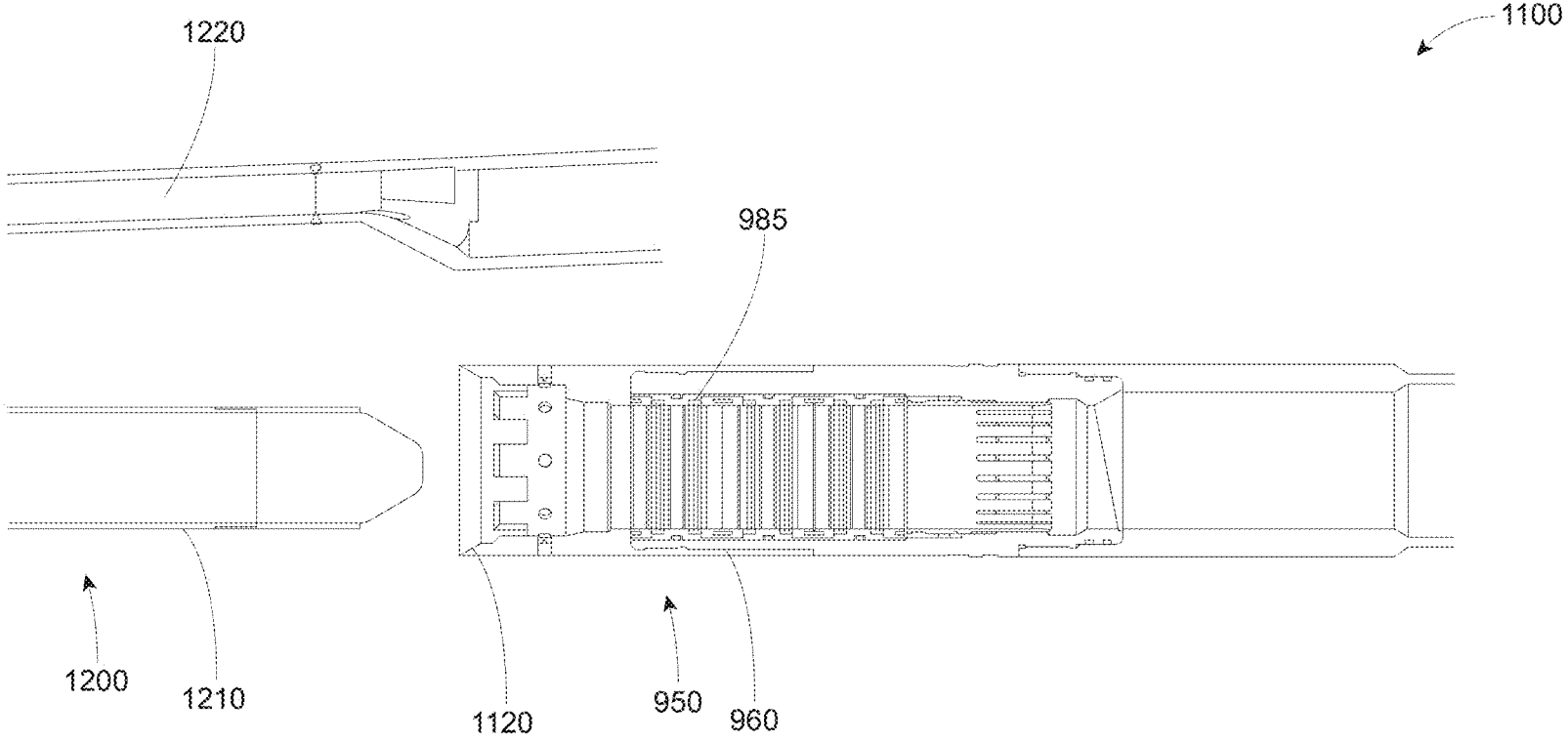
FIGS. 12A through 12C illustrate one embodiment of a multilateral junction including a mainbore leg and a lateral bore leg engaging with the lower sub and/or one or more seals of the whipstock of FIG. 11E.
Figure 12B:
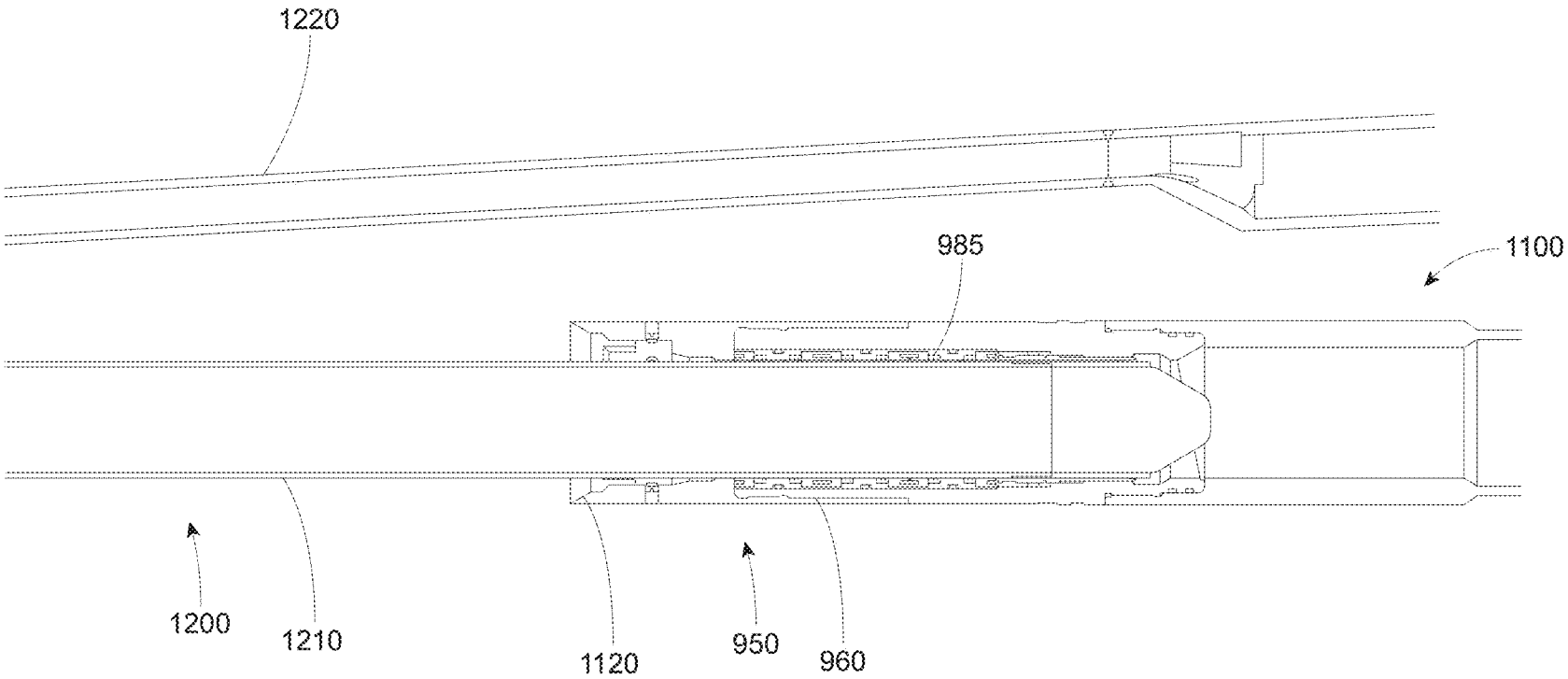
Figure 12C:
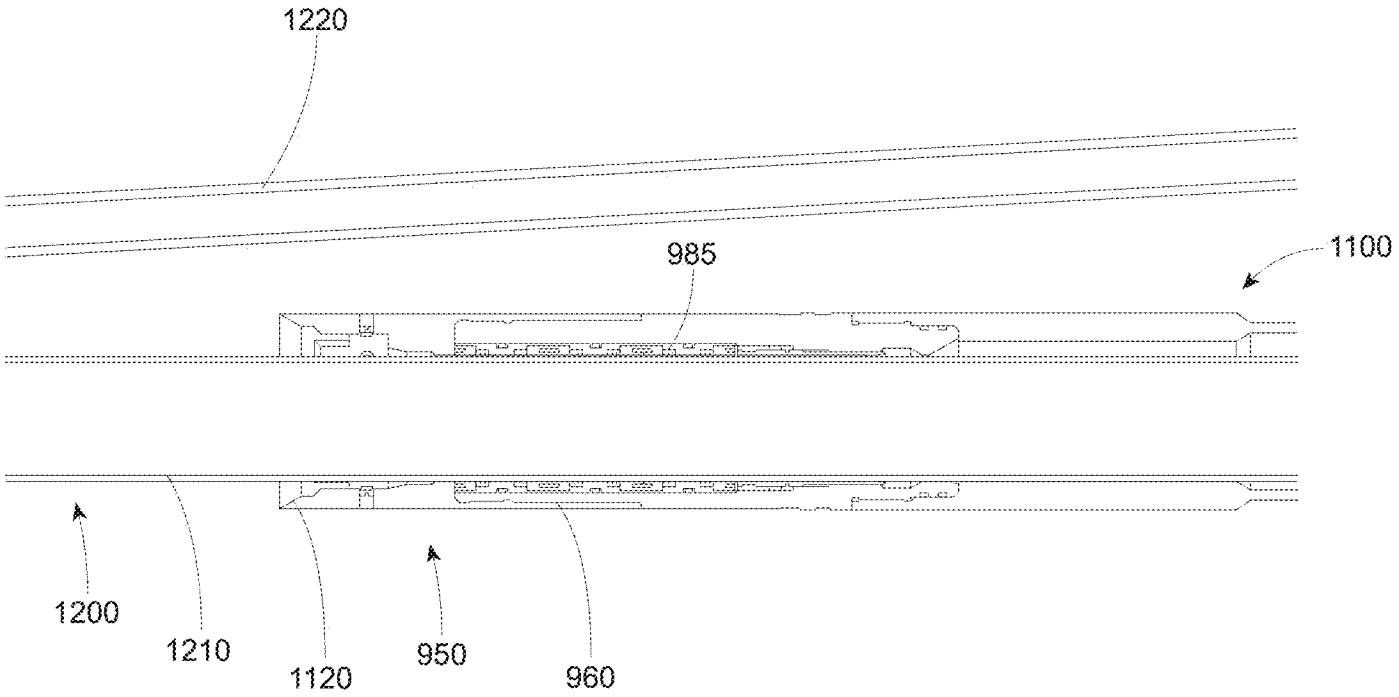

Turning to FIGS. 12A through 12C, illustrated is one embodiment of a multilateral junction 1200 including a mainbore leg 1210 and a lateral bore leg 1220 engaging with the lower sub 960 and/or one or more seals 985 of the whipstock 1100 of FIG. 11E. FIG. 12A illustrates that the mainbore leg 1210 of the multilateral junction 1200 is just about to enter the lower sub 960. FIG. 12B illustrates as the mainbore leg 1210 just begins to engage with the one or more seals 985. FIG. 12C illustrates as the mainbore leg 1210 is fully engaged with the lower sub 960, and thus the one or more seals 985 are fully engaged.

Figure 13A:
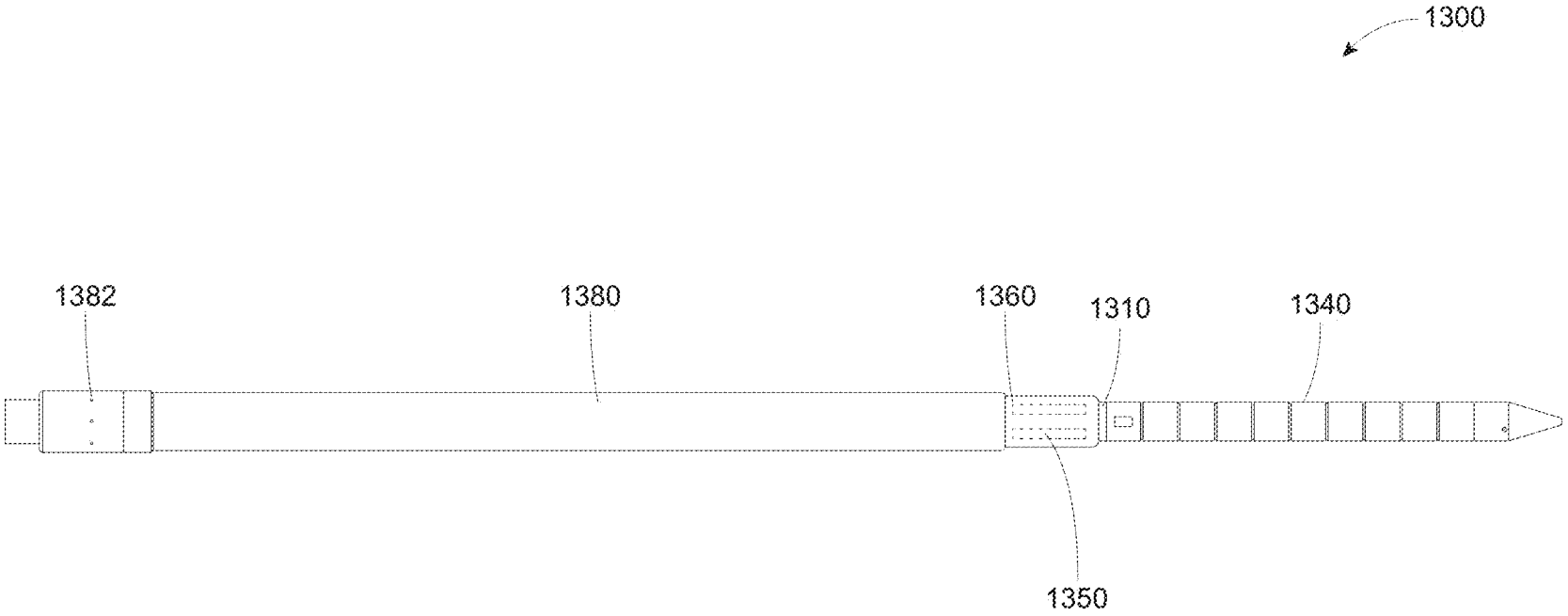
FIGS. 13A through 13D illustrate various different views (e.g., outside and partial cutaway perspective) of a lateral locating assembly designed, manufactured and/or operated according to one or more embodiments of the disclosure.
Figure 13B:
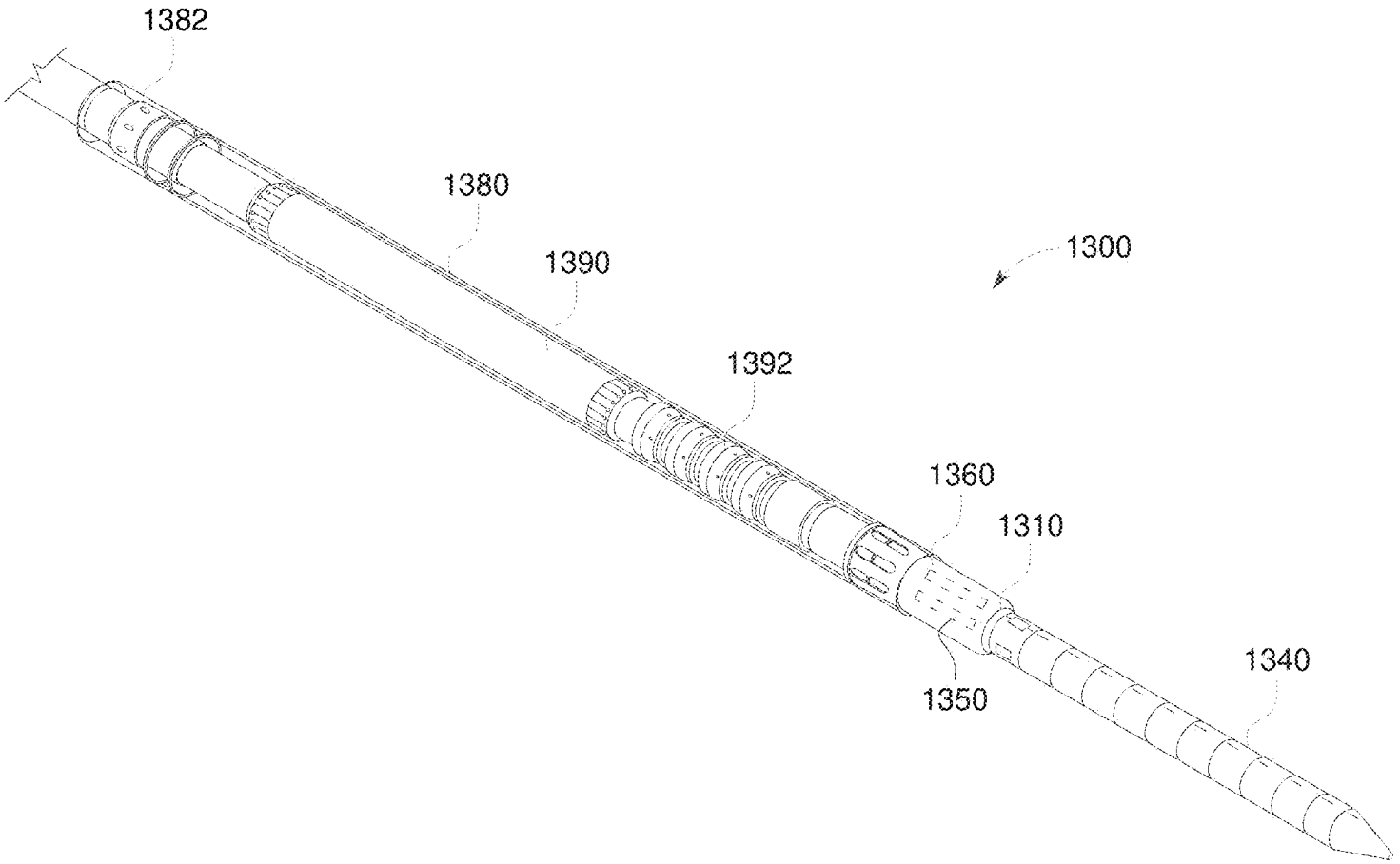
Figure 13C:
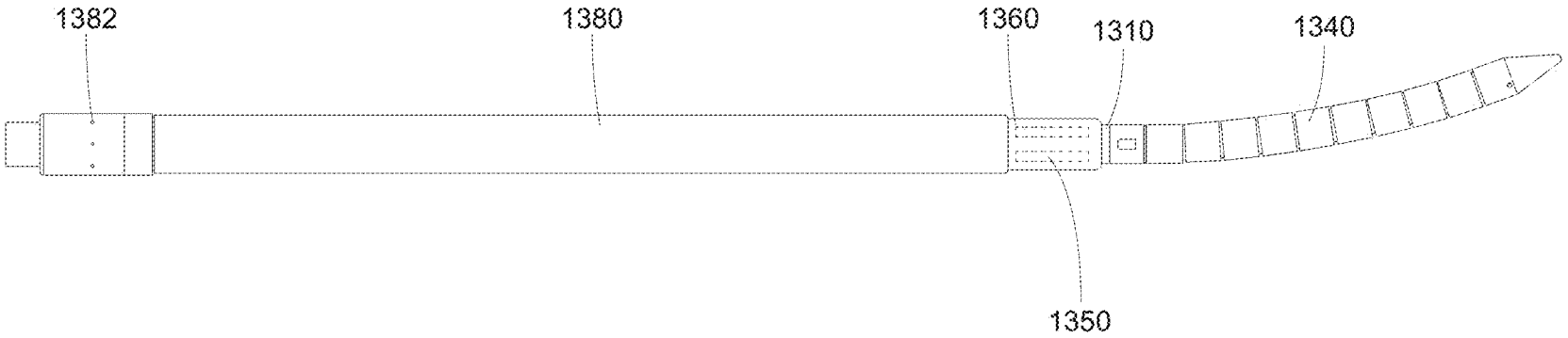
Figure 13D:
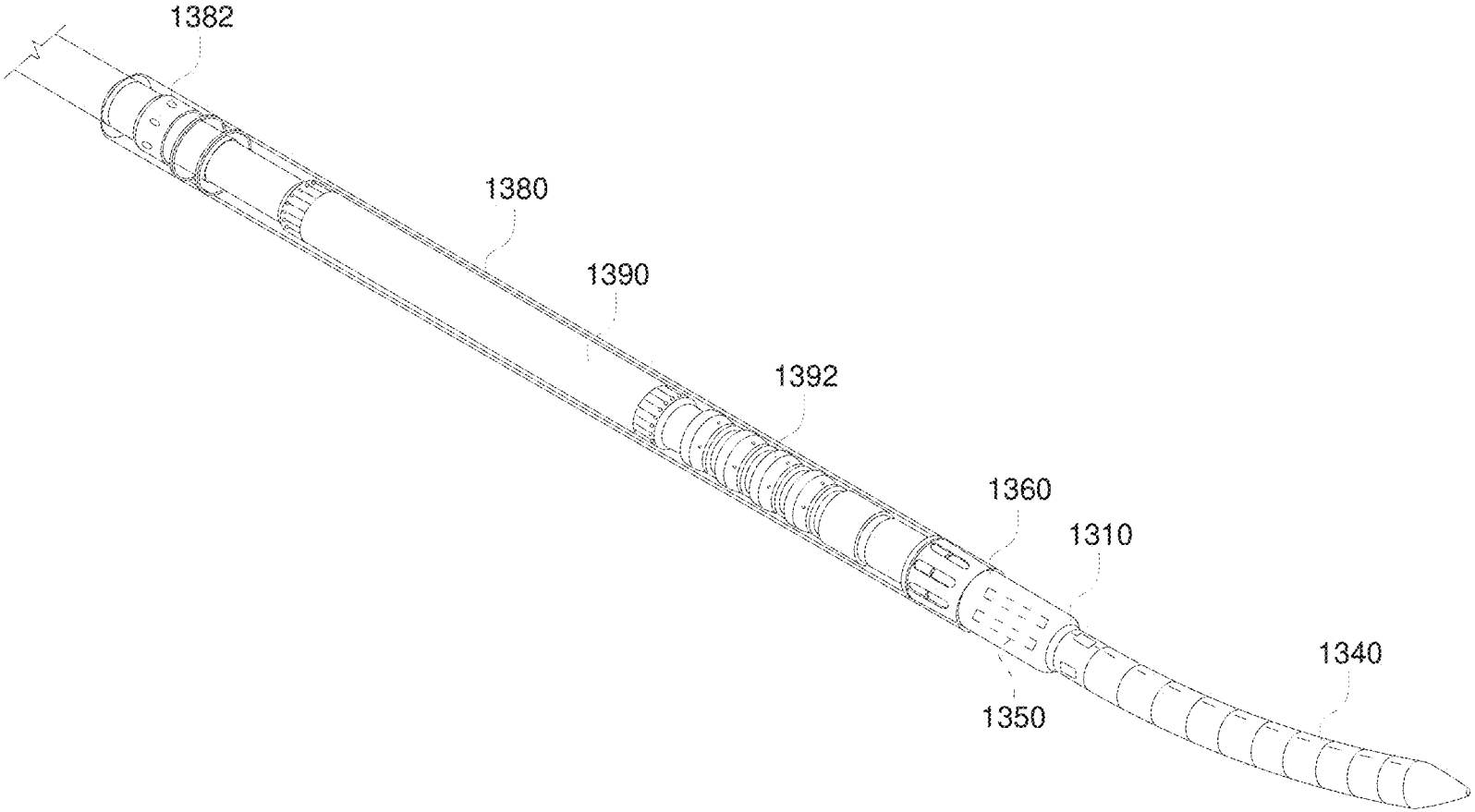

Turning to FIGS. 13A through 13D, illustrated are various different views (e.g., outside and partial cutaway perspective) of a lateral locating assembly 1300 designed, manufactured and/or operated according to one or more embodiments of the disclosure. FIGS. 13A and 13B illustrate the lateral locating assembly 1300 in a run-in-hole position, whereas FIGS. 13C and 13D illustrate the lateral locating assembly 1300 in a bent position.

The lateral locating assembly 1300, in at least one embodiment, includes a tubular 1310. The tubular 1310, in at least one embodiment, is coupled to a fluid pressure source (e.g., not shown). The tubular 1310, in one or more embodiments, may have a length (L). The length (L) may be chosen and/or tailored to allow the lateral locating assembly 1300 to enter and extend within a lateral wellbore for a great amount of distance (e.g., before a sliding sleeve of the lateral locating assembly encounters a lateral liner thereof). In at least one embodiment, the length (L) may be at least 10 m, 20 m, 30 m, 50 m, 100 m or more, depending on the design of the lateral locating assembly 1300.

The lateral locating assembly 1300, in at least one other embodiment, includes a bendable deflection tip 1340 coupled to the tubular 1310. In at least one embodiment, the bendable deflection tip 1340 is configured to move between a straight position (e.g., as shown in FIGS. 13A and 13B) and a bent position (e.g., as shown in FIGS. 13C and 13D) upon the application of fluid pressure thereto. The bendable deflection tip 1340, and the movement thereto, in one or more embodiments may track that shown and discussed above with regard to FIGS. 1 through 5 and/or FIGS. 6 through 8E, among other possible configurations. Nevertheless, the embodiment of FIGS. 13A through 13D are more similar to the lateral locating assembly of FIGS. 6 through 8E.

In at least one embodiment, the lateral locating assembly 1300 includes one or more production ports 1350 coupling an interior of the tubular 1310 and an exterior of the tubular 1310. The one or more production ports 1350, in contrast to existing lateral locating assemblies, provide a fluid path for production fluid to enter and/or exit the lateral locating assembly 1300 for passageway between a surface of the wellbore and a subterranean formation.

In one or more embodiments, the lateral locating assembly 1300 includes a sliding sleeve 1360 positioned about the one or more production ports 1350, the sliding sleeve 1360 configured to seal the one or more production ports 1350 when in a first position and expose the one or more production ports 1350 when in a second position. Accordingly, the sliding sleeve 1360 may be moved to the second position at a time when it is necessary or desirable for the production fluid to enter the lateral locating assembly 1300.

In one or more embodiments, the lateral locating assembly 1300 additionally includes a shroud 1380 positioned about the tubular 1310 and removably coupled to the sliding sleeve 1360. For example, the shroud 1380 could be sized such that it may enter a lateral wellbore and remain fixed in the run-in-hole position, but it is too large to enter the lateral liner. Thus, when the lateral locating assembly 1300, and more particularly the shroud 1380, encounters the lateral liner, the shroud 1380 remains fixed in location while other features of the lateral locating assembly 1300 may continue downhole. In one or more embodiments, it is this mechanism that shifts the sliding sleeve 1360 from the first position to the second position. Moreover, the lateral locating assembly 1300 may additionally include one or more shear features 1381 releasably coupled to the shroud 1380 to hold the sliding sleeve 1360 in the first position until the shroud 1380 encounters the lateral liner.

The lateral locating assembly 1300, in one or more embodiments, may further include a packer 1390 coupled to the tubular 1310 uphole of the bendable deflection tip 1340. In at least one embodiment, the packer 1390 is a swell packer protected by the shroud 1380 when the sliding sleeve 1360 is in the first position. The lateral locating assembly 1300, in at least one embodiment, may further include one or more swab cups 1392 protected by the shroud 1380 when the sliding sleeve 1360 is in the first position, the one or more swab cups 1392 configured to provide a seal until the swell packer fully sets (e.g., once the lateral locating assembly 1300 is properly placed within the lateral wellbore, and ideally coupled to the lateral completion).

Turning to FIGS. 14A through 14H, illustrated are various cross-sectional views of another embodiment of a lateral locating assembly 1400 at various different deployment states. The lateral locating assembly 1400 is similar in many respects to the lateral locating assembly 1300. Accordingly, like reference numbers have been used to indicate similar, if not identical, features. The lateral locating assembly 1400, in one or more embodiments, also includes one or more no go blades 1410 coupled to a tip of the bendable deflection tip 1340, the one or more no go blades 1410 configured to prevent the bendable deflection tip from accessing a main wellbore completion.

In one or more embodiments, the sliding sleeve 1360 includes a collet 1462, the collet 1462 fixing the sliding sleeve 1360 to the shroud 1380 when the sliding sleeve 1360 is in the first position and releasing the sliding sleeve 1360 from the shroud 1380 when the sliding sleeve 1360 is in the second position. Further to this one embodiment, the shroud 1380 may include a first collet groove 1482 configured to engage the collet 1462 in an expanded state to fix the sliding sleeve 1360 to the shroud 1380 when the sliding sleeve 1360 is in the first position. Similarly, the tubular 1310 may include a second collet groove 1412 configured to accept the collet 1462 in a collapsed state to release the sliding sleeve 1360 from the shroud 1380 when the sliding sleeve 1360 is in the second position. In one or more embodiments, such as shown, the lateral locating assembly 1400 may additionally include a snap ring 1464 and snap ring groove 1414 located in ones of the tubular 1310 and the sliding sleeve 1360, the snap ring 1464 configured to engage with the snap ring groove 1414 when the sliding sleeve 1360 is in the second position to fix the sliding sleeve 1360 in the second position.

Figure 14A:
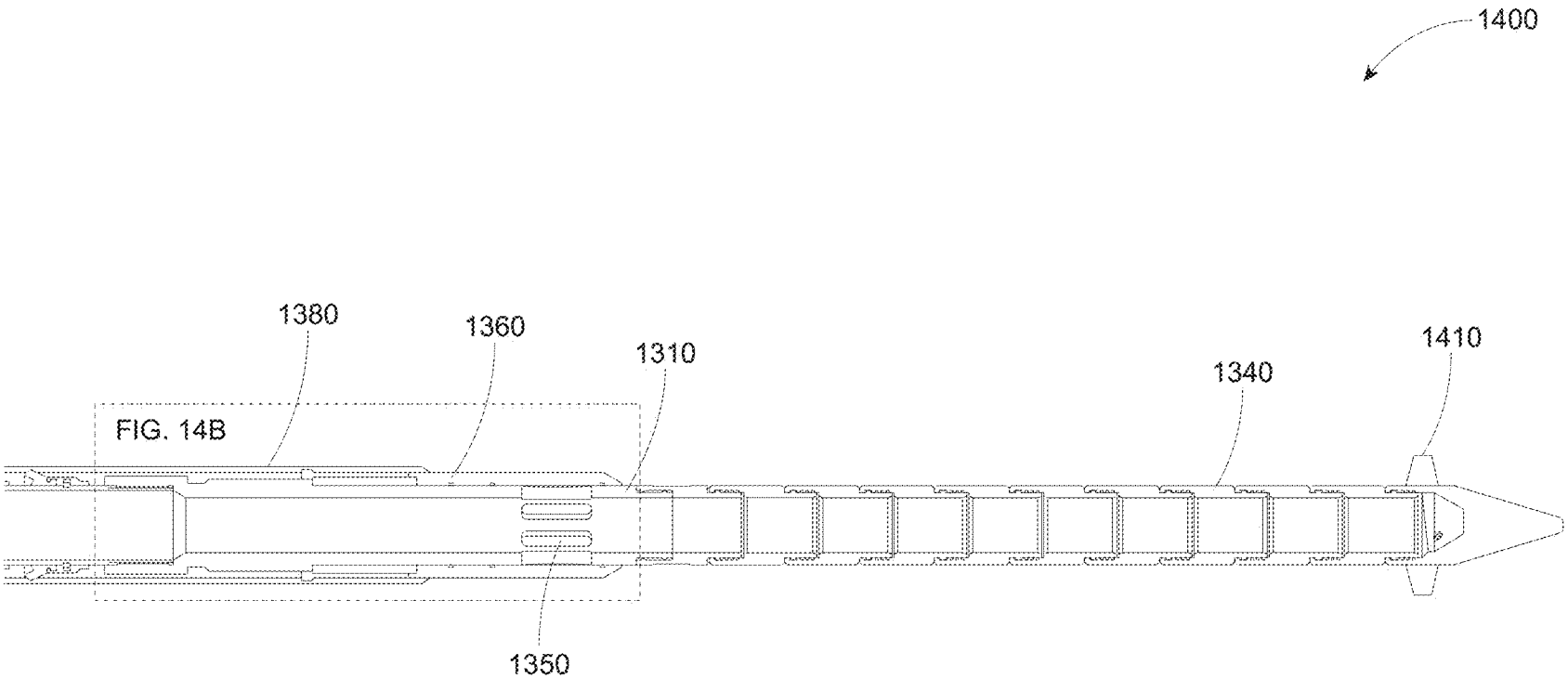
FIGS. 14A through 14H illustrate various cross-sectional views of another embodiment of a lateral locating assembly at various different deployment states.
Figure 14B:
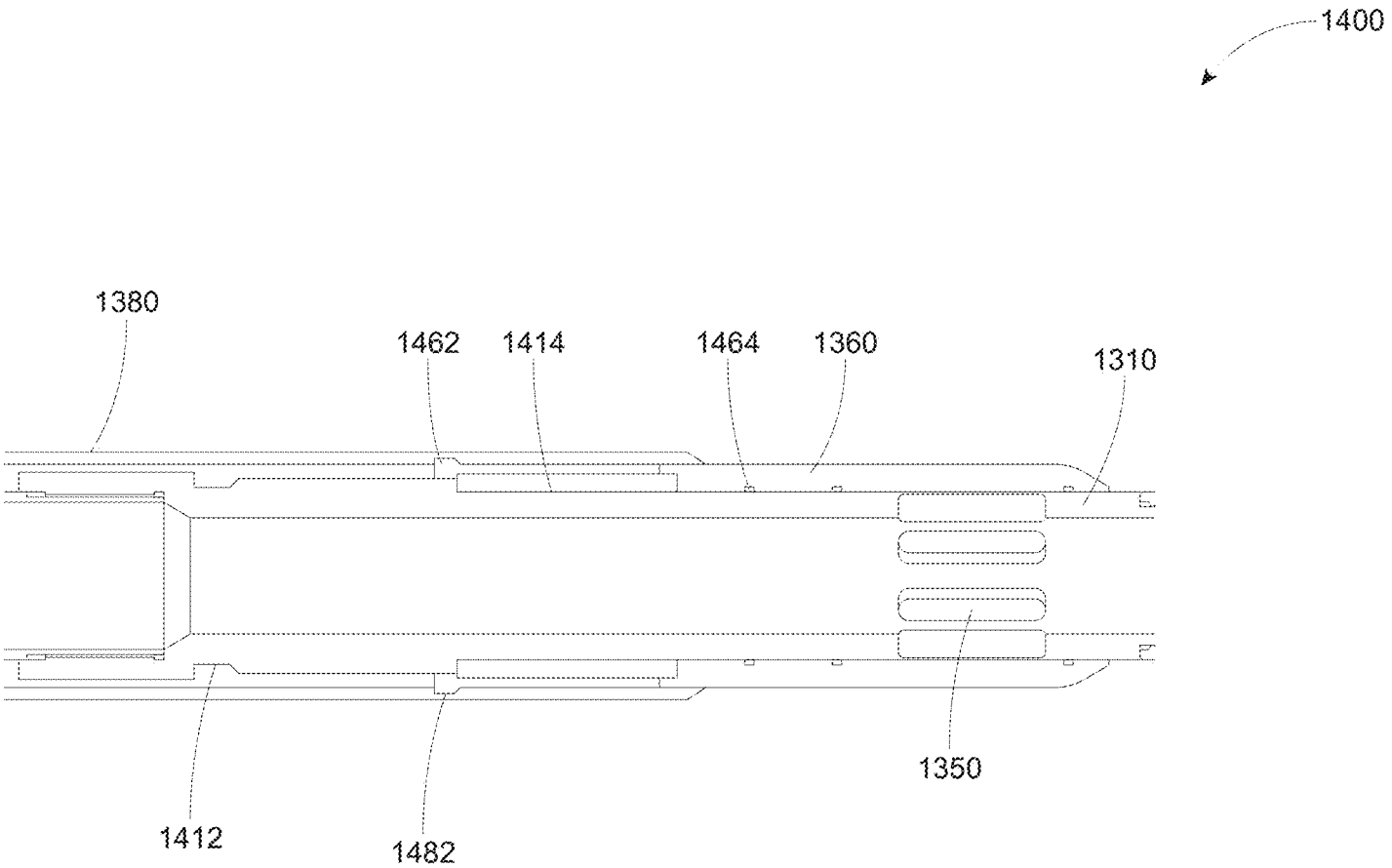
Figure 14C:
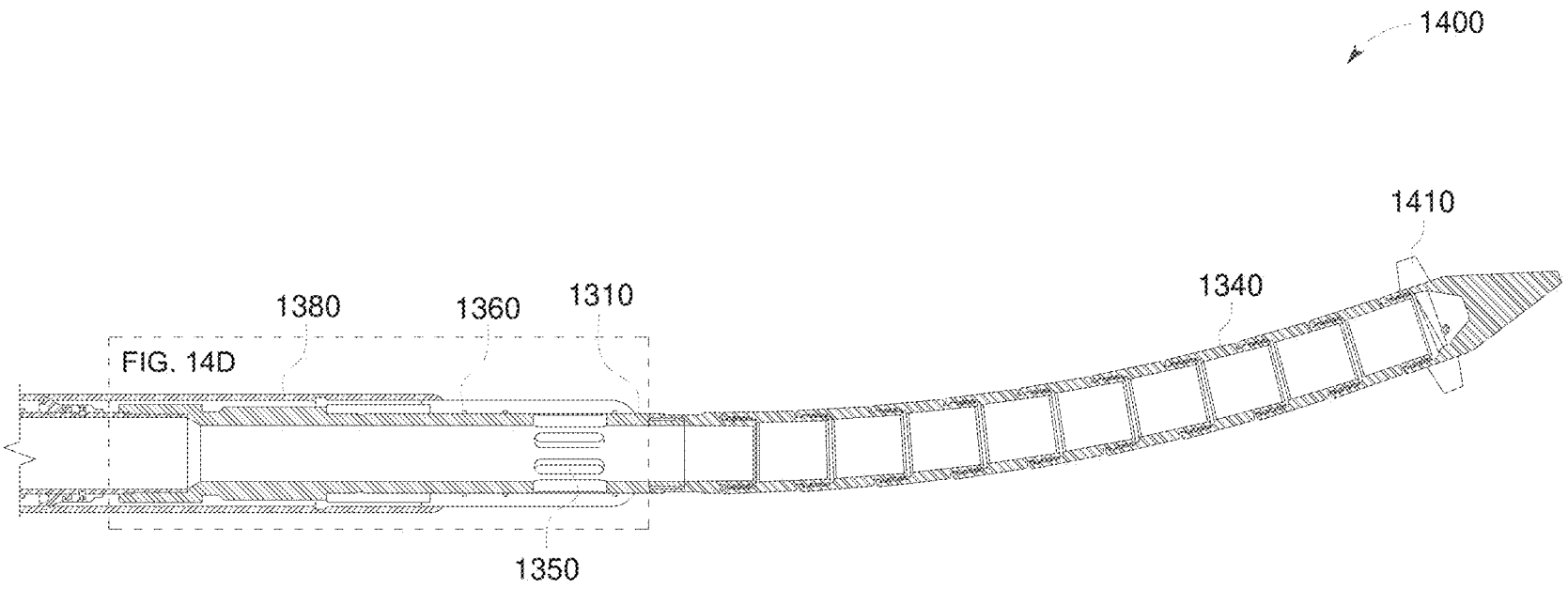
Figure 14D:
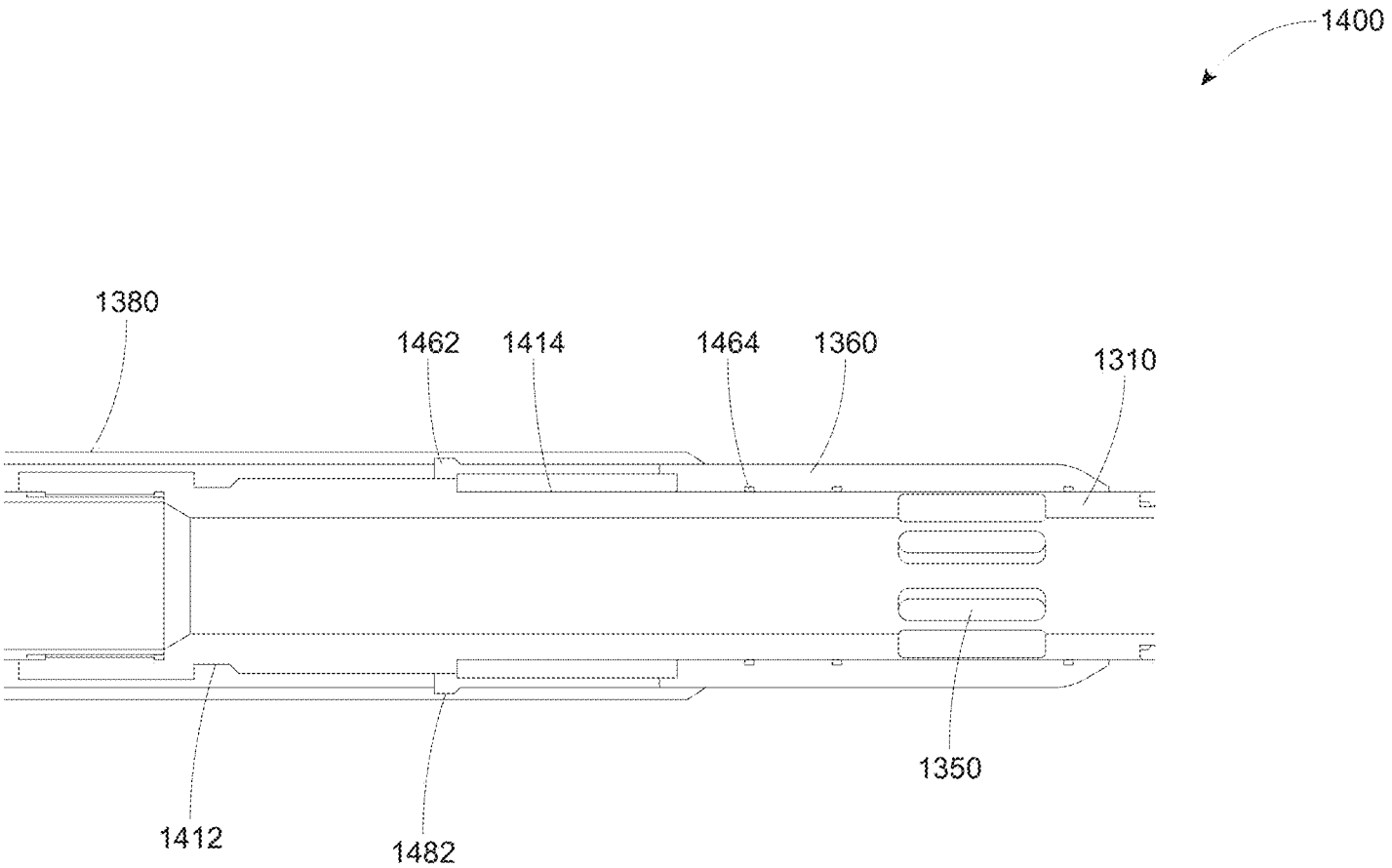
Figure 14E:
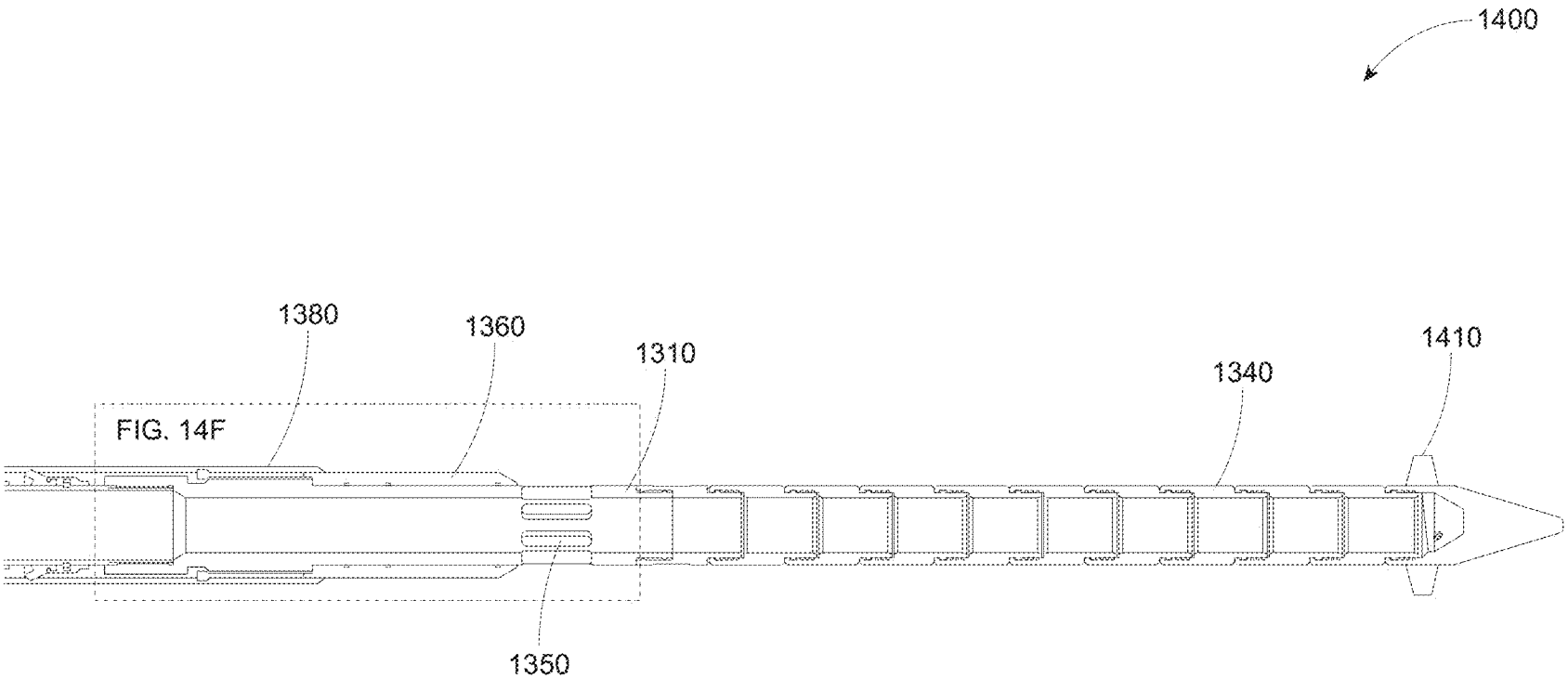
Figure 14F:
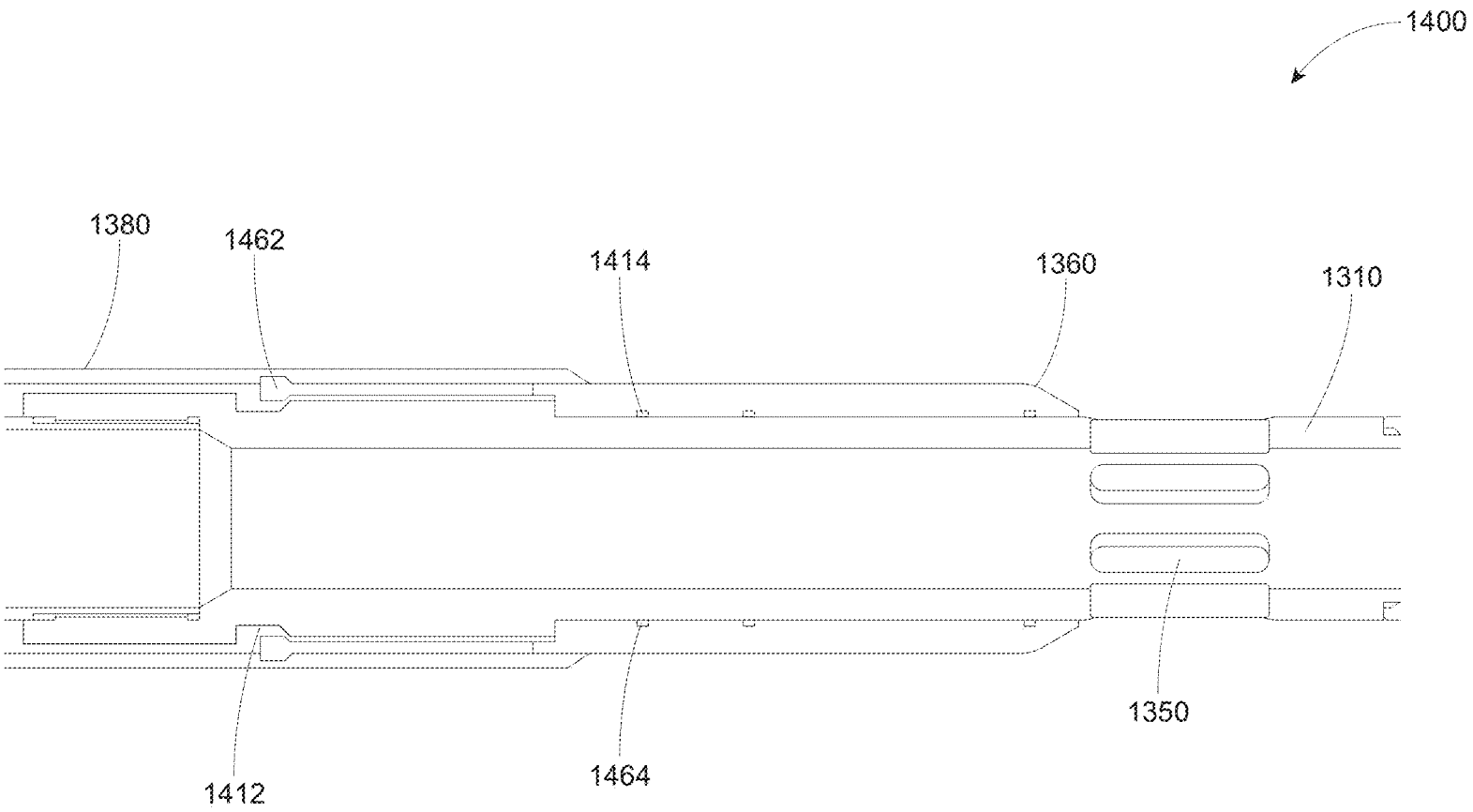
Figure 14G:
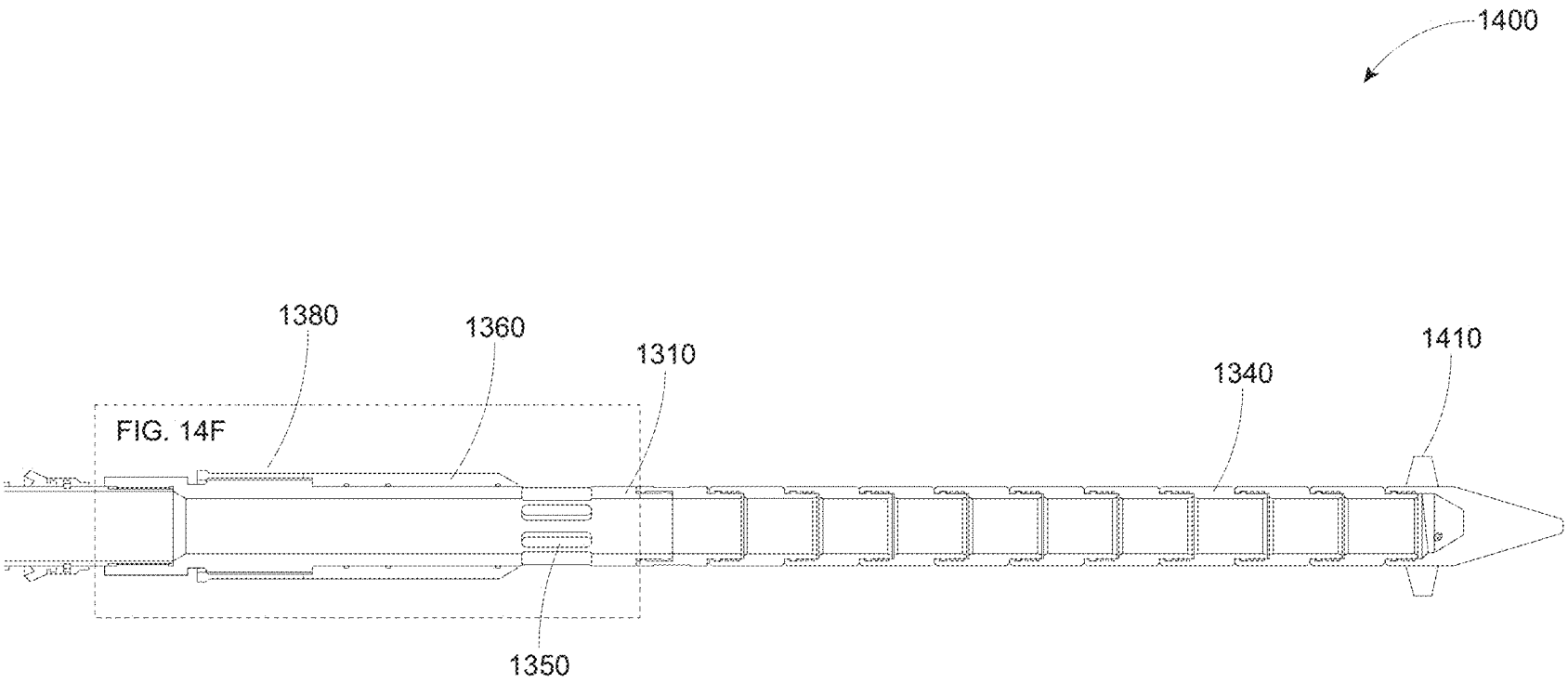
Figure 14H:
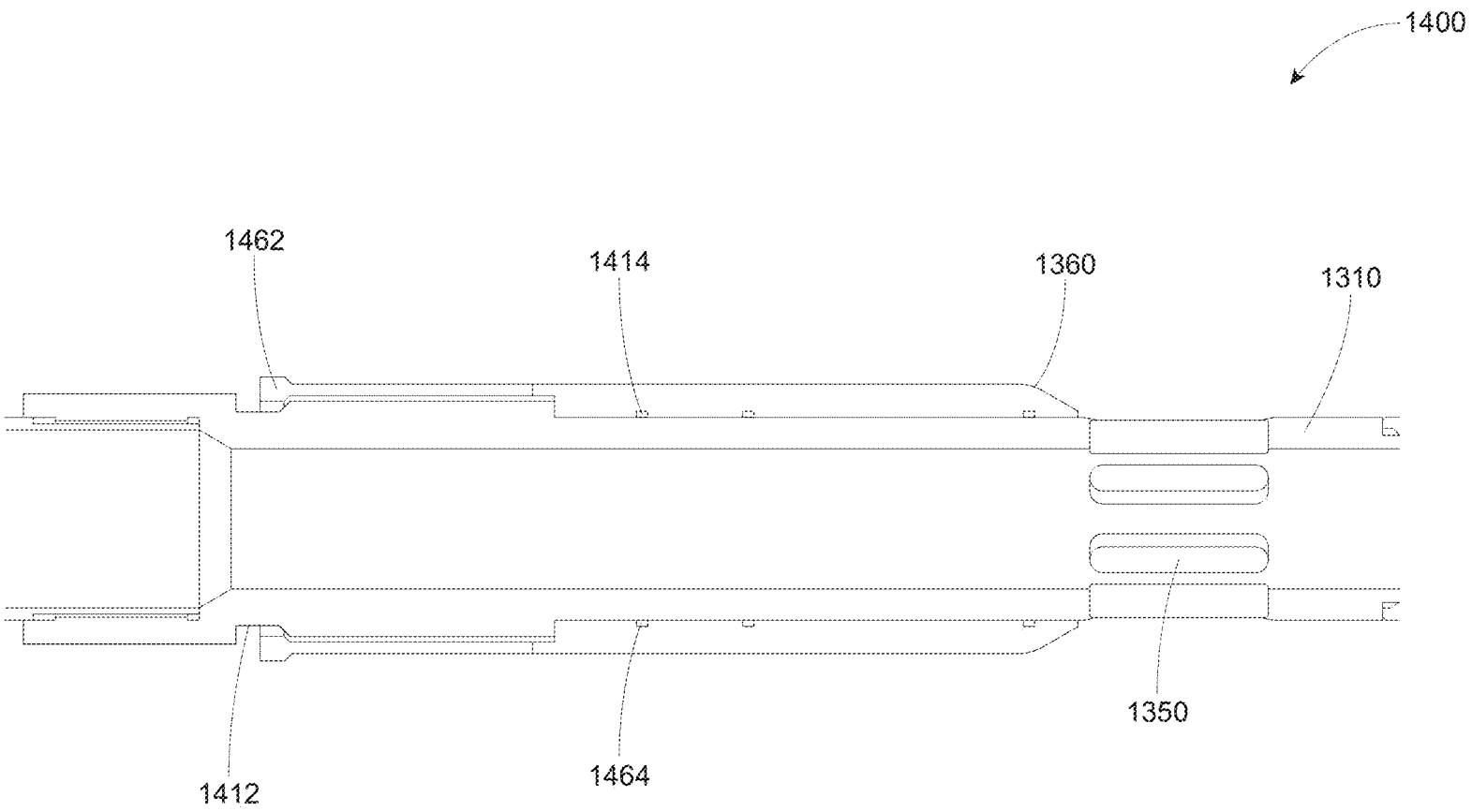

FIGS. 14A and 14B illustrate the lateral locating assembly 1400 in the run-in-hole position, and thus the bendable deflection tip 1340 is in the straight position and the sliding sleeve 1360 is in the closed position. FIGS. 14C and 14D illustrate the lateral locating assembly 1400 after the bendable deflection tip 1340 is in the bent position, and the sliding sleeve 1360 remains in the closed position. FIGS. 14E and 14F illustrate the lateral locating assembly 1400 after the bendable deflection tip 1340 has returned to the straight position, and the shroud 1380 and sliding sleeve 1360 have slid to expose the one or more production ports 1350. FIGS. 14G and 14H illustrate the lateral locating assembly 1400 after the shroud 1380 has released from the sliding sleeve 1360.

Figure 15A:
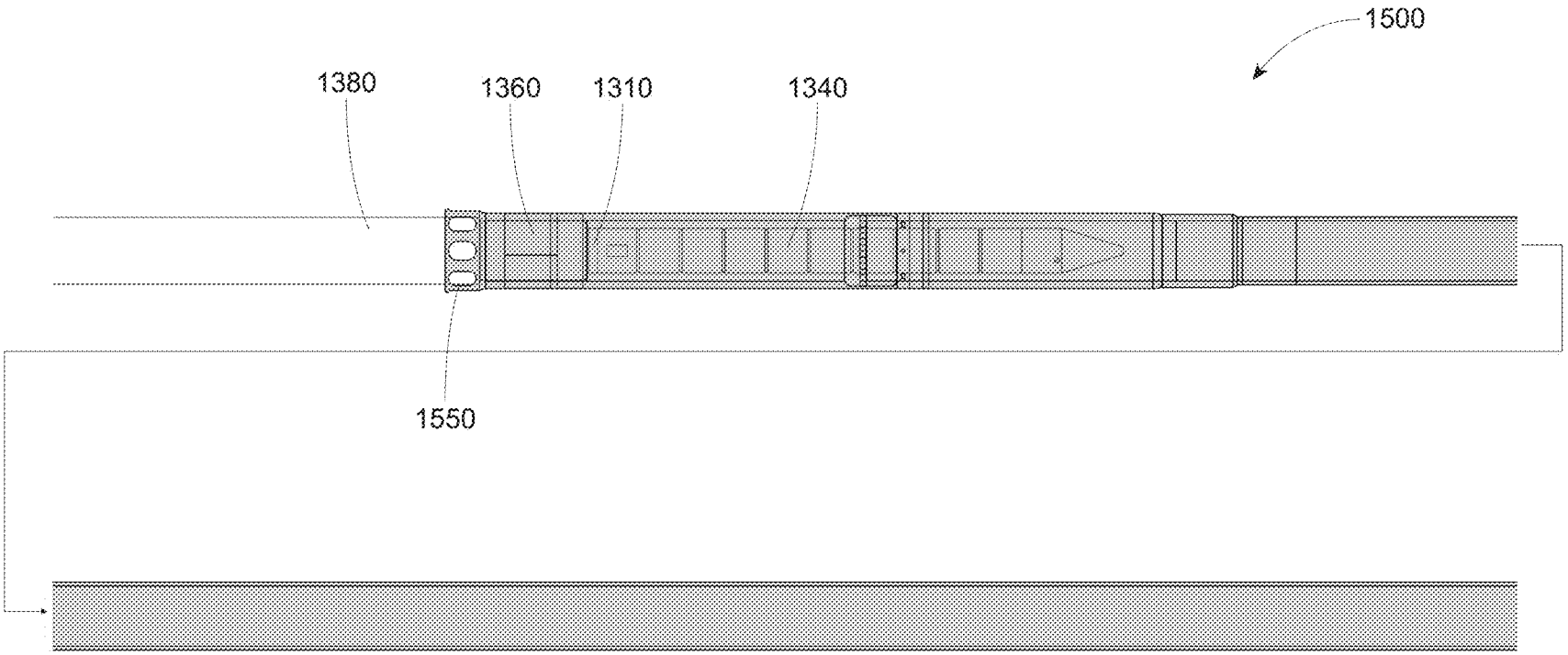
FIGS. 15A through 15C illustrate various different operational views of a lateral locating assembly engaging with a lateral liner, as might occur when the lateral locating assembly has entered a lateral wellbore and is proceeding to engage with a lateral completion.
Figure 15B:
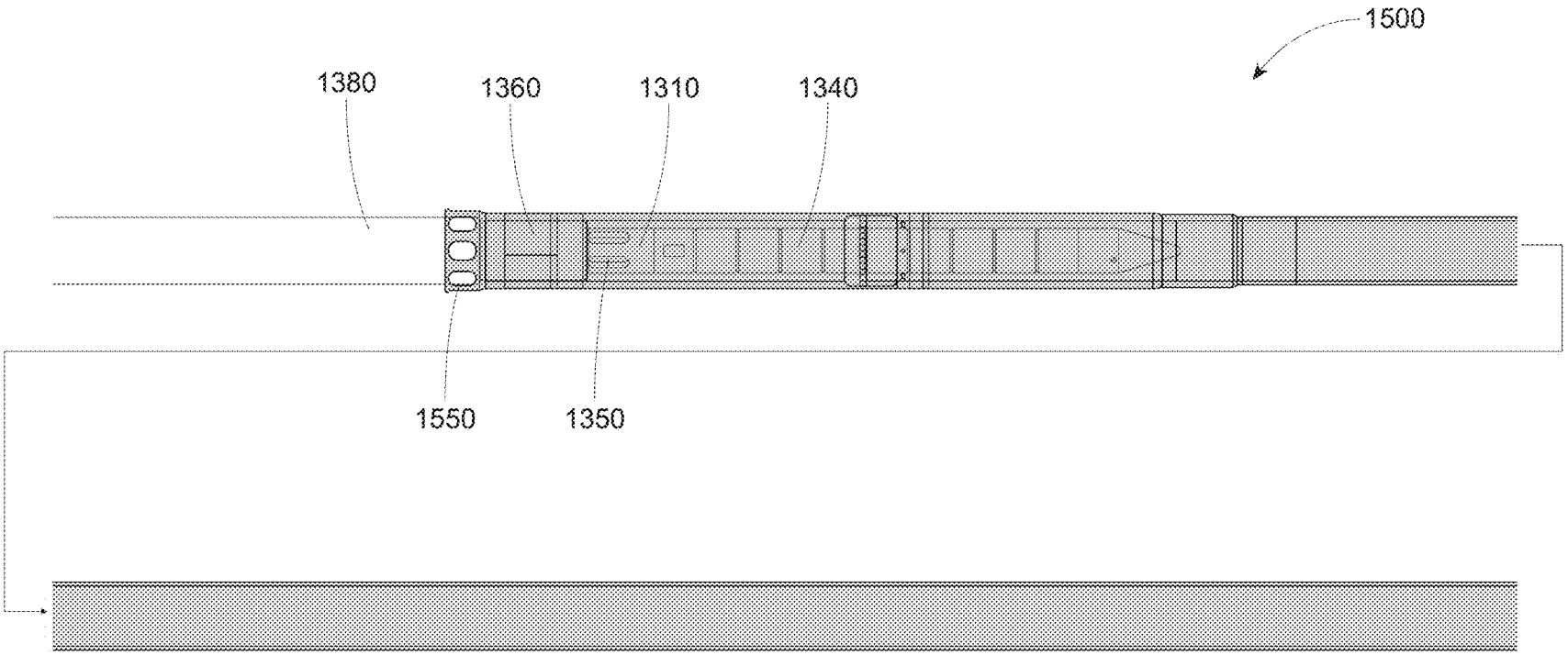
Figure 15C:
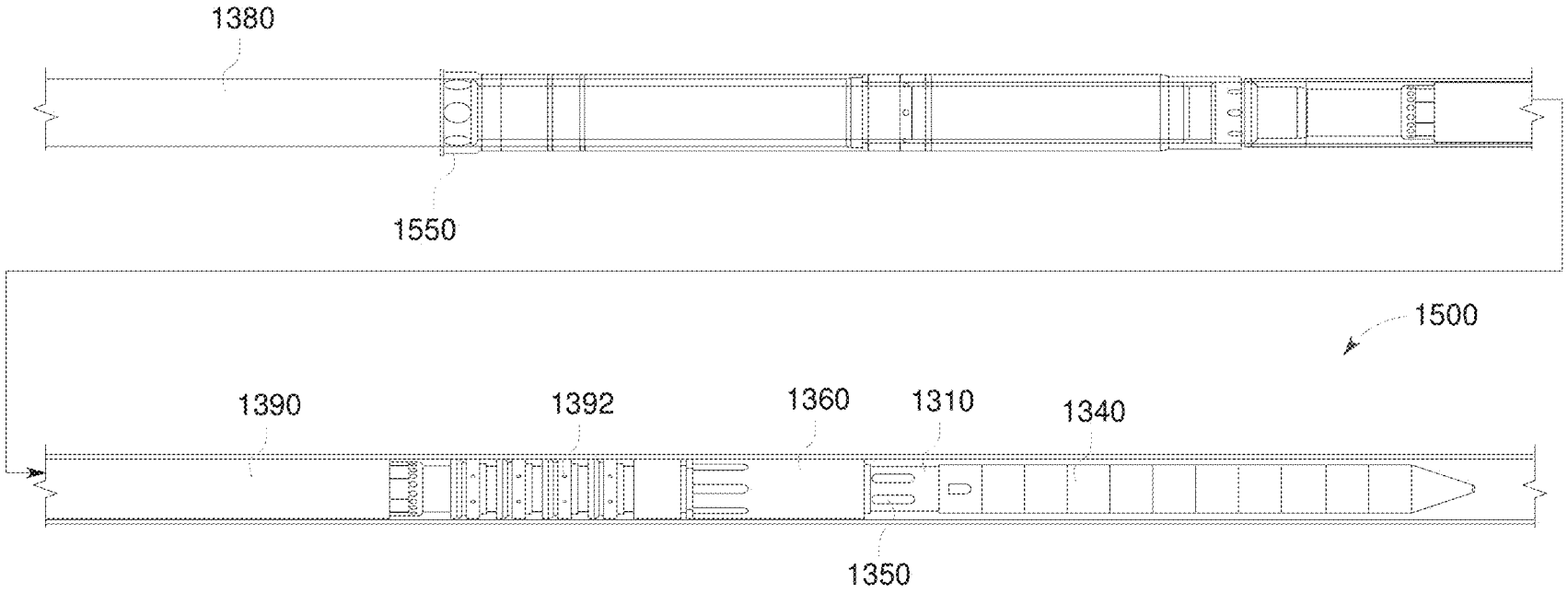

FIGS. 15A through 15C illustrate various different operational views of a lateral locating assembly 1500 engaging with a lateral liner 1550, as might occur when the lateral locating assembly 1500 has entered a lateral wellbore and is proceeding to engage with a lateral completion. The lateral locating assembly 1500 is similar in many respects to the lateral locating assembly 1300 discussed above. Accordingly, like reference numbers have been used to indicate similar, if not identical, features.

FIG. 15A illustrates the lateral locating assembly 1500 as the shroud 1380 is just engaging with the lateral liner 1550. Accordingly, the shroud 1380 is still releasably fixed with the sliding sleeve 1360, and furthermore the sliding sleeve 1360 is in the first position sealing the one or more production ports 1350. FIG. 15B illustrates the lateral locating assembly 1500 as the shroud 1380 can no longer proceed downhole, and the sliding sleeve 1360 has slid to the second position exposing the one or more production ports 1350. At this point, however, the shroud 1380 is still releasably fixed with the sliding sleeve 1360. FIG. 15C illustrates the lateral locating assembly 1500 as the sliding sleeve 1360 has released from the shroud 1380, and furthermore that remaining features of the lateral locating assembly 1500 has continued downhole.

Turning to FIGS. 16A through 16F, illustrated are different schematic views of a lateral locating assembly 1600 traversing through a main wellbore 1650 and a lateral wellbore 1670 in accordance with one or more embodiments of the disclosure. The lateral locating assembly 1600 is similar in many respects to the lateral locating assembly 1300 discussed above. Accordingly, like reference numbers have been used to indicate similar, if not identical, features.

Figure 16A:
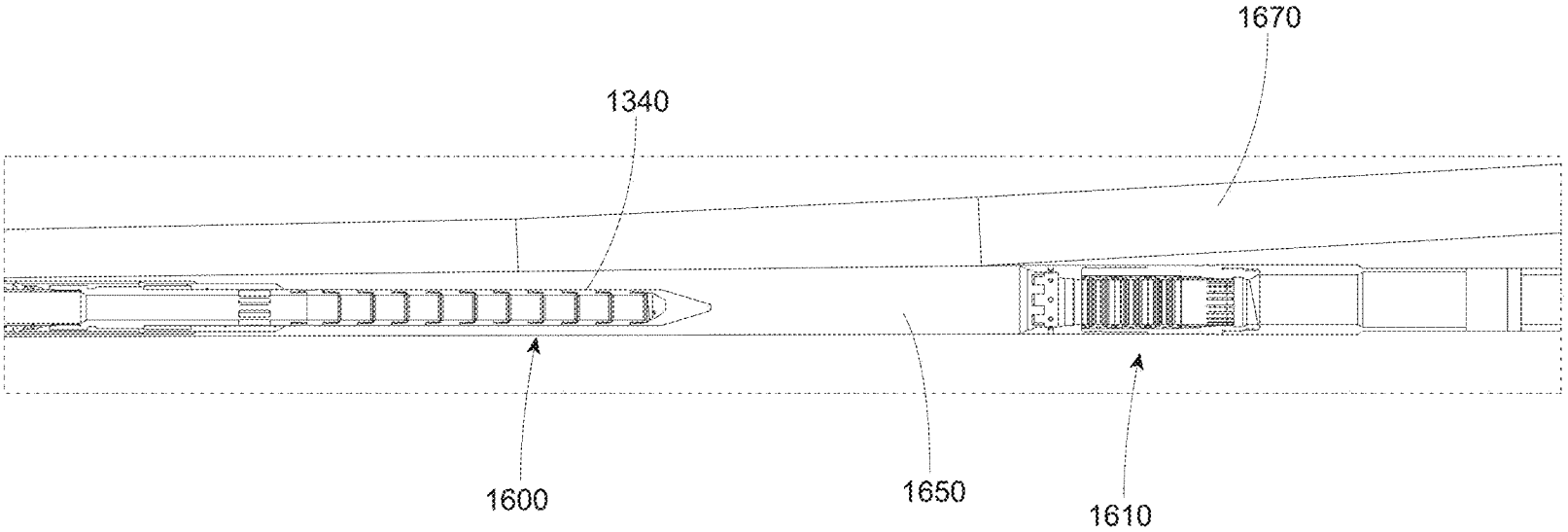
FIGS. 16A through 16F illustrate different schematic views of a lateral locating assembly traversing through a main wellbore and a lateral wellbore in accordance with one or more embodiments of the disclosure.

With initial reference to FIG. 16A, the lateral locating assembly 1600 is located within the main wellbore 1650, and for example approaching a whipstock 1610 (e.g., similar to the detachable whipstock discussed above with regard to FIG. 11E). At this stage, the bendable deflection tip 1340 of the lateral locating assembly 1600 is in the straight position, and is located at an intersection between the main wellbore 1650 and the lateral wellbore 1670.

Figure 16B:
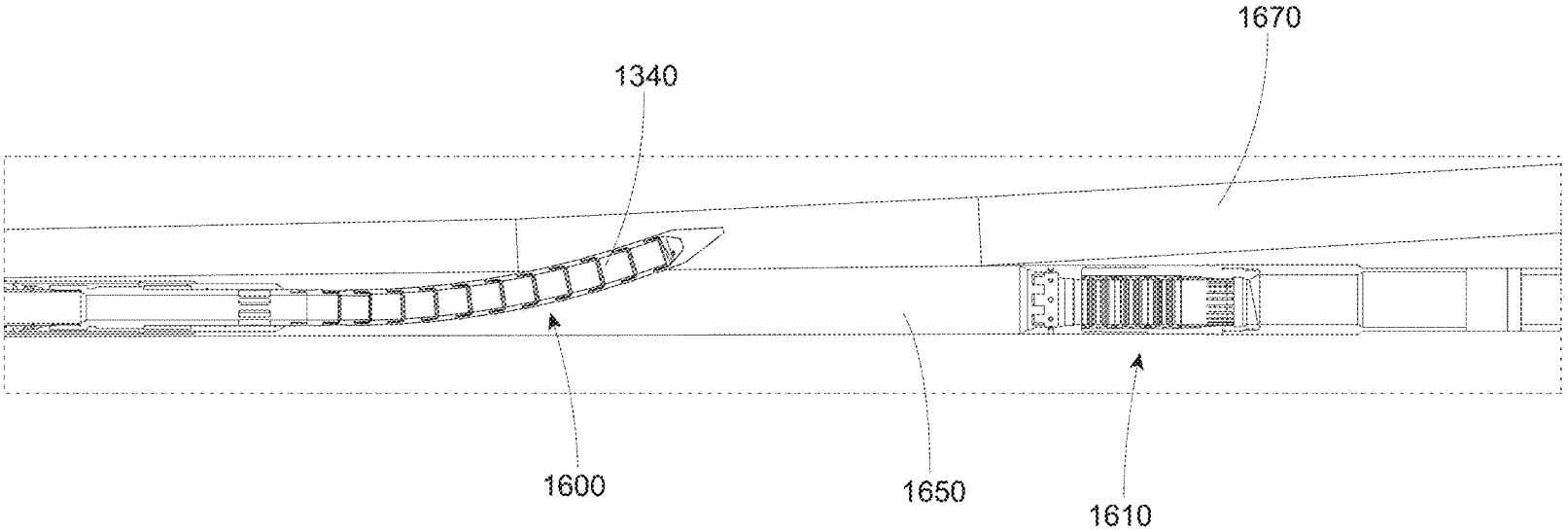

Turning to FIG. 16B, the lateral locating assembly 1600 has been activated (e.g., fluid pressure applied thereto), and thus the bendable deflection tip 1340 of the lateral locating assembly 1600 is now in the bent position. For example, at this point the bendable deflection tip 1340 of the lateral locating assembly 1600 has entered the lateral wellbore 1670, and specifically entered the lateral wellbore 1670 without the need for a deflector, as discussed above.

Figure 16C:
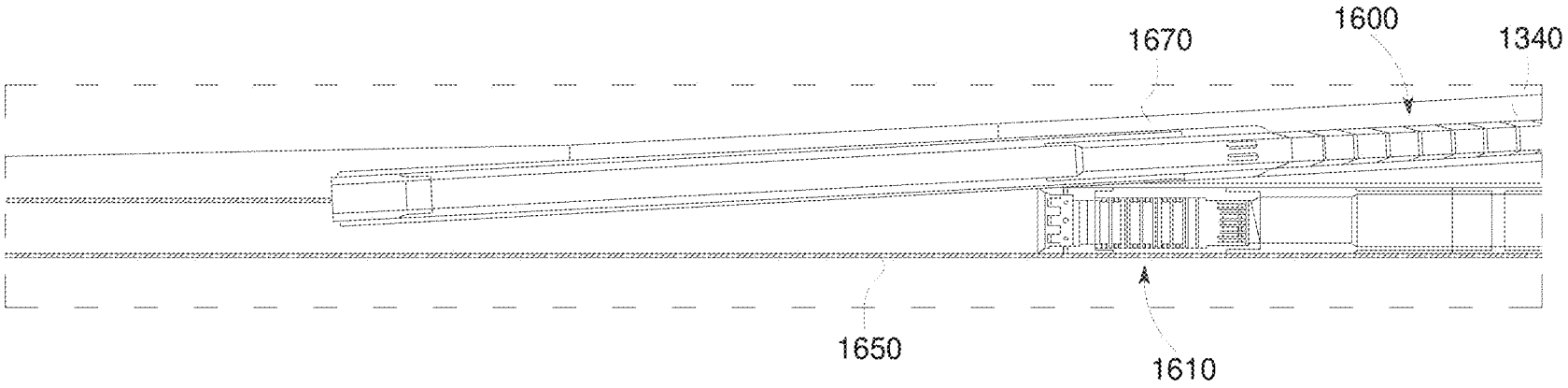

Turning to FIG. 16C, the bendable deflection tip 1340 of the lateral locating assembly 1600 moves back to the straight position, and continues downhole.

Figure 16D:
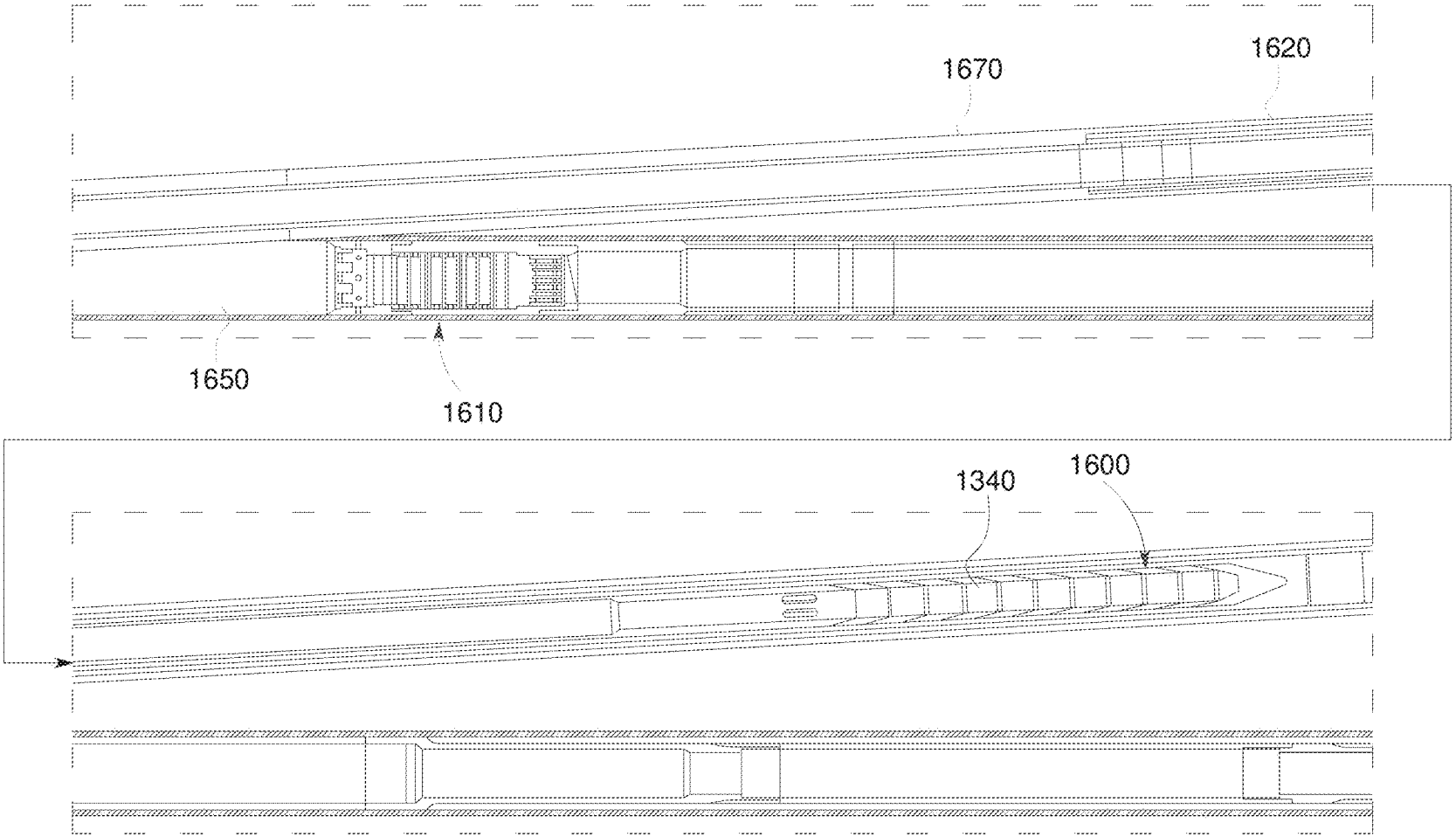

Turning to FIG. 16D, the lateral locating assembly 1600 begins to engage with the lateral liner 1620. Again, the shroud 1380 is too large to pass through the lateral liner 1620.

Figure 16E:
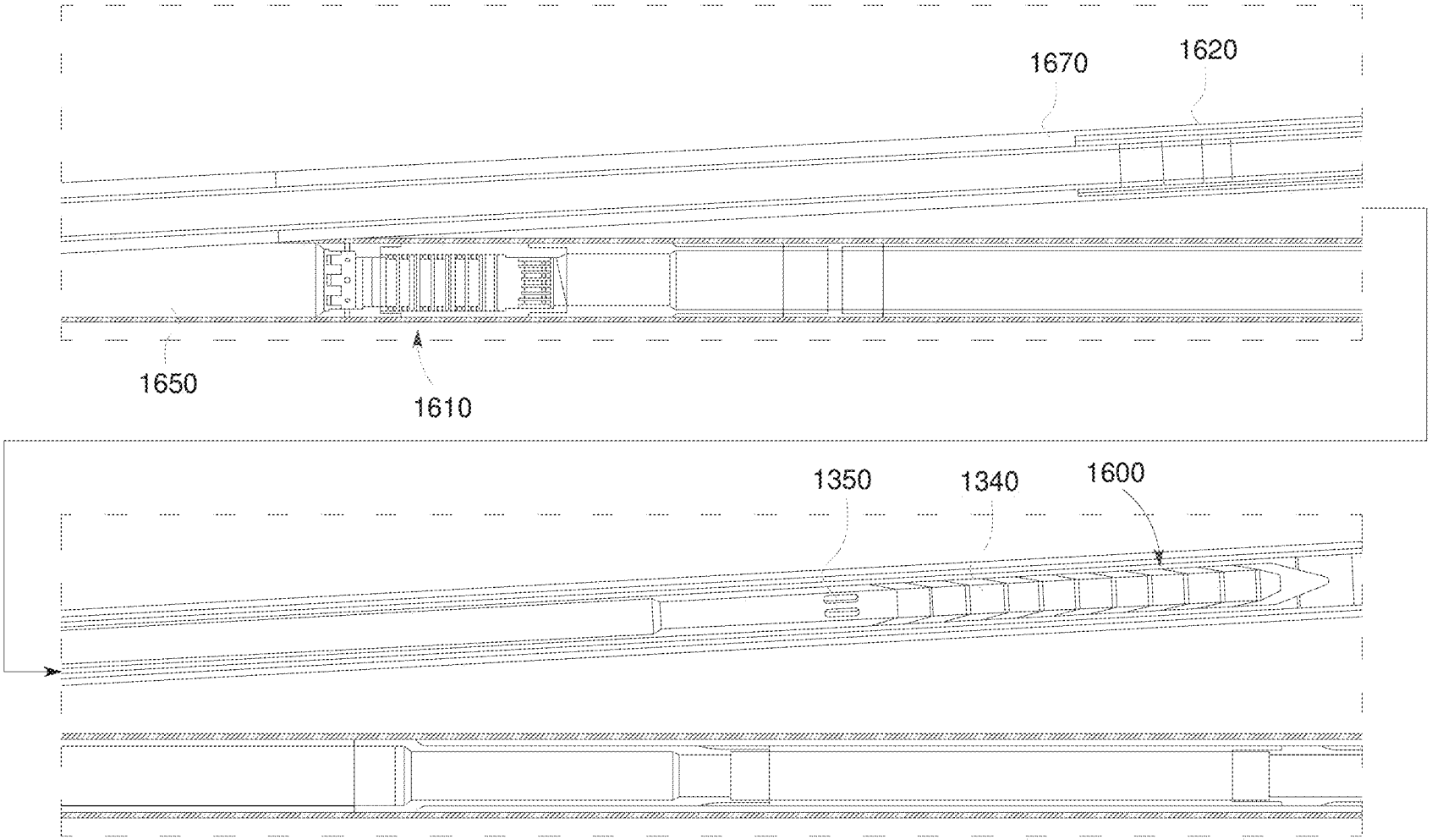

Turning to FIG. 16E, the lateral locating assembly 1600 continues to move downhole, thereby shifting the sliding sleeve 1360 from the first position sealing the one or more production ports 1350 to the second position exposing the one or more production ports 1350.

Figure 16F:
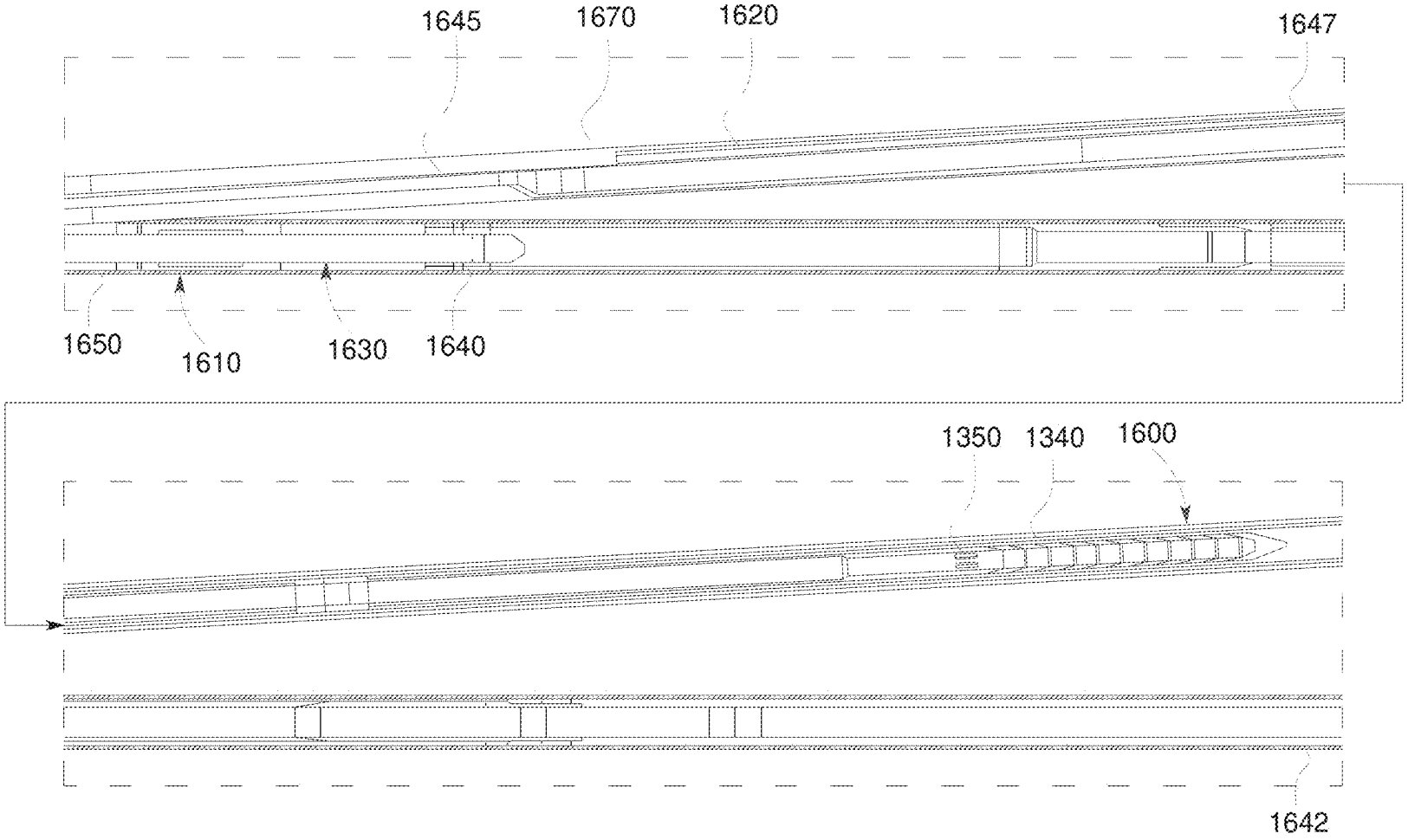

Turning to FIG. 16F, the lateral locating assembly 1600 continues downhole. As the lateral locating assembly 1600 is coupled to a downhole end of a lateral bore leg 1645 of a multilateral junction 1630, the mainbore leg 1640 of the multilateral junction 1630 engages with a mainbore completion 1642, while the lateral bore leg 1645 of the multilateral junction 1630 engages with a lateral bore completion 1647. At this stage, hydrocarbons may be produced through the exposed one or more production ports 1350 when the lateral locating assembly 1600 is properly placed within the lateral bore completion 1647.

Turning to FIGS. 17A through 17D, illustrated are different operational views of a multilateral junction 1700 designed, manufactured and/or operated according to one or more embodiments of the disclosure. The multilateral junction 1700, in the illustrated embodiment, includes a y-block 1710. The y-block, in one or more embodiments, includes a housing 1715 having a first end and a second opposing end, a single first bore extending into the housing 1715 from the first end, the single first bore defining a first centerline, and second and third separate bores extending into the housing 1715 and branching off from the single first bore, the second bore defining a second centerline and the third bore defining a third centerline. In the illustrated embodiment, a mainbore leg 1720 has a first mainbore leg end and a second opposing mainbore leg end, wherein the first mainbore leg end is coupled to the second bore. In the illustrated embodiment, a lateral bore leg 1730 has a first lateral bore leg end and a second opposing lateral bore leg end, wherein the first lateral bore leg end is coupled to the third bore.

As shown in the embodiment of FIGS. 17A through 17D, a lateral locating assembly 1740 is coupled to the second opposing lateral bore leg end. The lateral locating assembly 1740 is similar in many respects to the lateral locating assembly 1300 discussed above. Accordingly, like reference numbers may be used to indicate similar, if not identical, features. In the illustrated embodiment, the lateral locating assembly 1740 includes: 1) a tubular; and 2) a bendable deflection tip coupled to the tubular, the bendable deflection tip configured to move between a straight position and a bent position upon the application of fluid pressure thereto.

Figure 17A:
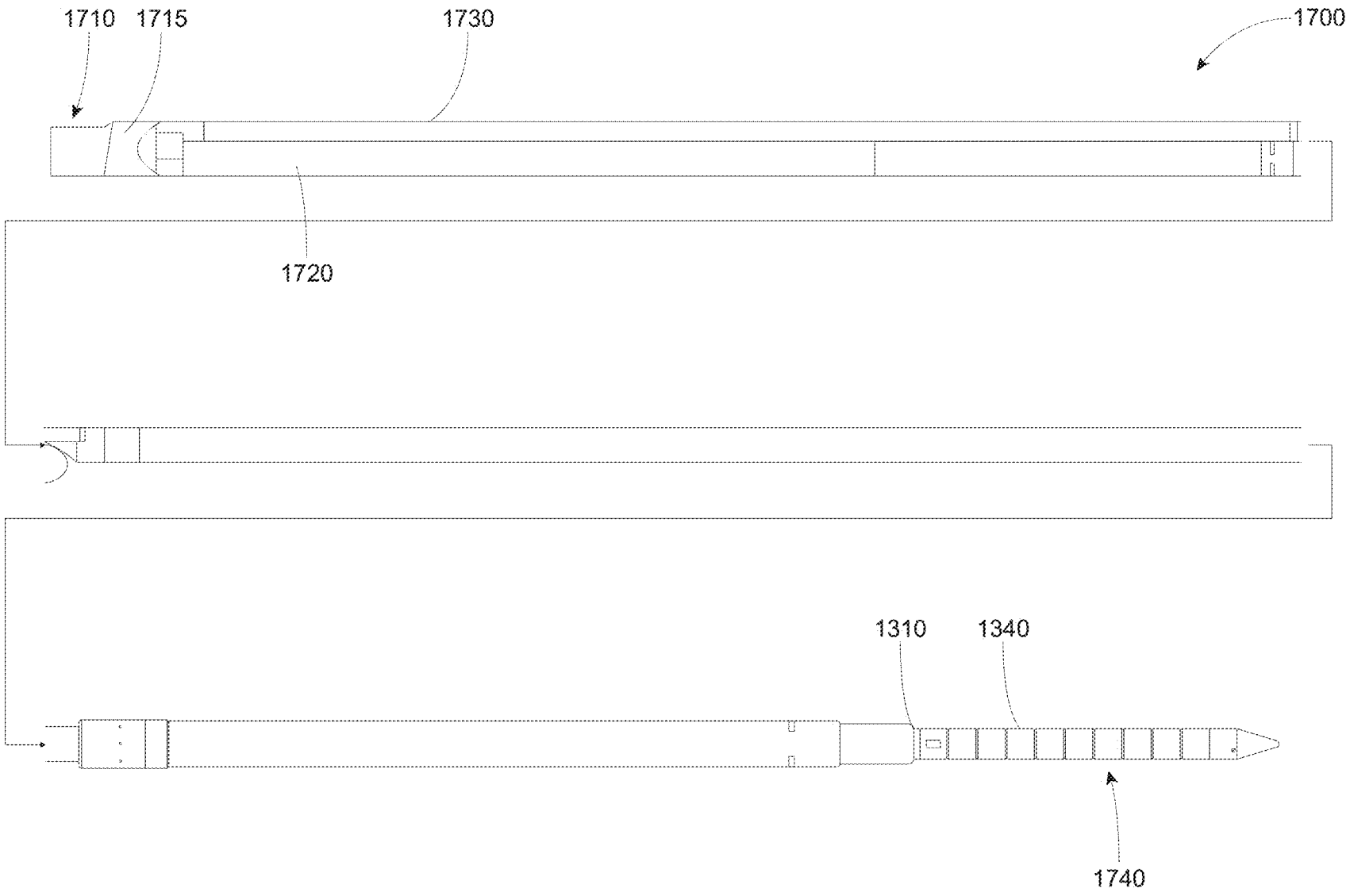
FIGS. 17A through 17D illustrate different operational views of a multilateral junction designed, manufactured and/or operated according to one or more embodiments of the disclosure.
Figure 17B:
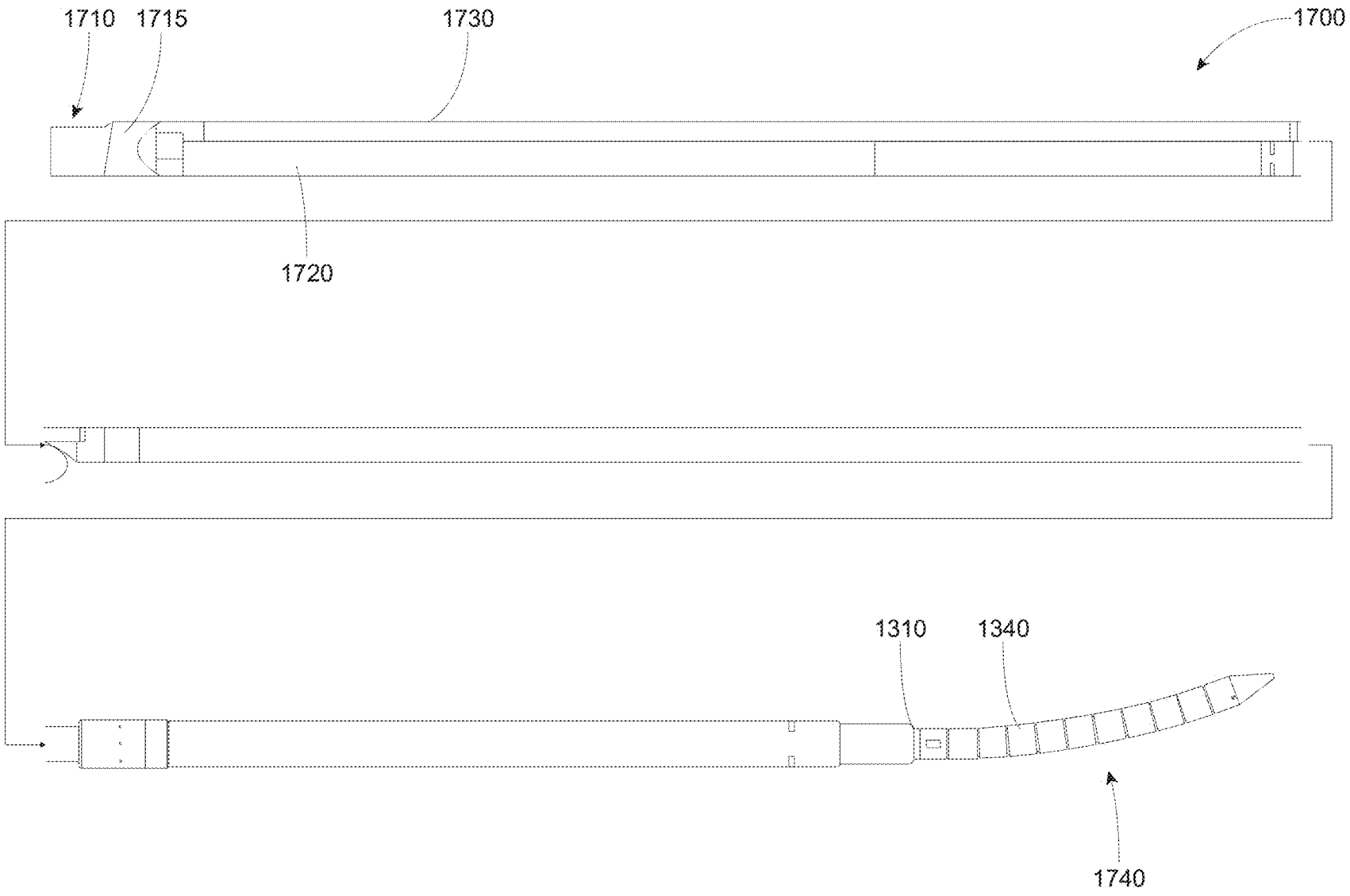
Figure 17C:
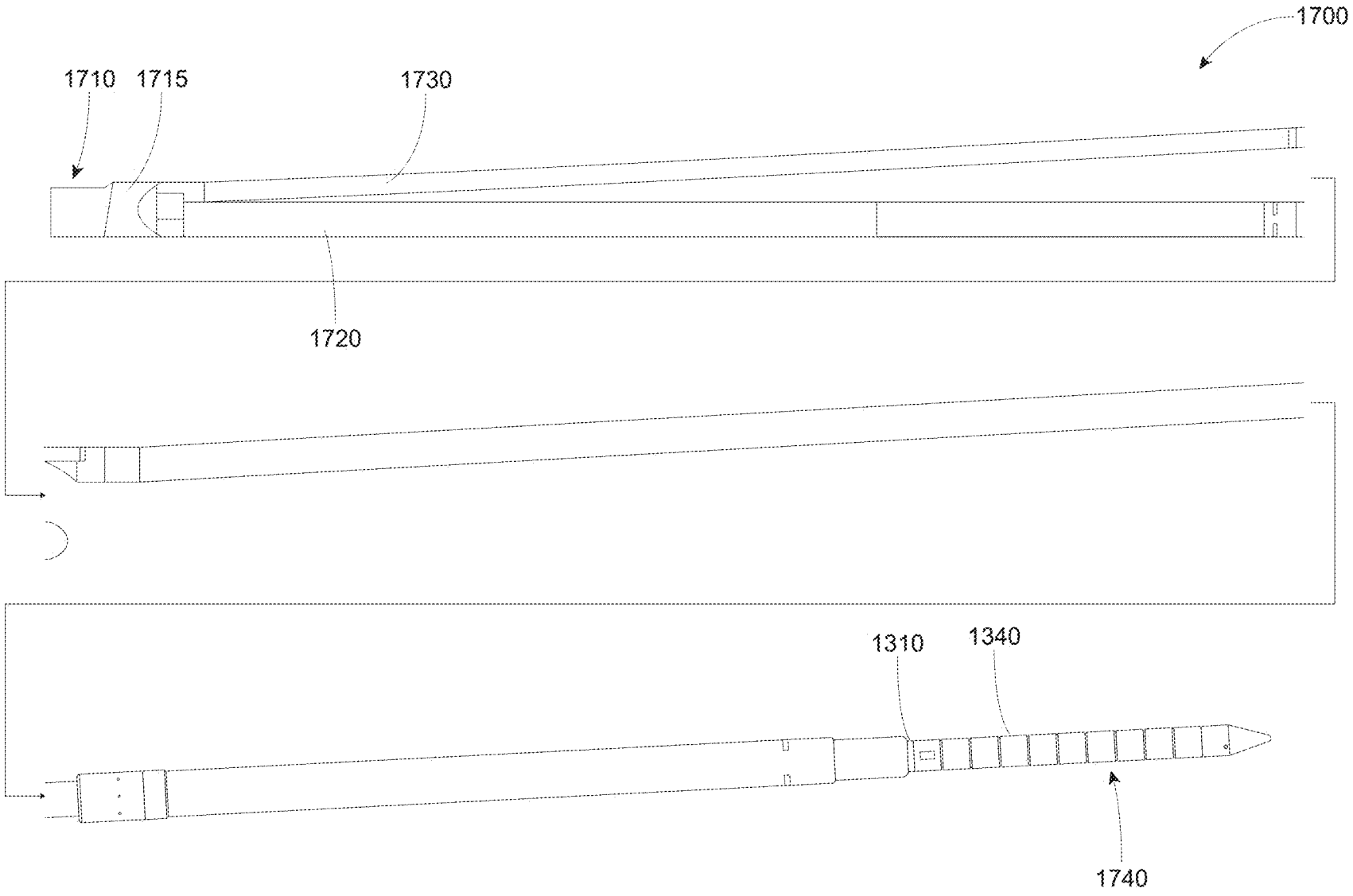
Figure 17D:
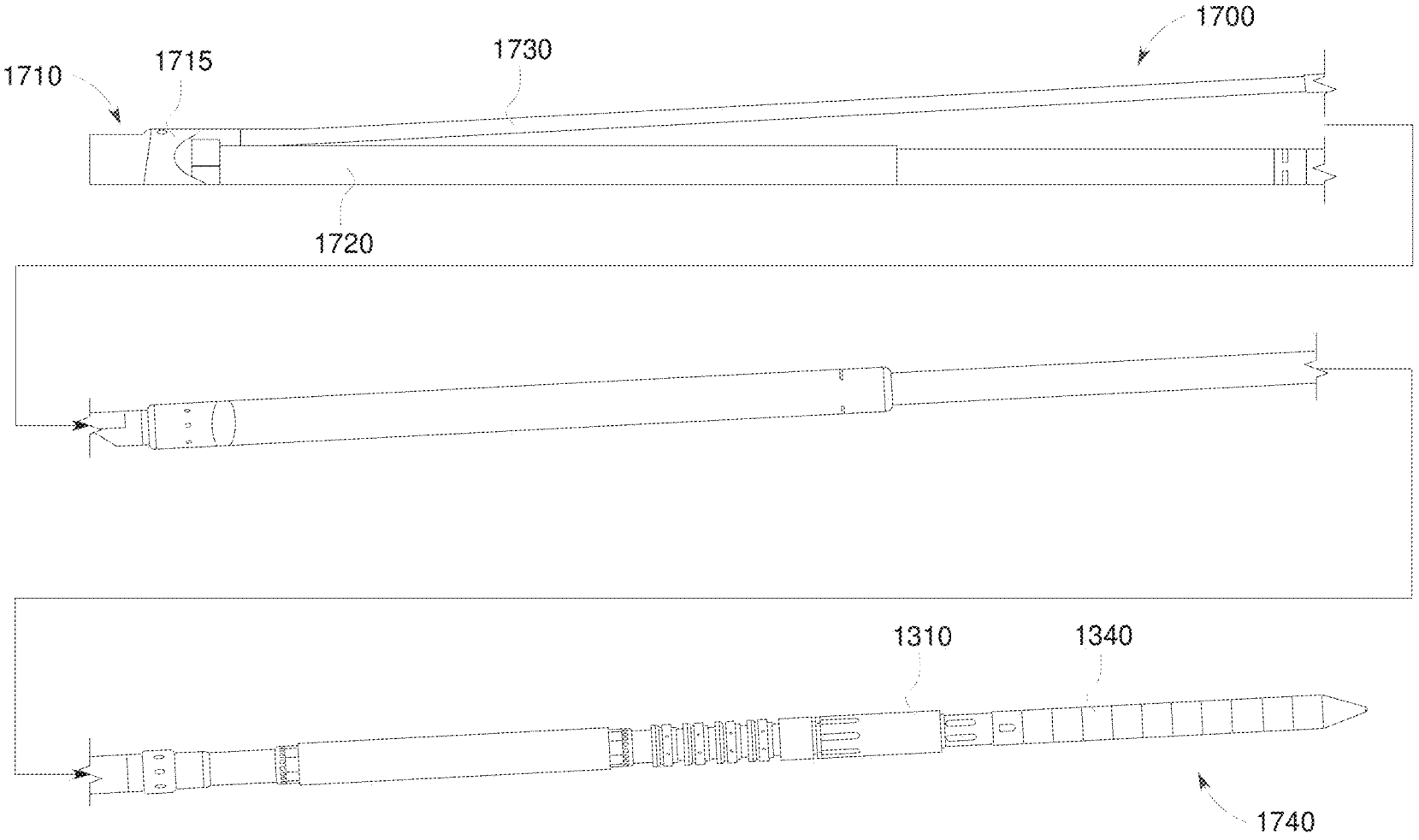

FIG. 17A illustrates the lateral locating assembly 1740 in the run-in-hole position. FIG. 17B illustrates the lateral locating assembly 1740 with its bendable deflection tip in the bent position. FIG. 17C illustrates the lateral locating assembly 1740 with its bendable deflection tip back in the straight position, but as it might look when the lateral bore leg 1730 has entered the lateral wellbore. FIG. 17D illustrates the lateral locating assembly 1740 with its sliding sleeve in the second position, thereby exposing the one or more production ports.

Figure 18:
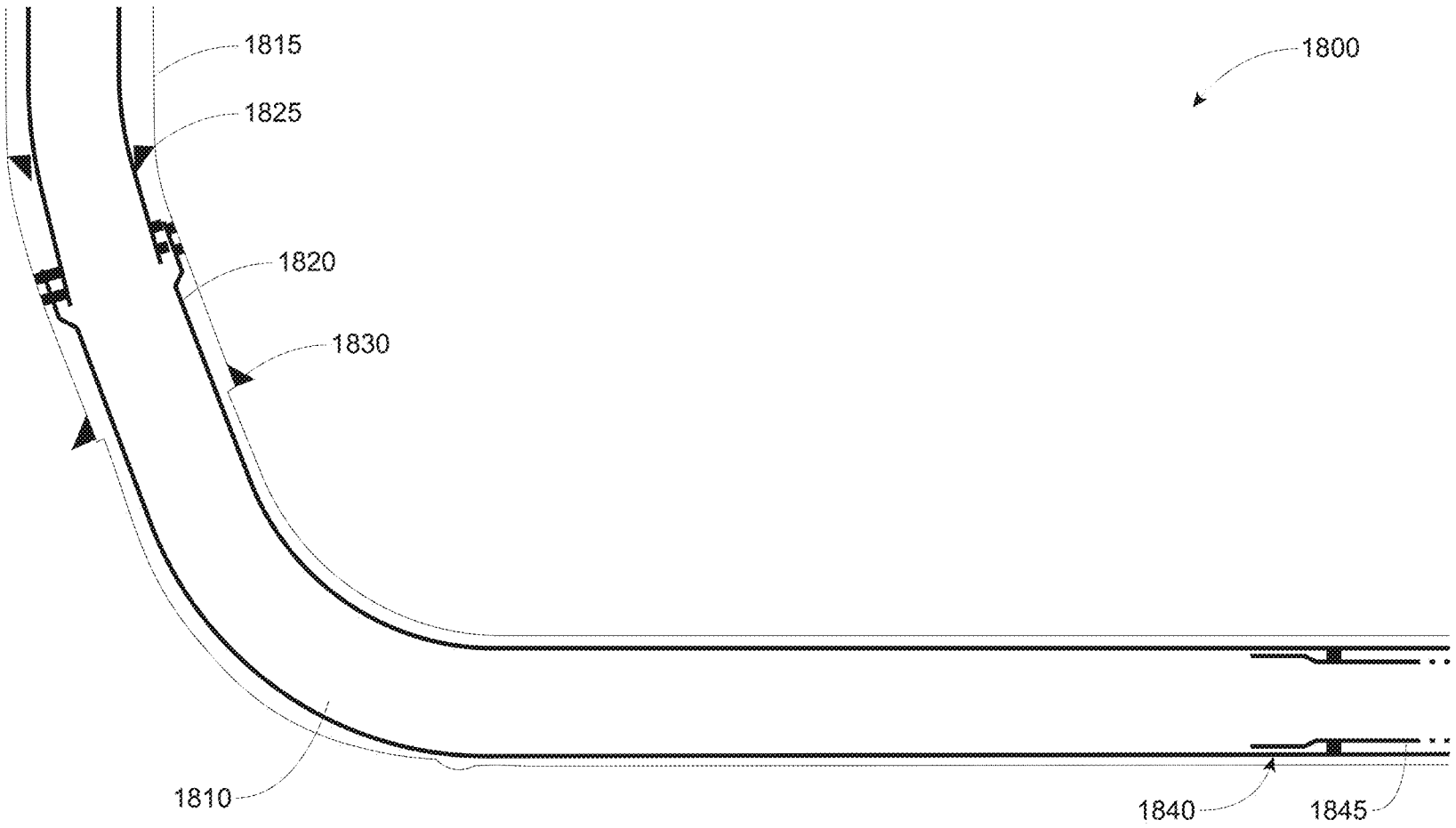
FIGS. 18 through 33 illustrate a method for forming, accessing, and completing a well system in accordance with one or more embodiments of the disclosure.

Turning now to FIGS. 18 through 33, illustrated is a method for forming, accessing, and completing a well system 1800 in accordance with one or more embodiments of the disclosure. FIG. 18 is a schematic of the well system 1800 at the initial stages of formation. A main wellbore 1810 may be drilled, for example by a rotary steerable system at the end of a drill string and may extend from a well origin (not shown), such as the earth's surface or a sea bottom. The main wellbore 1810 may be lined by one or more casings 1815, 1820, each of which may be terminated by a shoe 1825, 1830.

The well system 1800 of FIG. 18 may additionally include a main wellbore completion 1840 positioned in the main wellbore 1810. The main wellbore completion 1840 may, in certain embodiments, include a main wellbore liner 1845 (e.g., with frac sleeves in one embodiment), as well as one or more packers (e.g., swell packers in one embodiment).

Figure 19:
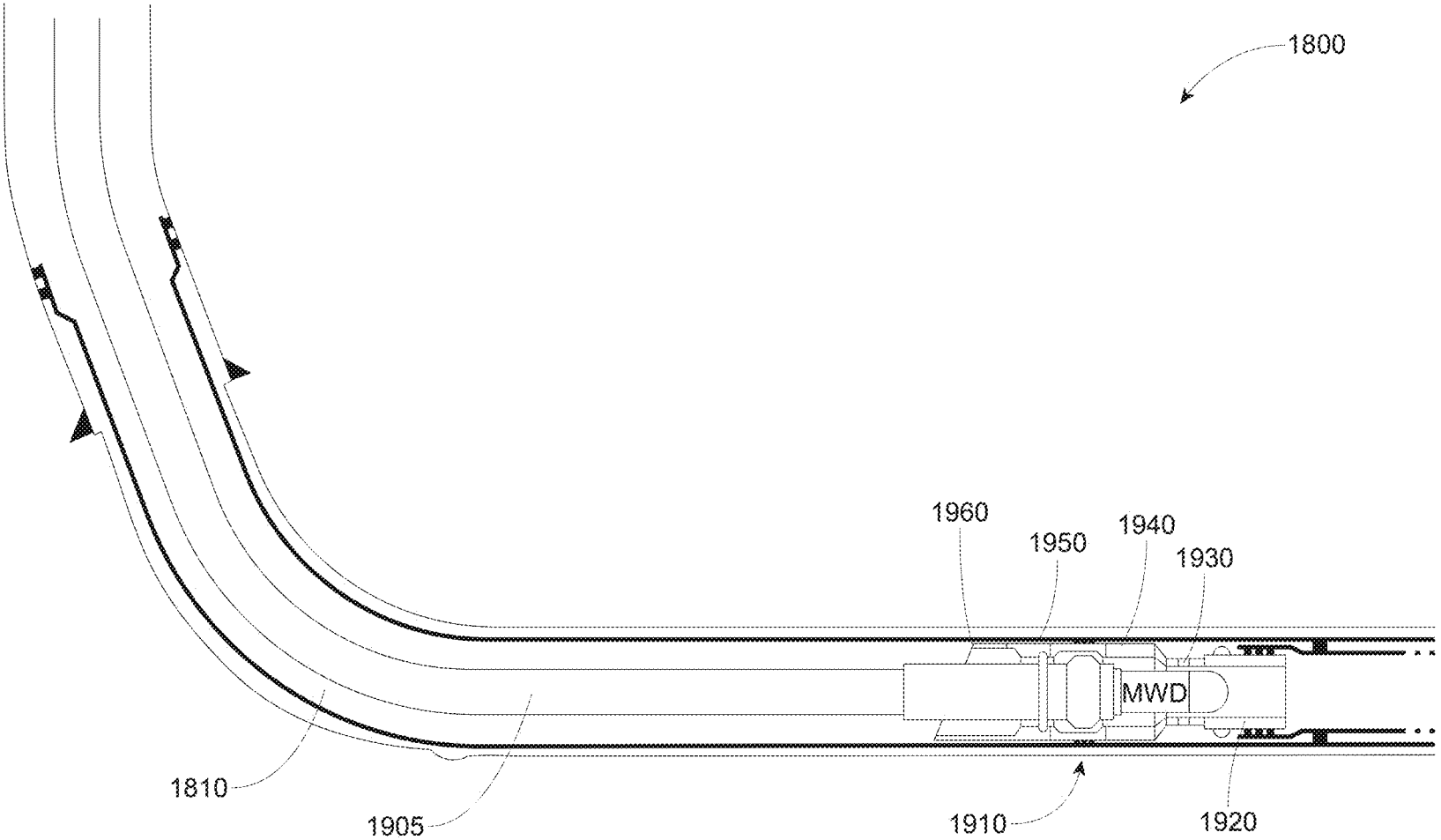

Turning to FIG. 19, illustrated is the well system 1800 of FIG. 18 after installing a multilateral anchor 1910 in the main wellbore 1810 using a running tool 1905. The multilateral anchor 1910 may include a stinger with seals 1920, a perf joint 1930, a seal bore 1940, a collet profile 1950 and a slotted alignment muleshoe 1960, among other features.

Figure 20:
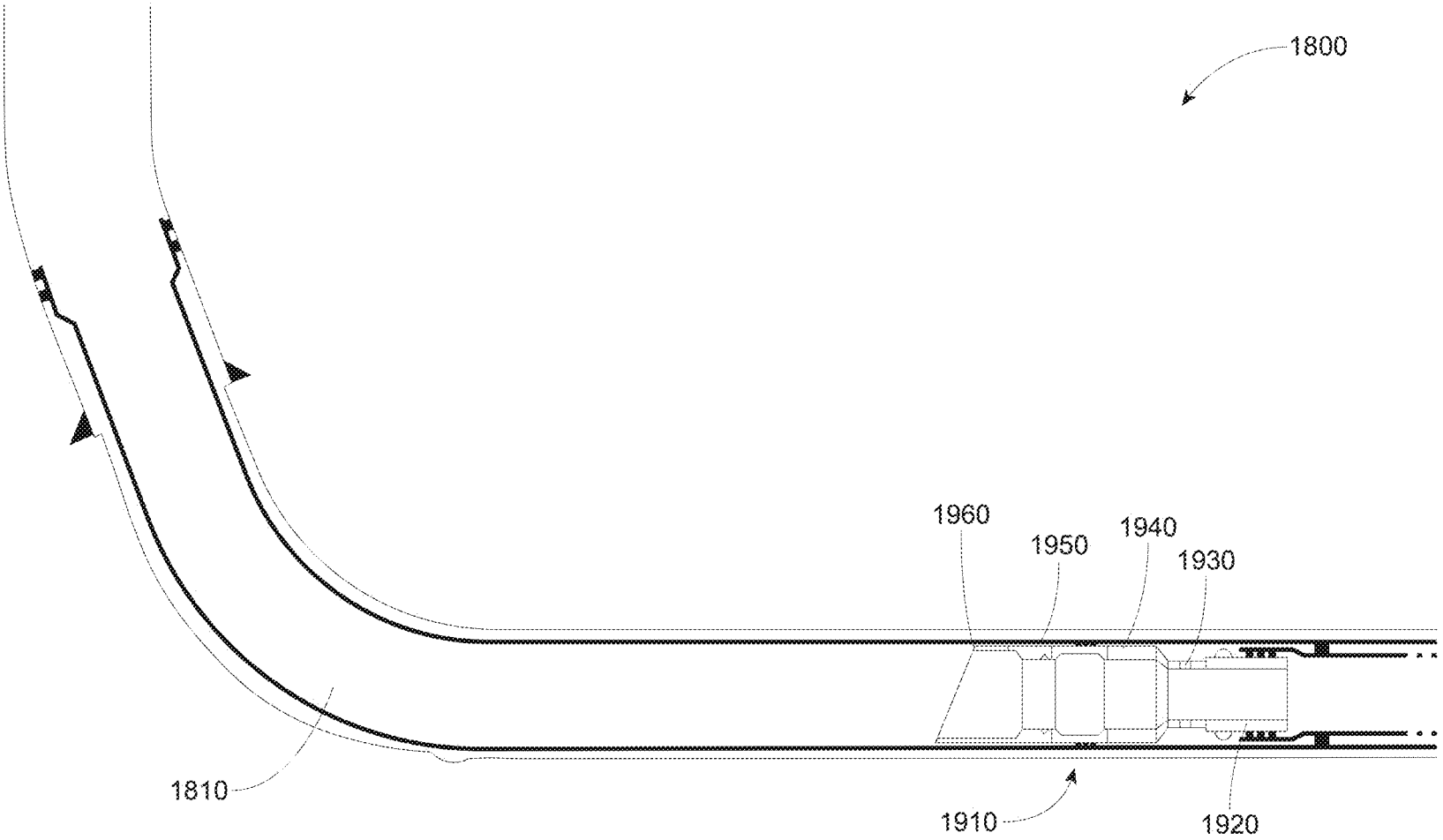

Turning to FIG. 20, illustrated is the well system 1800 of FIG. 19 after removing the running tool 1905.

Figure 21:
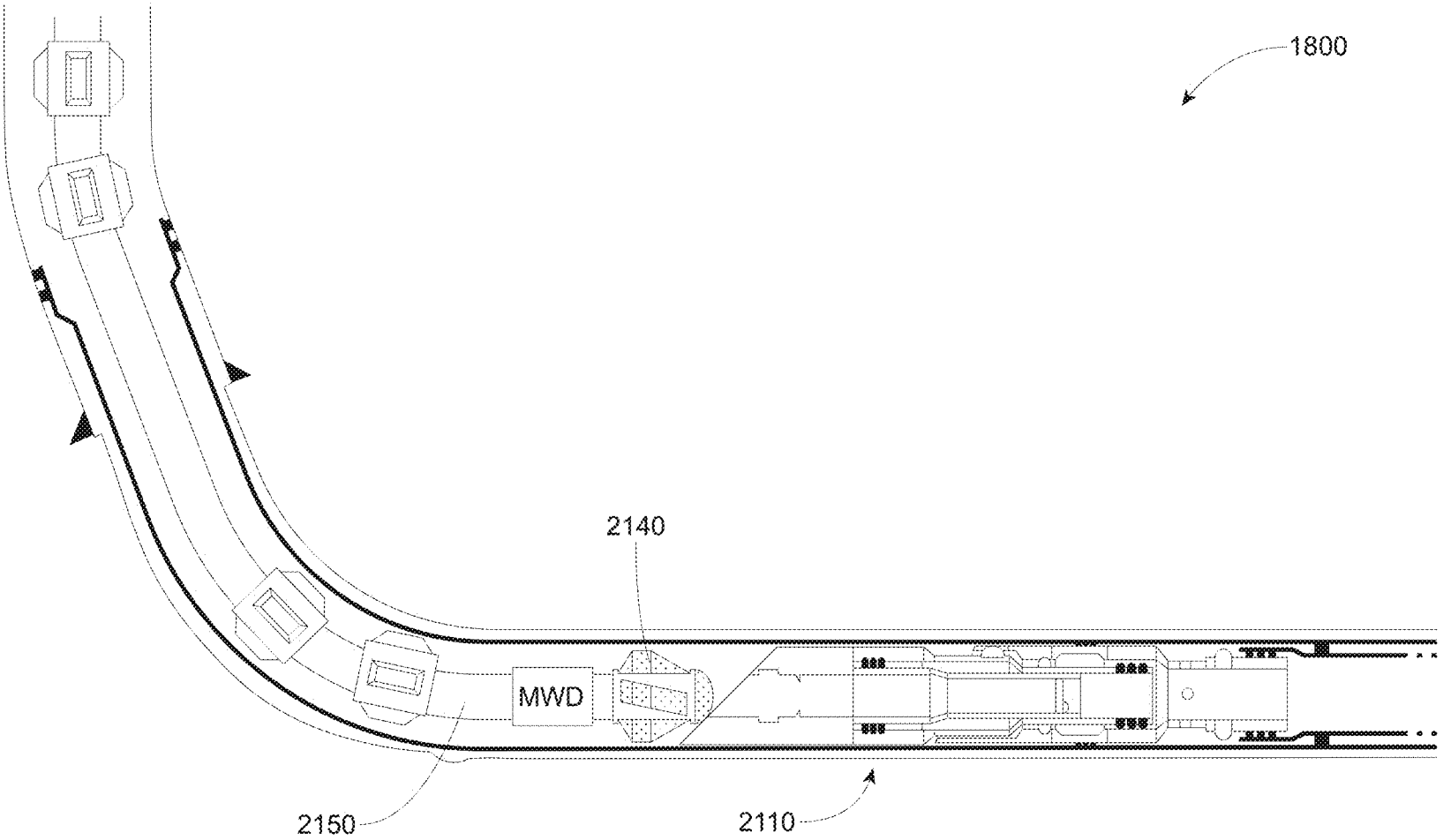

Turning to FIG. 21, illustrated is the well system 1800 of FIG. 20 after positioning a whipstock 2110 downhole at a location where a lateral wellbore is to be formed. The whipstock 2110, in at least one embodiment, is similar to the whipstock 900 discussed above, and thus may include: 1) a whipface having an angled casing string exit surface; 2) a sub detachably coupled to the whipface; and 3) a bottom hole assembly fixedly coupled to the sub, the bottom hole assembly having one or more seals along an inner surface thereof.

In certain embodiments, such as that shown in FIG. 21, the whipstock 2110 is made up with a lead mill bit 2140, for example using a shear bolt, and then run in hole on a drill string 2150. The lead mill bit 2140 and the whipstock 2110 may comprise one or more of the mill bits and/or whipstocks discussed in the paragraphs above. The WOT/MWD tool may be employed to orient the whipstock 2110.

Figure 22:
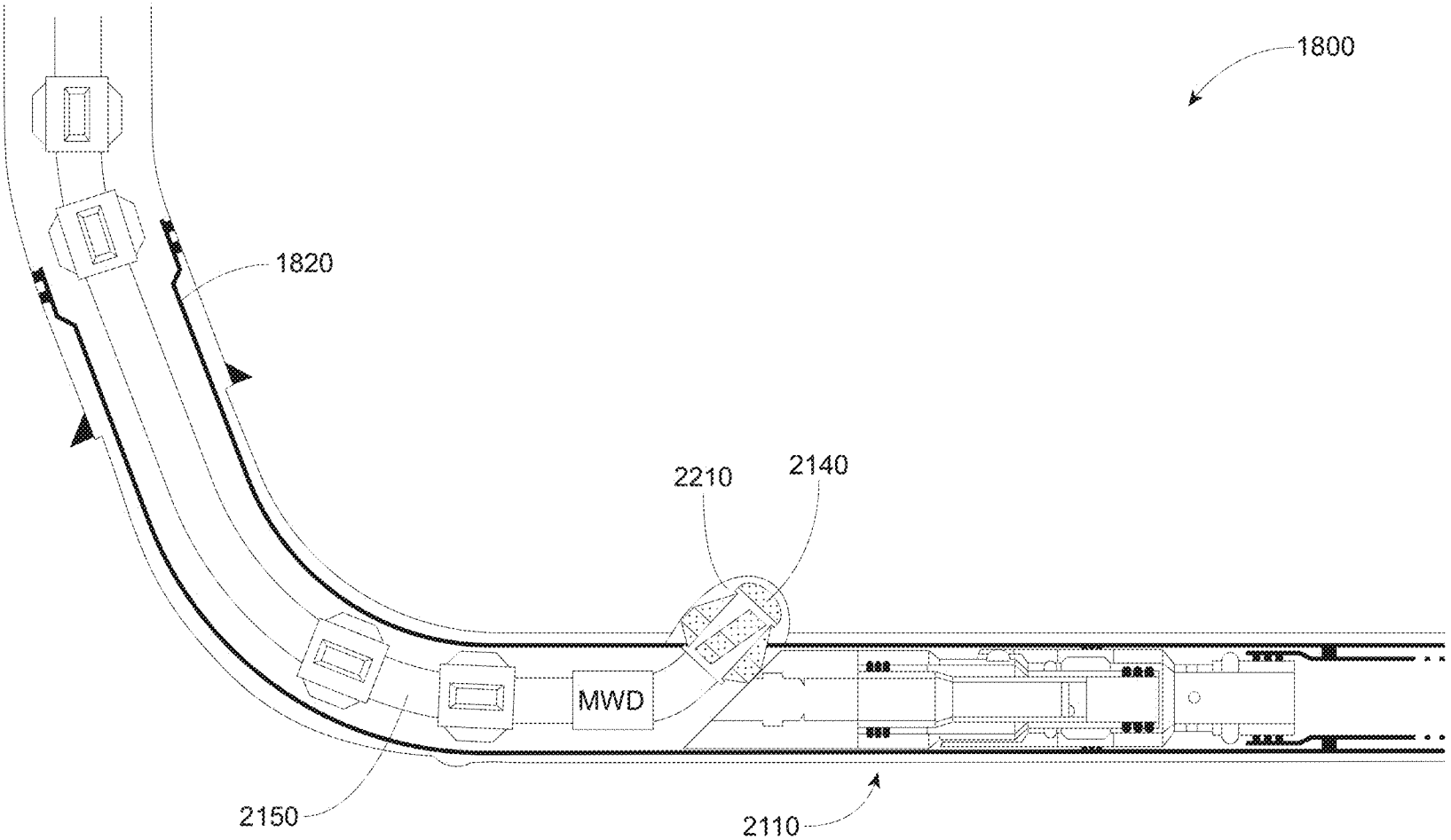

Turning to FIG. 22, illustrated is the well system 1800 of FIG. 21 after setting down weight to shear the shear bolt between the lead mill bit 2140 and the whipstock 2110, and then milling an initial window pocket 2210. In certain embodiments, the initial window pocket 2210 is between 1.5 m and 7.0 m long, and in certain other embodiments about 2.5 m long, and extends through the casing 1820. Thereafter, a circulate and clean process could occur, and then the drill string 2150 and lead mill 2140 may be pulled out of hole.

Figure 23:
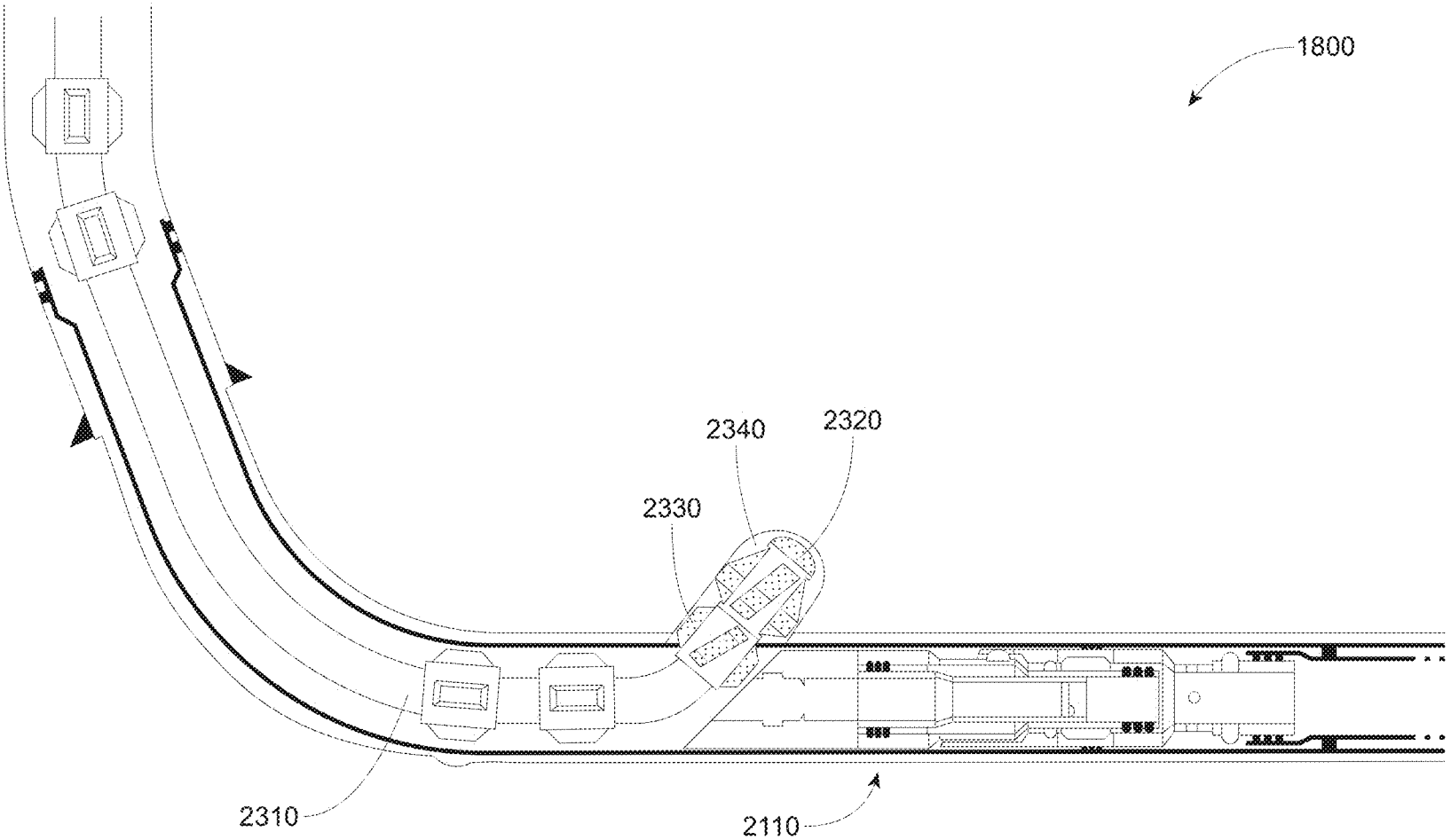

Turning to FIG. 23, illustrated is the well system 1800 of FIG. 22 after running a lead mill bit 2320 and watermelon mill bit 2330 downhole on a drill string 2310. In the embodiments shown in FIG. 23, the drill string 2310, lead mill bit 2320 and watermelon mill bit 2330 drill a full window pocket 2340 in the formation. In certain embodiments, the full window pocket 2340 is between 5 m and 10 m long, and in certain other embodiments about 8.5 m long. Thereafter, a circulate and clean process could occur, and then the drill string 2310, lead mill bit 2320 and watermelon mill bit 2330 may be pulled out of hole.

Figure 24:
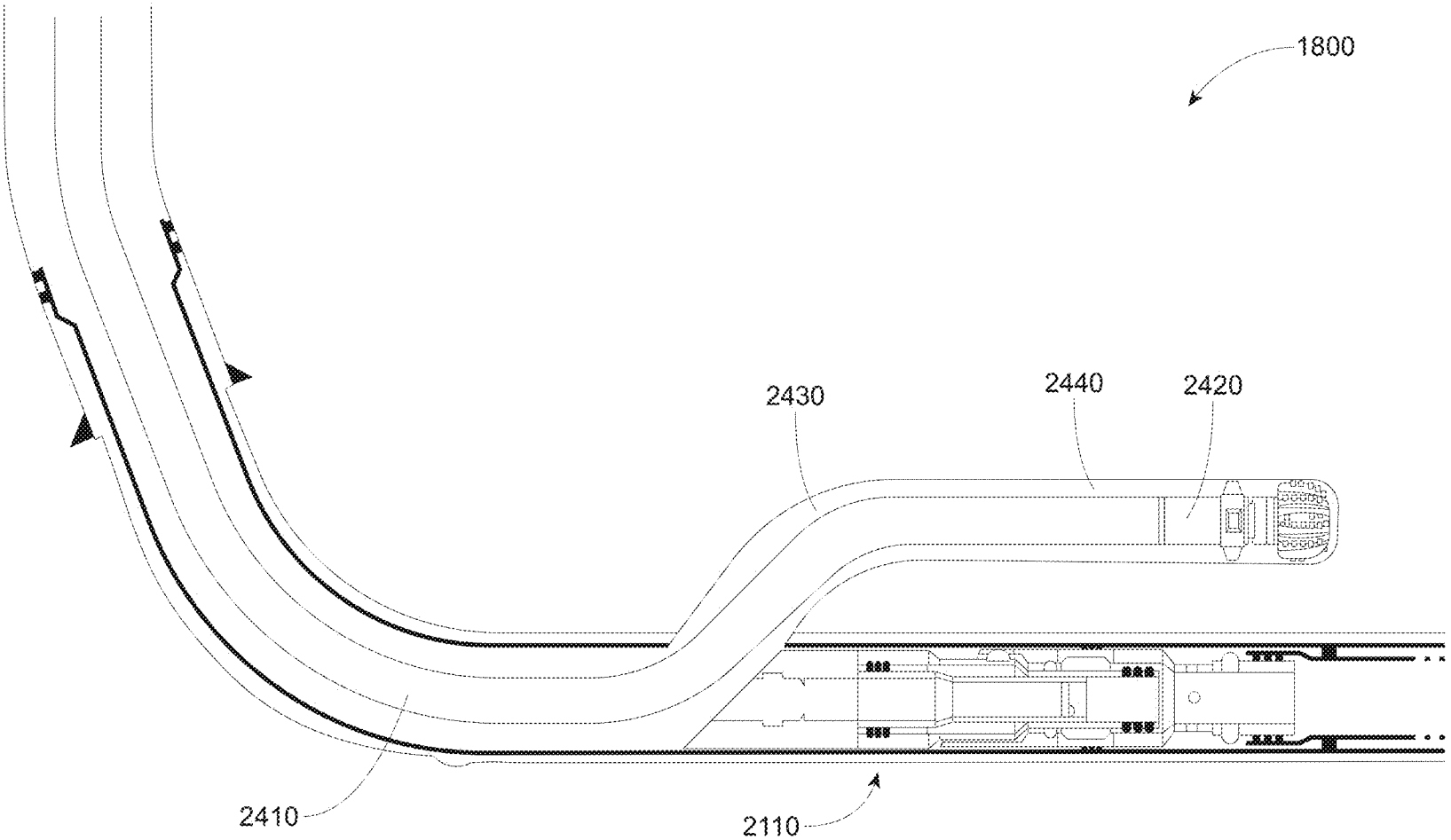

Turning to FIG. 24, illustrated is the well system 1800 of FIG. 23 after running in hole a drill string 2410 with a rotary steerable assembly 2420, drilling a tangent 2430 following an inclination of the whipstock 2110, and then continuing to drill the lateral wellbore 2440 to depth. Thereafter, the drill string 2410 and rotary steerable assembly 2420 may be pulled out of hole.

Figure 25:
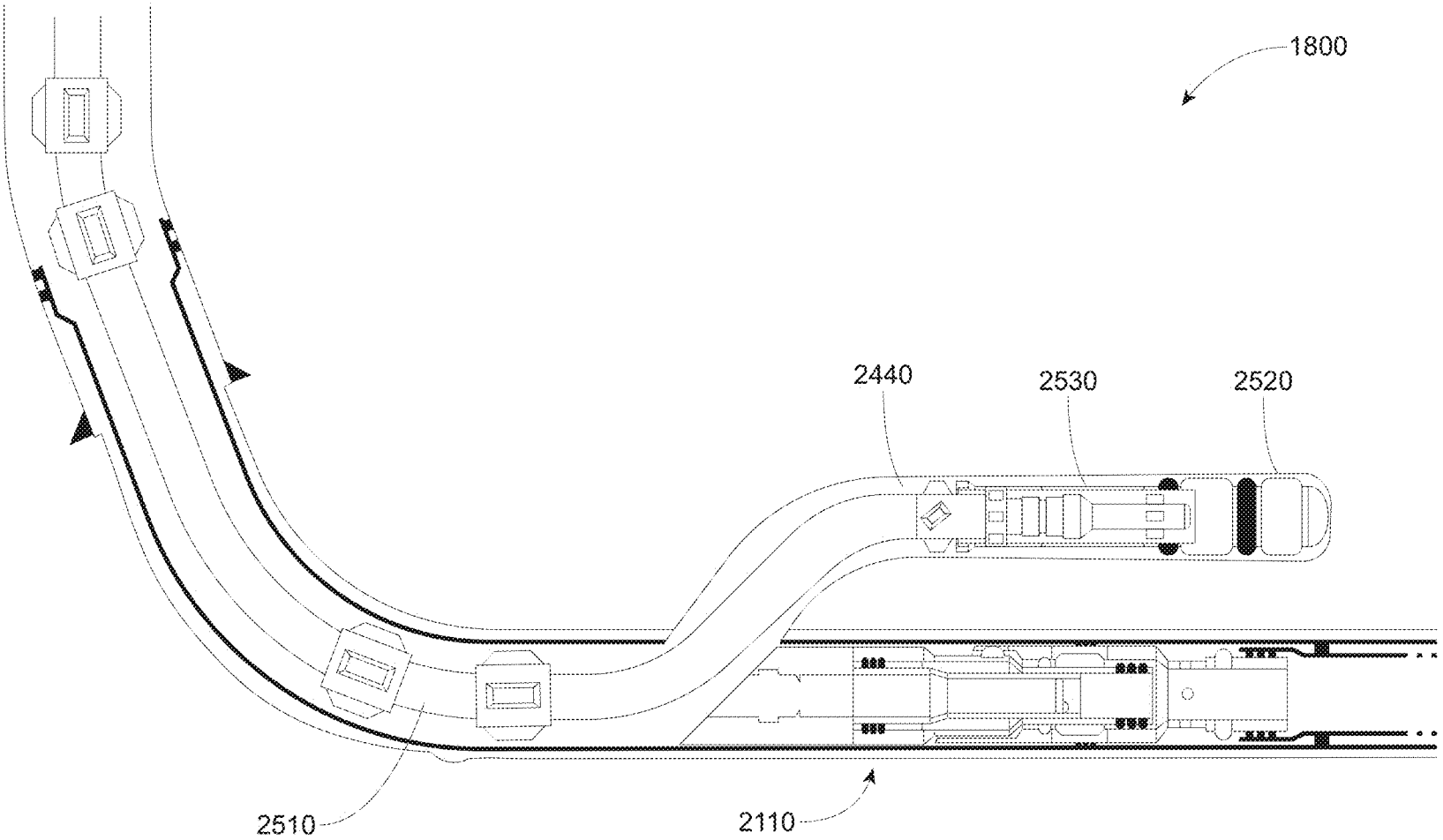

Turning to FIG. 25, illustrated is the well system 1800 of FIG. 24 after employing an inner string 2510 to position a lateral wellbore completion 2520 in the lateral wellbore 2440. The lateral wellbore completion 2520 may, in certain embodiments, include a lateral wellbore liner 2530 (e.g., with frac sleeves in one embodiment), as well as one or more packers.

Figure 26:
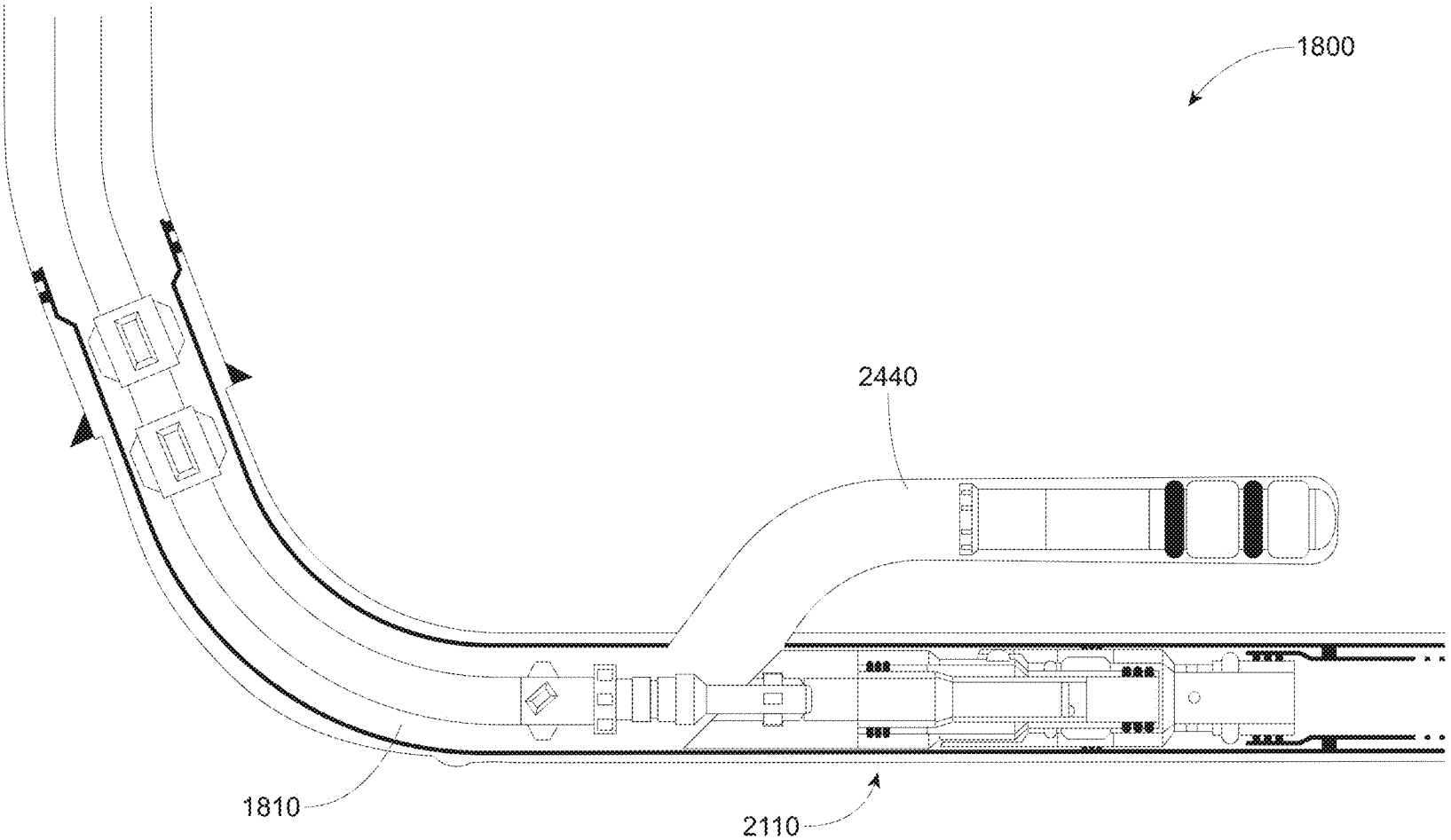

Turning to FIG. 26, illustrated is the well system 1800 of FIG. 25 after pulling the inner string 2510 back into the main wellbore 1810, and engaging with the whipstock 2110. While this is shown as a single trip, other embodiments may exist wherein two or more separate trips are desired.

Figure 27:
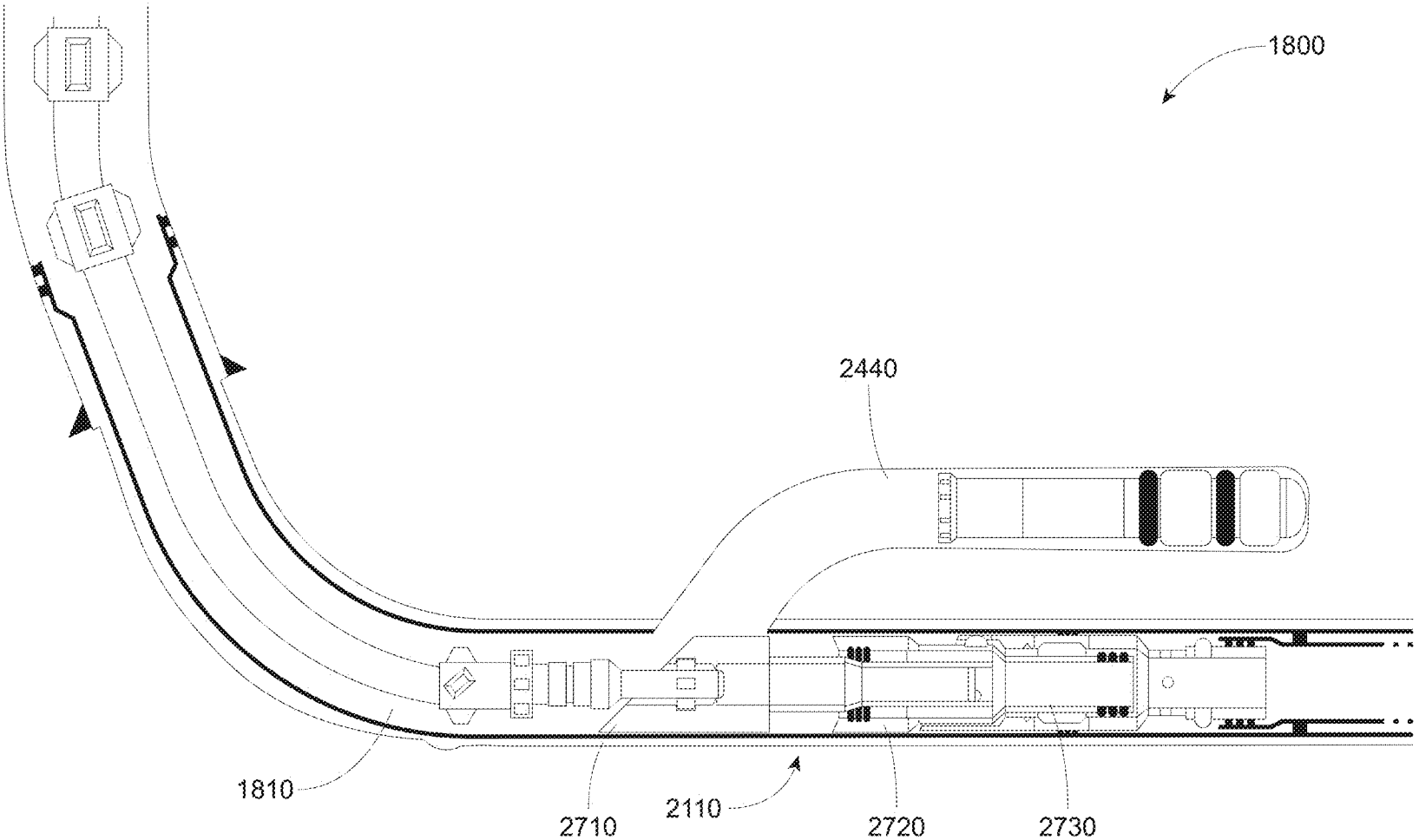

Turning to FIG. 27, illustrated is the well system 1800 of FIG. 26 after detaching the whipface 2710 of the whipstock 2110 from the sub 2720 and bottom hole assembly 2730. This process may be similar to that disclosed above with regard to FIGS. 11A through 11E.

Figure 28:
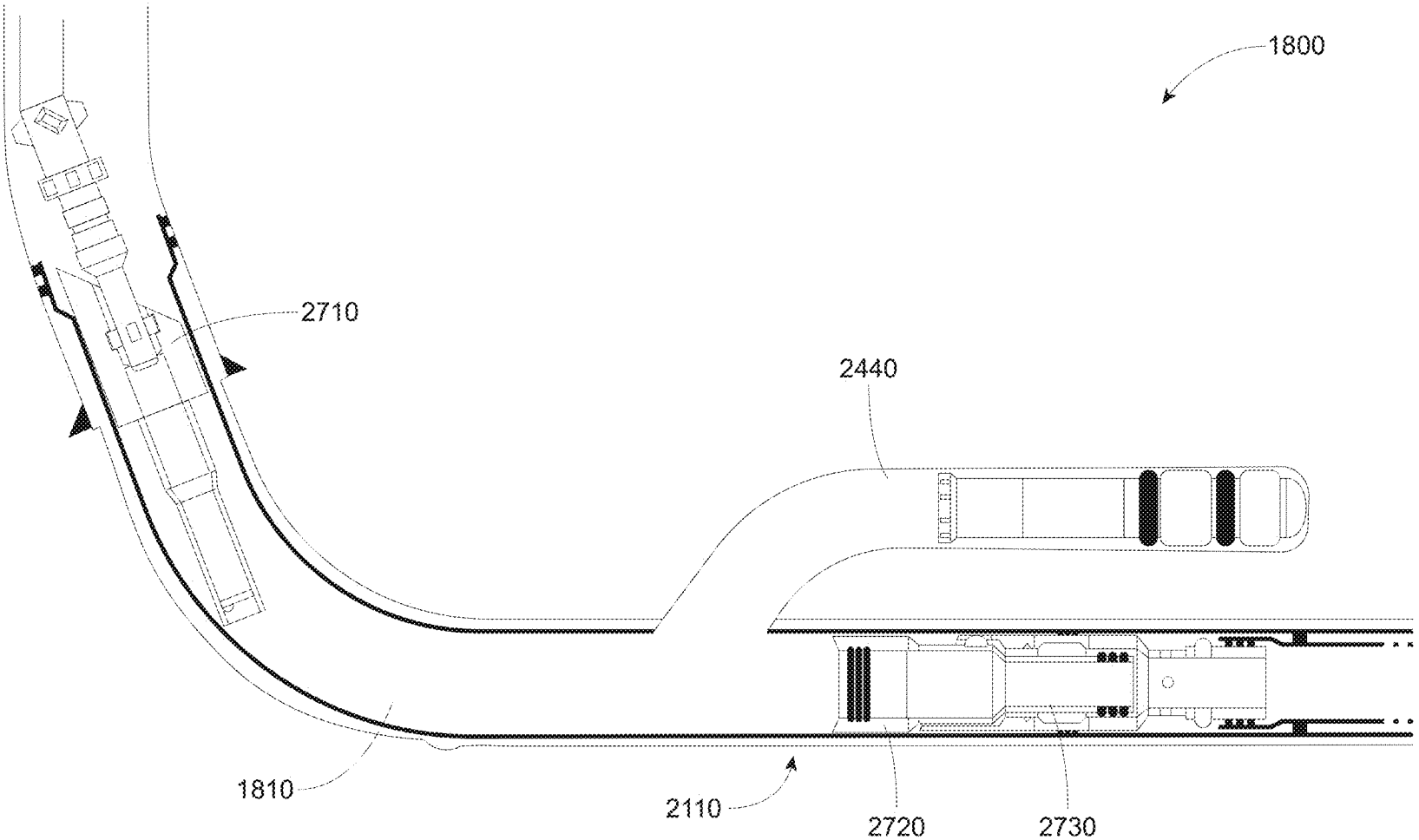

Turning to FIG. 28, illustrated is the well system 1800 of FIG. 27 after further drawing the whipface 2710 uphole, again similar to that disclosed above with regard to FIGS. 11A through 11E.

Figure 29:
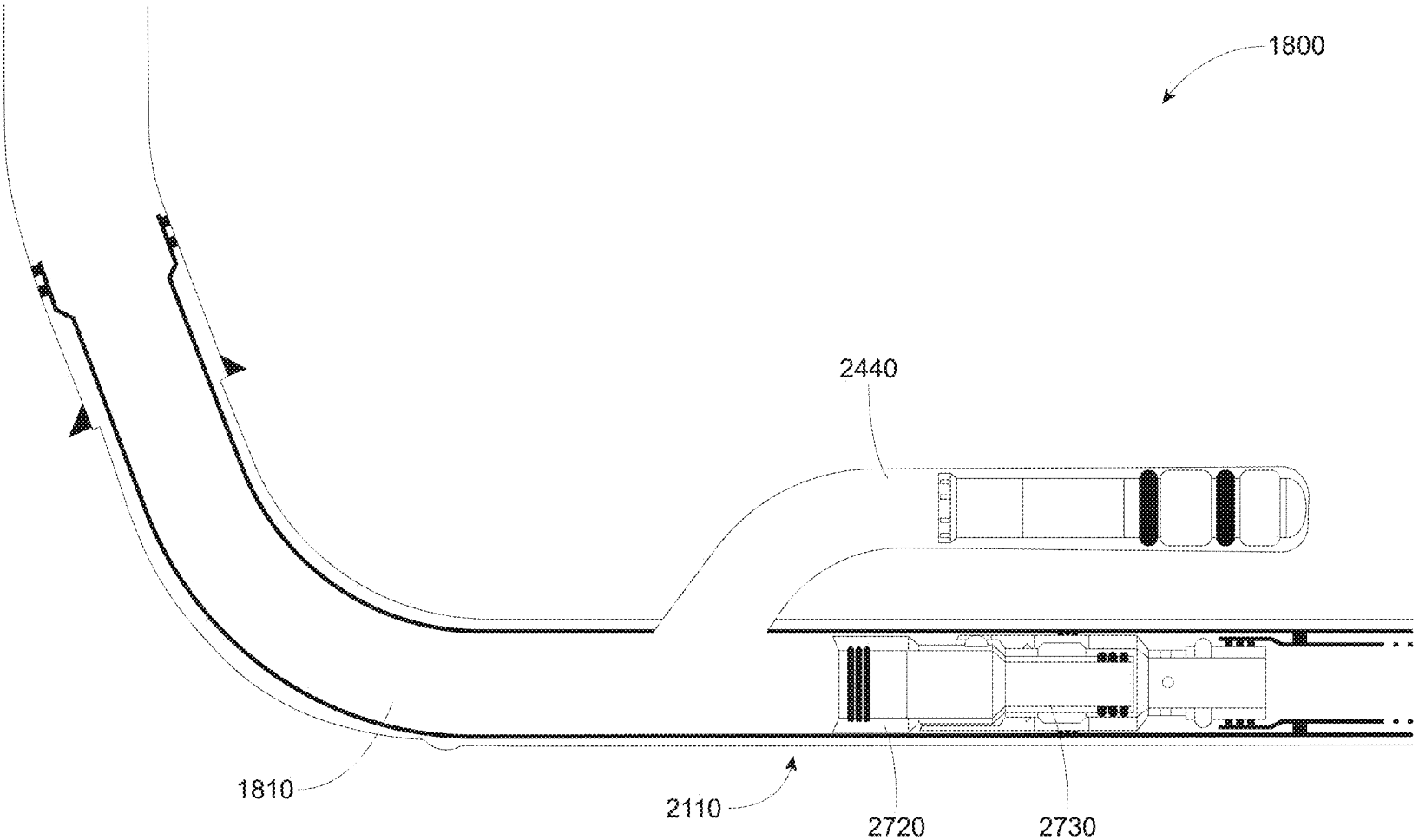

Turning to FIG. 29, illustrated is the well system 1800 of FIG. 28 after fully drawing the whipface 2710 uphole, again similar to that disclosed above with regard to FIGS. 11A through 11E.

Figure 30:
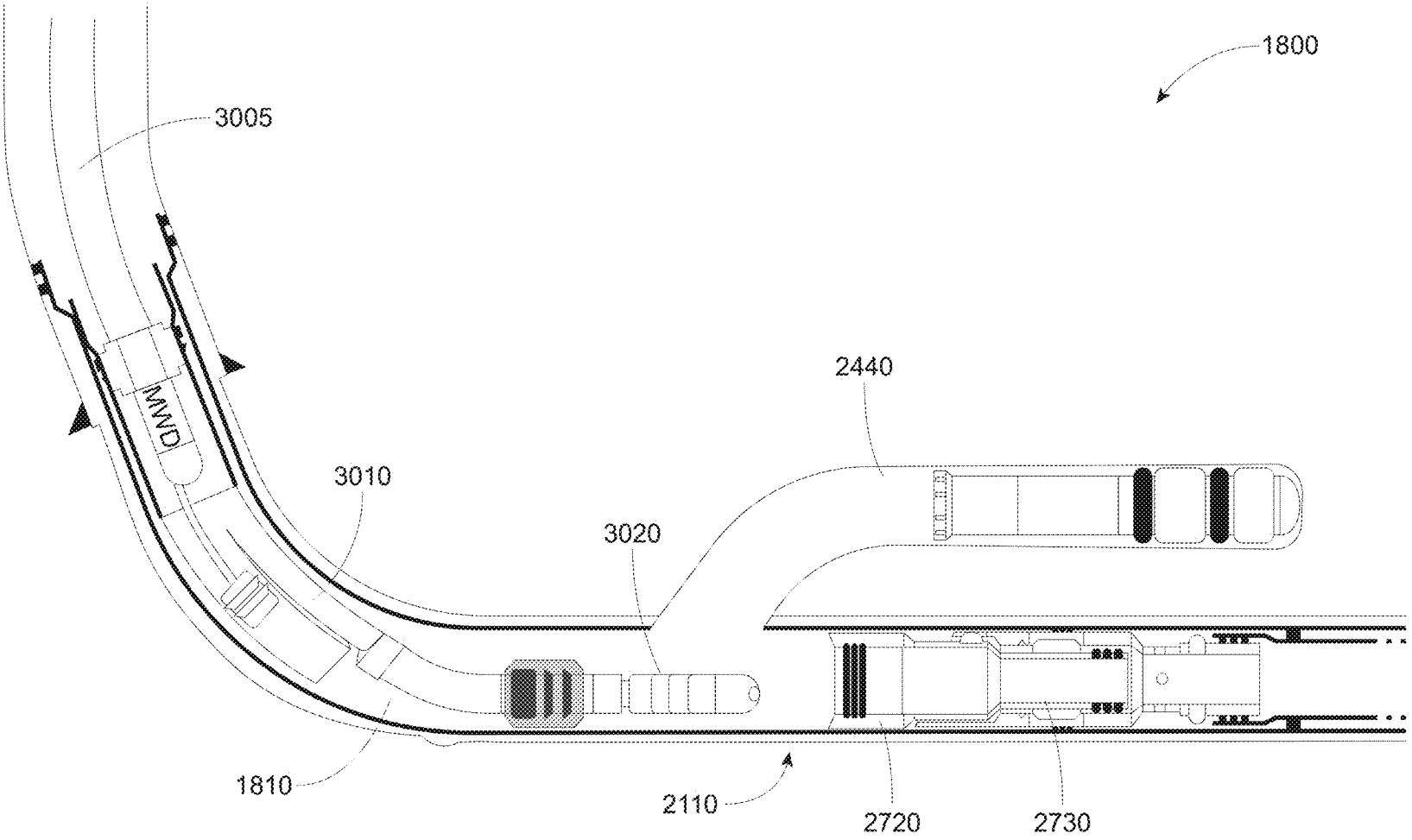

Turning to FIG. 30, illustrated is the well system 1800 of FIG. 29 after positioning a multilateral junction 3010 designed, manufactured and/or operated according to the disclosure within the main wellbore 1810 using a running tool 3005. The multilateral junction 3010 may be similar to one or more of the embodiments disclosed above, and thus may include a lateral locating assembly 3020. In the given embodiment, a sliding sleeve of the lateral locating assembly 3020 is in a first position (e.g., closed position), and thus is sealing the one or more production ports thereof.

Figure 31:
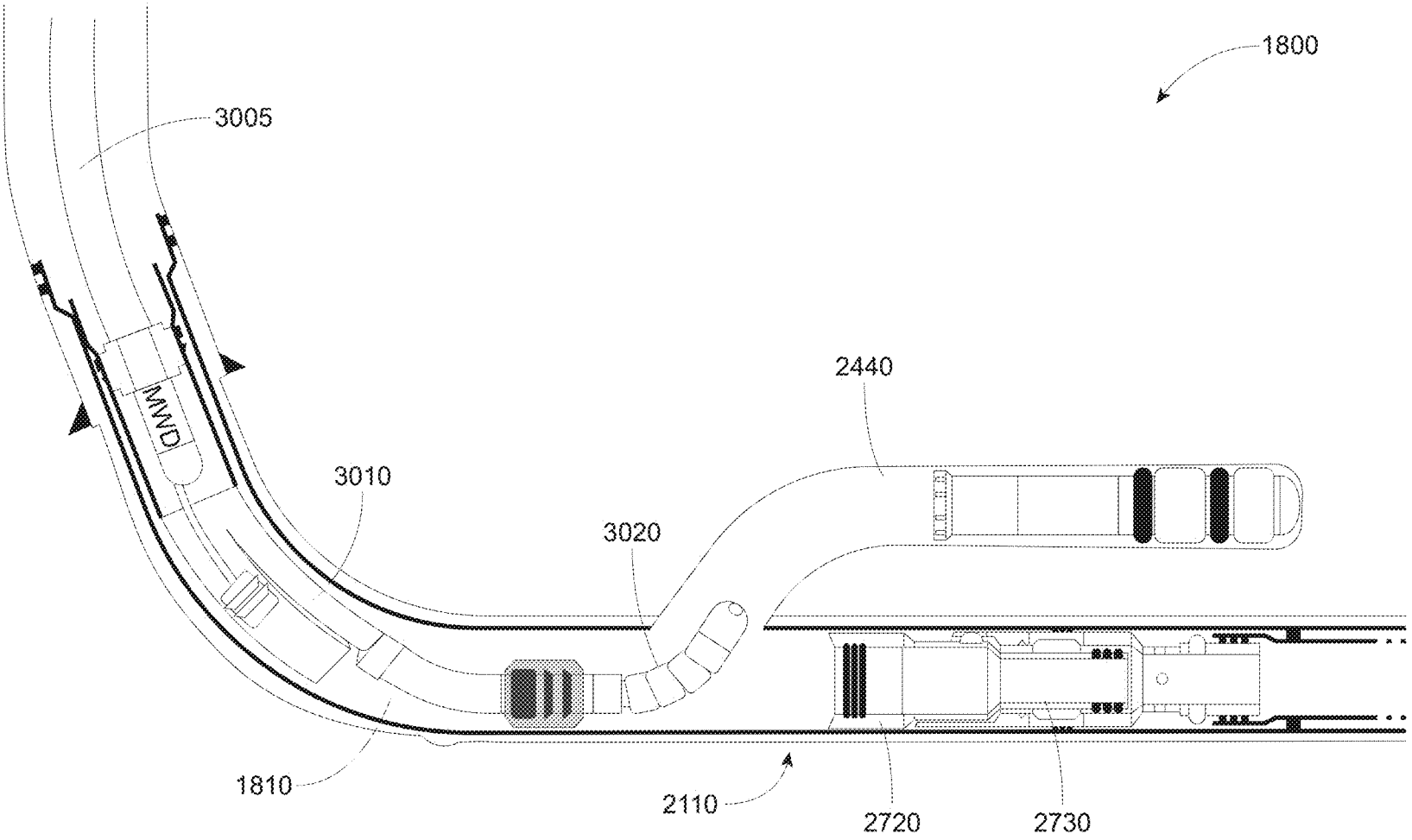

Turning to FIG. 31, illustrated is the well system 1800 of FIG. 30 after causing the bendable deflection tip of the lateral locating assembly 3020 to move from the straight position to the bent position, such that it can enter the lateral wellbore 2440. Again, the sliding sleeve remains in the first position (e.g., closed position) at this moment.

Figure 32:
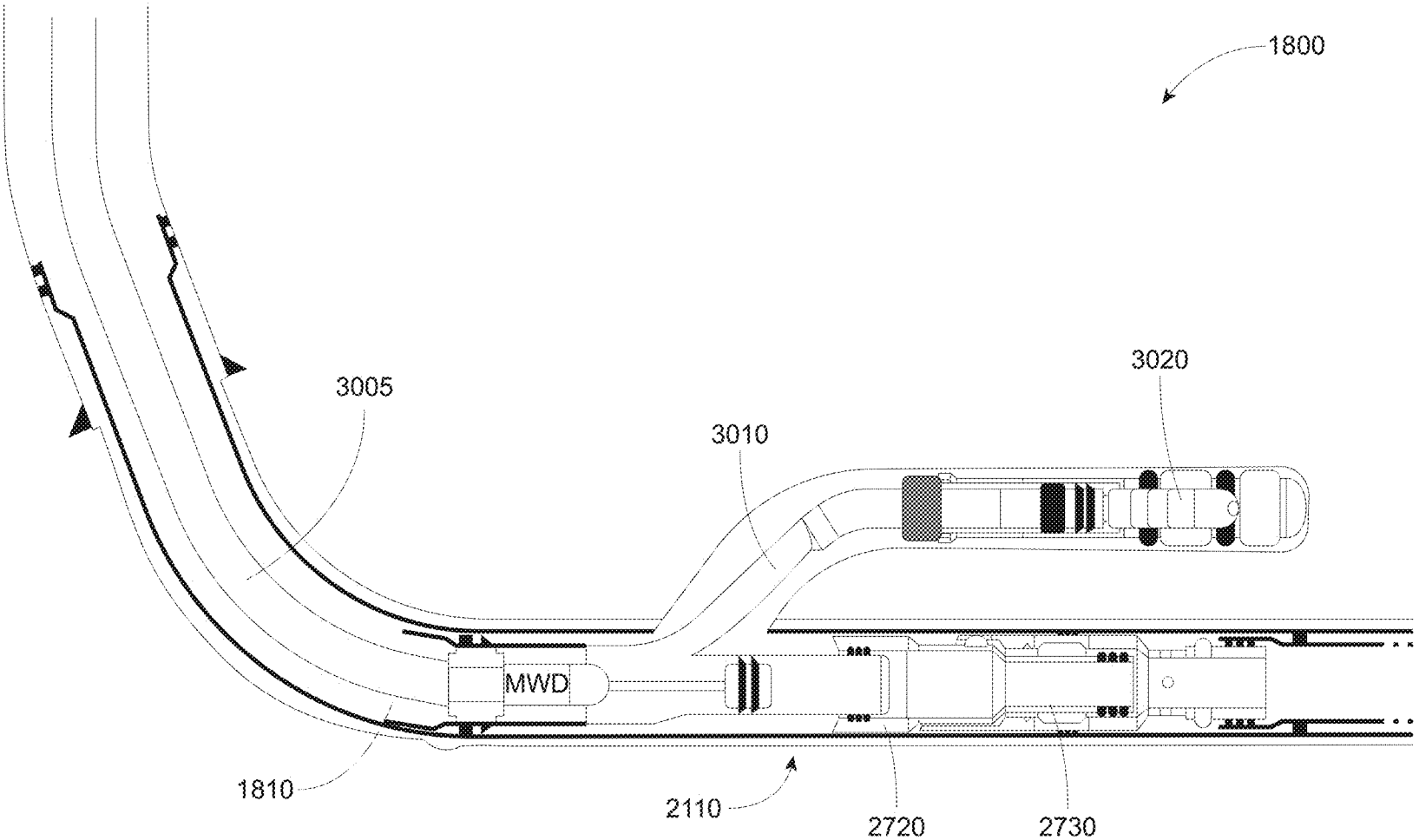

Turning to FIG. 32, illustrated is the well system 1800 of FIG. 31 after continuing to push the multilateral junction 3010 downhole until the shroud of the lateral locating assembly 3020 engages with a lateral liner of the lateral bore completion, and thus slides the sliding sleeve from the first position to a second position exposing the one or more production ports.

Figure 33:
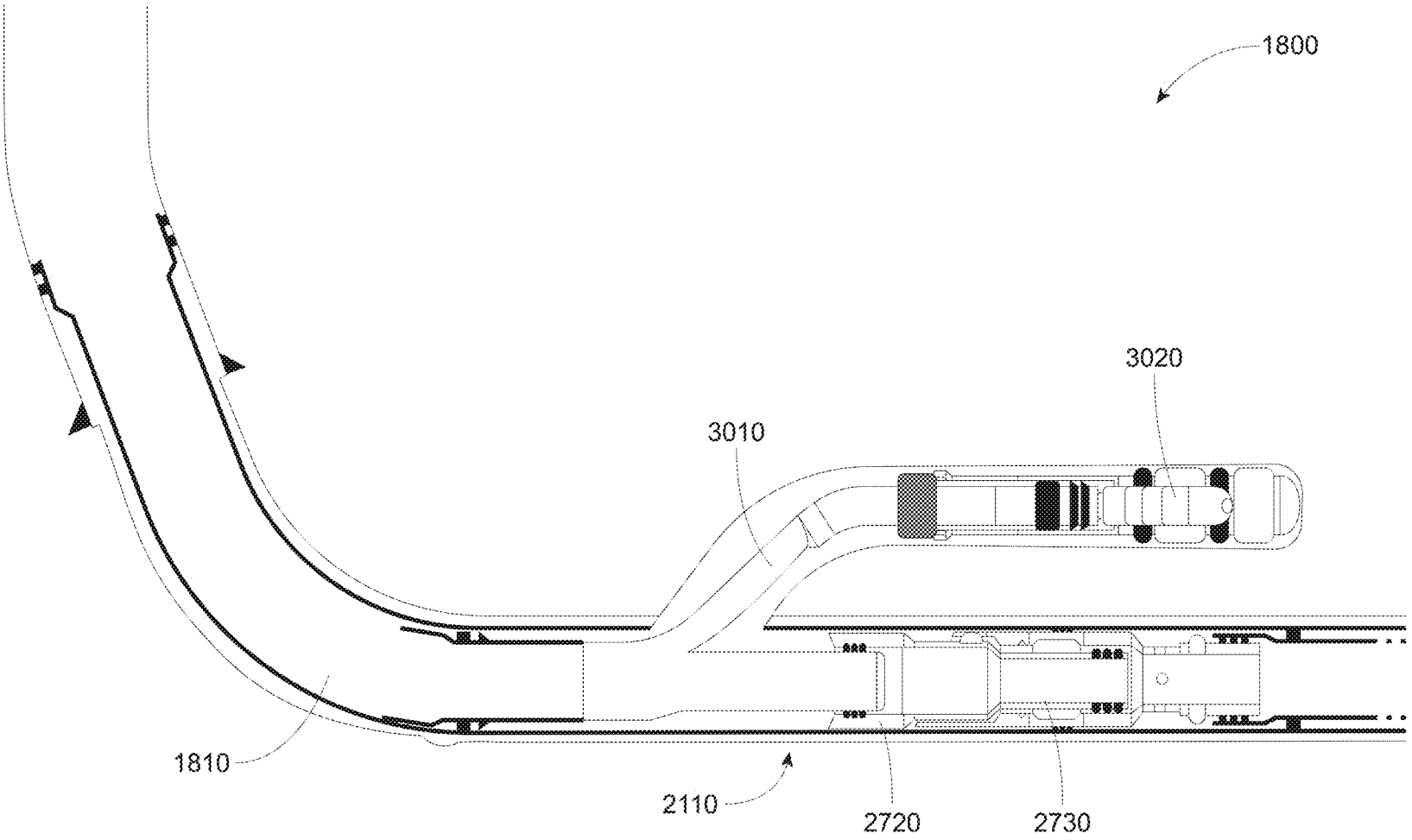

Turning to FIG. 33, illustrated is the well system 1800 of FIG. 32 after removing the running tool 3005, thereby leaving the lateral locating assembly 3020 with its sliding sleeve in the second position (e.g., open position).

Aspects disclosed herein include:

A. A whipstock, the whipstock including: 1) a whipface having an angled casing string exit surface; 2) a sub detachably coupled to the whipface; and 3) a bottom hole assembly fixedly coupled to the sub, the bottom hole assembly having one or more seals along an inner surface thereof.

B. A well system, the well system including: 1) a main wellbore extending through one or more subterranean formations; 2) a casing string located within the main wellbore; and 3) a whipstock located in the casing string proximate a junction where a lateral wellbore is to exit the main wellbore, the whipstock including: a) a whipface having an angled casing string exit surface; b) a sub detachably coupled to the whipface; and c) a bottom hole assembly fixedly coupled to the sub, the bottom hole assembly having one or more seals along an inner surface thereof.

C. A method, the method including: 1) forming a main wellbore through one or more subterranean formations; 2) positioning a casing string within the main wellbore; and 3) locating a whipstock in the casing string proximate a junction where a lateral wellbore is to exit the main wellbore, the whipstock including: a) a whipface having an angled casing string exit surface; b) a sub detachably coupled to the whipface; and c) a bottom hole assembly fixedly coupled to the sub, the bottom hole assembly having one or more seals along an inner surface thereof.

D. A lateral locating assembly, the lateral locating assembly including: 1) a tubular; 2) a bendable deflection tip coupled to the tubular, the bendable deflection tip configured to move between a straight position and a bent position upon the application of fluid pressure thereto; 3) one or more production ports coupling an interior of the tubular and an exterior of the tubular; and 4) a sliding sleeve positioned about the one or more production ports, the sliding sleeve configured to seal the one or more production ports when in a first position and expose the one or more production ports when in a second position.

E. A well system, the well system including: 1) a main wellbore extending through one or more subterranean formations; 2) a lateral wellbore extending from the main wellbore; and 3) a lateral locating assembly located in the main wellbore proximate an intersection between the main wellbore and the lateral wellbore, the lateral locating assembly including: a) a tubular; b) a bendable deflection tip coupled to the tubular, the bendable deflection tip configured to move between a straight position and a bent position upon the application of fluid pressure thereto; c) one or more production ports coupling an interior of the tubular and an exterior of the tubular; and d) a sliding sleeve positioned about the one or more production ports, the sliding sleeve configured to seal the one or more production ports when in a first position and expose the one or more production ports when in a second position.

F. A method, the method including: 1) forming a main wellbore through one or more subterranean formations; 2) forming a lateral wellbore from the main wellbore; and 3) positioning a lateral locating assembly proximate an intersection between the main wellbore and the lateral wellbore, the lateral locating assembly including: a) a tubular; b) a bendable deflection tip coupled to the tubular, the bendable deflection tip configured to move between a straight position and a bent position upon the application of fluid pressure thereto; c) one or more production ports coupling an interior of the tubular and an exterior of the tubular; and d) a sliding sleeve positioned about the one or more production ports, the sliding sleeve configured to seal the one or more production ports when in a first position and expose the one or more production ports when in a second position.

G. A multilateral junction, the multilateral junction including: 1) a y-block, the y-block including: a) a housing having a first end and a second opposing end; b) a single first bore extending into the housing from the first end; and c) second and third separate bores extending into the housing and branching off from the single first bore; 2) a mainbore leg having a first mainbore leg end coupled to the second bore and a second opposing mainbore leg end; 3) a lateral bore leg having a first lateral bore leg end coupled to the third bore and a second opposing lateral bore leg end; and 4) a lateral locating assembly coupled to the second opposing lateral bore leg end, the lateral locating assembly including: a) a tubular; and b) a bendable deflection tip coupled to the tubular, the bendable deflection tip configured to move between a straight position and a bent position upon the application of fluid pressure thereto.

H. A well system, the well system including: 1) a main wellbore extending through one or more subterranean formations; 2) a lateral wellbore extending from the main wellbore; and 3) a multilateral junction located in the main wellbore, the multilateral junction including: a) a y-block, the y-block including: i) a housing having a first end and a second opposing end; ii) a single first bore extending into the housing from the first end; and iii) second and third separate bores extending into the housing and branching off from the single first bore; b) a mainbore leg having a first mainbore leg end coupled to the second bore and a second opposing mainbore leg end; c) a lateral bore leg having a first lateral bore leg end coupled to the third bore and a second opposing lateral bore leg end; and d) a lateral locating assembly coupled to the second opposing lateral bore leg end, the lateral locating assembly including: i) a tubular; and ii) a bendable deflection tip coupled to the tubular, the bendable deflection tip configured to move between a straight position and a bent position upon the application of fluid pressure thereto.

I. A method, the method including: 1) forming a main wellbore through one or more subterranean formations; 2) forming a lateral wellbore from the main wellbore; and 3) positioning a multilateral junction proximate an intersection between the main wellbore and the lateral wellbore, the multilateral junction including: a) a y-block, the y-block including: i) a housing having a first end and a second opposing end; ii) a single first bore extending into the housing from the first end; and iii) second and third separate bores extending into the housing and branching off from the single first bore; b) a mainbore leg having a first mainbore leg end coupled to the second bore and a second opposing mainbore leg end; c) a lateral bore leg having a first lateral bore leg end coupled to the third bore and a second opposing lateral bore leg end; and d) a lateral locating assembly coupled to the second opposing lateral bore leg end, the lateral locating assembly including: i) a tubular; and ii) a bendable deflection tip coupled to the tubular, the bendable deflection tip configured to move between a straight position and a bent position upon the application of fluid pressure thereto.

Aspects A, B, C, D, E, F, G, H and I may have one or more of the following additional elements in combination: Element 1: wherein the sub is a lower sub, and further including an upper sub fixedly coupled to the whipface between the whipface and the lower sub. Element 2: wherein the upper sub includes a tubular that extends within the lower sub and at least a portion of the bottom hole assembly. Element 3: further including one or more debris collection devices located within the tubular. Element 4: further including a first course debris filter located within the tubular and a second fine debris filter located within the tubular downhole of the first course debris filter. Element 5: further including one or more shear features detachably coupling the whipface and upper sub to the lower sub. Element 6: further including a plurality of members and member profiles in the lower sub and upper sub, the members and member profiles configured to cooperate to rotationally fix the lower sub and the upper sub. Element 7: wherein the bottom hole assembly includes an alignment key located along an outer surface thereof. Element 8: wherein the bottom hole assembly includes one or more second seals located along the outer surface thereof proximate a downhole end thereof, the one or more second seals configured to engage and seal with a mainbore completion. Element 9: wherein the bottom hole assembly further includes an anchor positioned between the alignment key and the one or more second seals, the anchor configured to laterally fix the bottom hole assembly relative to the mainbore completion. Element 10: further including positioning a mainbore completion within the main wellbore prior to locating the whipstock in the casing string. Element 11: further including milling a pocket in the casing string at the junction using a milling tool and the whipface. Element 12: further including drilling the lateral wellbore from the main wellbore after milling the pocket. Element 13: further including positioning a lateral bore completion within the lateral wellbore after drilling. Element 14: further including detaching the whipface from the sub after positioning the lateral bore completion within the lateral wellbore, the detaching exposing the more or more seals. Element 15: further including placing a multilateral junction including a mainbore leg and a lateral bore leg within the main wellbore. Element 16: wherein placing the multilateral junction includes stabbing the mainbore leg into the one or more seals of the bottom hole assembly and stabbing the lateral bore leg into additional seals of the lateral bore completion. Element 17: further including a shroud positioned about the tubular and removably coupled to the sliding sleeve. Element 18: wherein the sliding sleeve includes a collet, the collet fixing the sliding sleeve to the shroud when the sliding sleeve is in the first position and releasing the sliding sleeve from the shroud when the sliding sleeve is in the second position. Element 19: wherein the shroud includes a first collet groove configured to engage the collet in an expanded state to fix the sliding sleeve to the shroud when the sliding sleeve is in the first position and the tubular includes a second collet groove configured to accept the collet in a collapsed state to release the sliding sleeve from the shroud when the sliding sleeve is in the second position. Element 20: further including a snap ring and snap ring groove located in ones of the tubular and the sliding sleeve, the snap ring configured to engage with the snap ring groove when the sliding sleeve is in the second position to fix the sliding sleeve in the second position.

Element 21: further including a packer coupled to the tubular uphole of the bendable deflection tip. Element 22: wherein the packer is a swell packer protected by the shroud when the sliding sleeve is in the first position. Element 23: further including one or more swab cups protected by the shroud when the sliding sleeve is in the first position, the one or more swab cups configured to provide a seal until the swell packer fully sets. Element 24: further including one or more shear features releasably coupled to the shroud to hold the sliding sleeve in the first position. Element 25: further including one or more no go blades coupled to a tip of the bendable deflection tip, the one or more no go blades configured to prevent the bendable deflection tip from accessing a main wellbore completion. Element 26: further including a shroud positioned about the tubular and removably coupled to the sliding sleeve. Element 27: further including applying fluid pressure to the bendable deflection tip to move the bendable deflection tip to the bent position. Element 28: further including entering the lateral wellbore with the bendable deflection tip in the bent position. Element 29: further including returning the bendable deflection tip back to the straight position from the bent position after entering the lateral wellbore. Element 30: further including pushing the lateral locating assembly downhole until the shroud engages with a tubular, the pushing moving the sliding sleeve from the first position to the second position and releasing the sliding sleeve from the shroud. Element 31: further including continuing to push the lateral locating assembly with the sliding sleeve in the second position downhole until properly placed within a lateral bore completion. Element 32: further including producing hydrocarbons through the exposed one or more production ports when the lateral locating assembly is properly placed within the lateral completion. Element 33: further including: 1) one or more production ports coupling an interior of the tubular and an exterior of the tubular; 2) a sliding sleeve positioned about the one or more production ports, the sliding sleeve configured to seal the one or more production ports when in a first position and expose the one or more production ports when in a second position; and 3) a shroud positioned about the tubular and removably coupled to the sliding. Element 34: wherein the mainbore leg is sealingly coupled with a mainbore completion in the main wellbore and the lateral bore leg is sealingly coupled with a lateral bore completion in the lateral bore. Element 35: further including applying fluid pressure to the bendable deflection tip to move the bendable deflection tip to the bent position. Element 36: further including pushing the multilateral junction downhole until the lateral bore leg having the bendable deflection tip in the bent position enters the lateral wellbore. Element 37: wherein pushing the multilateral junction downhole until the lateral bore leg having the bendable deflection tip in the bent position enters the lateral wellbore occurs without the use of a deflector assembly in the main wellbore. Element 38: further including returning the bendable deflection tip back to the straight position from the bent position after the lateral bore leg having the bendable deflection tip in the bent position enters the lateral wellbore. Element 39: further including continuing to push the multilateral junction downhole until the mainbore leg sealingly engages with a mainbore completion in the main wellbore and the lateral bore leg sealingly engages with a lateral bore completion in the lateral wellbore. Element 40: further including producing hydrocarbons through the multilateral junction having the deflection tip in the straight position. Element 41: further including: 1) one or more production ports coupling an interior of the tubular and an exterior of the tubular; and 2) a sliding sleeve positioned about the one or more production ports, the sliding sleeve configured to seal the one or more production ports when in a first position and expose the one or more production ports when in a second position; and 3) a shroud positioned about the tubular and removably coupled to the sliding sleeve.

Those skilled in the art to which this application relates will appreciate that other and further additions, deletions, substitutions and modifications may be made to the described embodiments.

What is claimed is:

1. A multilateral junction, comprising:

a y-block, the y-block including:

a housing having a first end and a second opposing end;

a single first bore extending into the housing from the first end; and second and third separate bores extending into the housing and branching off from the single first bore;

a mainbore leg having a first mainbore leg end coupled to the second bore and a second opposing mainbore leg end;

a lateral bore leg having a first lateral bore leg end coupled to the third bore and a second opposing lateral bore leg end; and a lateral locating assembly coupled to the second opposing lateral bore leg end, the lateral locating assembly including:

a tubular;

a bendable deflection tip coupled to the tubular, the bendable deflection tip configured to move between a straight position and a bent position upon the application of fluid pressure thereto;

one or more production ports coupling an interior of the tubular and an exterior of the tubular:

a sliding sleeve positioned about the one or more production ports, the sliding sleeve configured to seal the one or more production ports when in a first position and expose the one or more production ports when in a second position; and a shroud positioned about the tubular and removably coupled to the sliding sleeve, wherein the sliding sleeve includes a holding feature, the holding fixing the sliding sleeve to the shroud when the sliding sleeve is in the first position and releasing the sliding sleeve from the shroud when the sliding sleeve is in the second position.

2. The multilateral junction as recited in claim 1, wherein the holding feature is a collet, the collet fixing the sliding sleeve to the shroud when the sliding sleeve is in the first position and releasing the sliding sleeve from the shroud when the sliding sleeve is in the second position.

3. The multilateral junction as recited in claim 2, wherein the shroud includes a first collet groove configured to engage the collet in an expanded state to fix the sliding sleeve to the shroud when the sliding sleeve is in the first position and the tubular includes a second collet groove configured to accept the collet in a collapsed state to release the sliding sleeve from the shroud when the sliding sleeve is in the second position.

4. The multilateral junction as recited in claim 2, further including a snap ring and snap ring groove located in ones of the tubular and the sliding sleeve, the snap ring configured to engage with the snap ring groove when the sliding sleeve is in the second position to fix the sliding sleeve in the second position.

5. The multilateral junction as recited in claim 1, further including a packer coupled to the tubular, the packer coupled uphole of the bendable deflection tip.

6. The multilateral junction as recited in claim 5, wherein the packer is a swell packer protected by the shroud when the sliding sleeve is in the first position.

7. The multilateral junction as recited in claim 6, further including one or more swab cups protected by the shroud when the sliding sleeve is in the first position, the one or more swab cups configured to provide a seal until the swell packer fully sets.

8. The multilateral junction as recited in claim 1, wherein the holding feature is one or more shear features releasably coupled to the shroud to hold the sliding sleeve in the first position.

9. The multilateral junction as recited in claim 1, further including one or more no go blades coupled to a tip of the bendable deflection tip, the one or more no go blades configured to prevent the bendable deflection tip from accessing a main wellbore completion.

10. A well system, comprising:

a main wellbore extending through one or more subterranean formations;

a lateral wellbore extending from the main wellbore; and a multilateral junction located in the main wellbore, the multilateral junction including:

a y-block, the y-block including:

a housing having a first end and a second opposing end;

a single first bore extending into the housing from the first end; and second and third separate bores extending into the housing and branching off from the single first bore;

a mainbore leg having a first mainbore leg end coupled to the second bore and a second opposing mainbore leg end;

a lateral bore leg having a first lateral bore leg end coupled to the third bore and a second opposing lateral bore leg end; and a lateral locating assembly coupled to the second opposing lateral bore leg end, the lateral locating assembly including:

a tubular; and a bendable deflection tip coupled to the tubular, the bendable deflection tip configured to move between a straight position and a bent position upon the application of fluid pressure thereto;

one or more production ports coupling an interior of the tubular and an exterior of the tubular;

a sliding sleeve positioned about the one or more production ports, the sliding sleeve configured to seal the one or more production ports when in a first position and expose the one or more production ports when in a second position; and a shroud positioned about the tubular and removably coupled to the sliding sleeve, wherein the sliding sleeve includes a holding feature, the holding fixing the sliding sleeve to the shroud when the sliding sleeve is in the first position and releasing the sliding sleeve from the shroud when the sliding sleeve is in the second position.

11. The well system as recited in claim 10, wherein the holding feature is a collet, the collet fixing the sliding sleeve to the shroud when the sliding sleeve is in the first position and releasing the sliding sleeve from the shroud when the sliding sleeve is in the second position.

12. The well system as recited in claim 11, wherein the shroud includes a first collet groove configured to engage the collet in an expanded state to fix the sliding sleeve to the shroud when the sliding sleeve is in the first position and the tubular includes a second collet groove configured to accept the collet in a collapsed state to release the sliding sleeve from the shroud when the sliding sleeve is in the second position.

13. The well system as recited in claim 11, further including a snap ring and snap ring groove located in ones of the tubular and the sliding sleeve, the snap ring configured to engage with the snap ring groove when the sliding sleeve is in the second position to fix the sliding sleeve in the second position.

14. The well system as recited in claim 10, further including a packer coupled to the tubular, the packer coupled uphole of the bendable deflection tip.

15. The well system as recited in claim 14, wherein the packer is a swell packer protected by the shroud when the sliding sleeve is in the first position.

16. The well system as recited in claim 15, further including one or more swab cups protected by the shroud when the sliding sleeve is in the first position, the one or more swab cups configured to provide a seal until the swell packer fully sets.

17. The well system as recited in claim 10, wherein the holding feature is one or more shear features releasably coupled to the shroud to hold the sliding sleeve in the first position.

18. The well system as recited in claim 10, further including one or more no go blades coupled to a tip of the bendable deflection tip, the one or more no go blades configured to prevent the bendable deflection tip from accessing a main wellbore completion.

19. The well system as recited in claim 10, wherein the mainbore leg is sealingly coupled with a mainbore completion in the main wellbore and the lateral bore leg is sealingly coupled with a lateral bore completion in the lateral bore.

20. A method, comprising:

forming a main wellbore through one or more subterranean formations;

forming a lateral wellbore from the main wellbore; and positioning a multilateral junction proximate an intersection between the main wellbore and the lateral wellbore, the multilateral junction including:

a y-block, the y-block including:

a housing having a first end and a second opposing end;

a single first bore extending into the housing from the first end; and second and third separate bores extending into the housing and branching off from the single first bore;

a mainbore leg having a first mainbore leg end coupled to the second bore and a second opposing mainbore leg end;

a lateral bore leg having a first lateral bore leg end coupled to the third bore and a second opposing lateral bore leg end; and a lateral locating assembly coupled to the second opposing lateral bore leg end, the lateral locating assembly including:

a tubular; and a bendable deflection tip coupled to the tubular, the bendable deflection tip configured to move between a straight position and a bent position upon the application of fluid pressure thereto;

one or more production ports coupling an interior of the tubular and an exterior of the tubular:

a sliding sleeve positioned about the one or more production ports, the sliding sleeve configured to seal the one or more production ports when in a first position and expose the one or more production ports when in a second position; and a shroud positioned about the tubular and removably coupled to the sliding sleeve, wherein the sliding sleeve includes a holding feature, the holding fixing the sliding sleeve to the shroud when the sliding sleeve is in the first position and releasing the sliding sleeve from the shroud when the sliding sleeve is in the second position.

21. The method as recited in claim 20, further including applying fluid pressure to the bendable deflection tip to move the bendable deflection tip to the bent position.

22. The method as recited in claim 21, further including pushing the multilateral junction downhole until the lateral bore leg having the bendable deflection tip in the bent position enters the lateral wellbore.

23. The method as recited in claim 22, wherein pushing the multilateral junction downhole until the lateral bore leg having the bendable deflection tip in the bent position enters the lateral wellbore occurs without the use of a deflector assembly in the main wellbore.

24. The method as recited in claim 22, further including returning the bendable deflection tip back to the straight position from the bent position after the lateral bore leg having the bendable deflection tip in the bent position enters the lateral wellbore.

25. The method as recited in claim 24, further including continuing to push the multilateral junction downhole until the mainbore leg sealingly engages with a mainbore completion in the main wellbore and the lateral bore leg sealingly engages with a lateral bore completion in the lateral wellbore.

26. The method as recited in claim 25, further including producing hydrocarbons through the multilateral junction having the deflection tip in the straight position.

27. The method as recited in claim 20, wherein the holding feature is a collet, the collet fixing the sliding sleeve to the shroud when the sliding sleeve is in the first position and releasing the sliding sleeve from the shroud when the sliding sleeve is in the second position.

28. The method as recited in claim 27, wherein the shroud includes a first collet groove configured to engage the collet in an expanded state to fix the sliding sleeve to the shroud when the sliding sleeve is in the first position and the tubular includes a second collet groove configured to accept the collet in a collapsed state to release the sliding sleeve from the shroud when the sliding sleeve is in the second position.

29. The method as recited in claim 27, further including a snap ring and snap ring groove located in ones of the tubular and the sliding sleeve, the snap ring configured to engage with the snap ring groove when the sliding sleeve is in the second position to fix the sliding sleeve in the second position.

30. The method as recited in claim 20, further including a packer coupled to the tubular, the packer coupled uphole of the bendable deflection tip.

31. The method as recited in claim 30, wherein the packer is a swell packer protected by the shroud when the sliding sleeve is in the first position.

32. The method as recited in claim 31, further including one or more swab cups protected by the shroud when the sliding sleeve is in the first position, the one or more swab cups configured to provide a seal until the swell packer fully sets.

33. The method as recited in claim 20, wherein the holding feature is one or more shear features releasably coupled to the shroud to hold the sliding sleeve in the first position.

34. The method as recited in claim 20, further including one or more no go blades coupled to a tip of the bendable deflection tip, the one or more no go blades configured to prevent the bendable deflection tip from accessing a main wellbore completion.

* * * * *